United States Patent [19]

Hiraike et al.

[11] 4,375,917

[45] Mar. 8, 1983

[54] SINGLE-CHIP, MOS-LSI MICROPROCESSOR CONTROLLED ELECTROPHOTOGRAPHIC COPYING MACHINE

[75] Inventors: Shizuka Hiraike, Yamatokoriyama; Yukihiro Yoshida, Ikoma; Shintaro Hashimoto, Nara; Mitsuo Tada, Nara; Toshio Yamagishi, Nara, all of Japan

[73] Assignee: Sharp Kabushiki Kaisha, Osaka, Japan

[21] Appl. No.: 40,535

[22] Filed: May 21, 1979

Related U.S. Application Data

[63] Continuation of Ser. No. 794,140, May 21, 1977, abandoned.

[30] Foreign Application Priority Data

May 6, 1976 [JP] Japan ..... 51-52391

[51] Int. Cl.[3] ..... G03G 15/00

[52] U.S. Cl. ..... 355/14 R; 364/200; 355/14 C

[58] Field of Search ..... 355/14 R, 14 C; 364/200 MS File, 900 MS File

[56] References Cited

U.S. PATENT DOCUMENTS

| | | | |
|---|---|---|---|
| 3,936,180 | 2/1976 | Willard et al. | 355/14 R |
| 3,936,182 | 2/1976 | Sheikh | 355/14 |
| 4,025,902 | 5/1977 | Nakao et al. | 364/900 |
| 4,058,850 | 11/1977 | Sheikh | 364/900 |
| 4,126,390 | 11/1978 | Connin | 355/14 C |
| 4,162,848 | 7/1979 | Platt | 355/14 C |
| 4,202,622 | 5/1980 | Kawatsura | 355/14 C |
| 4,240,739 | 12/1980 | Koumura | 355/14 R |

*Primary Examiner*—Harvey E. Springborn

*Attorney, Agent, or Firm*—Birch, Stewart, Kolasch and Birch

[57] ABSTRACT

Within an electrophotographic copying machine having a predetermined number of sensing elements each deriving an output indicative of respective one of operating states of the machine, there is provided a single chip, MOS-LSI microprocessor responsive to the outputs of the sensing elements to control the machine in a sequential or serial mode. The microprocessor contains storage means storing a string of instructions, processing means to fetch sequentially the instructions from the storage means and to deal with the fetched instructions, first input means to receive synchronizing signals generated within the body of the machine, first output means to determine with aid of the processing means whether any synchronizing signal is inputted via the first input means and to produce confirmation signals after confirming the sensed operating states of the machine, second input means to introduce through the sensing elements the confirmation signals supplied via the first output means, and a second output means to process with aid of the processing means the signals received by the first input means and the second input means and to consequently produce control signals effective to control operation of the machine.

6 Claims, 41 Drawing Figures

| CODE | INSTRUC-TION | MICRO ORDER | CODE | INSTRUC-TION | MICRO ORDER |
|---|---|---|---|---|---|
| 00000001 | KTA | 25 27 | 010----- | LB | 14 |
| 00000010 | TAM | 32 24 33 | 01011110 | RTN | 2 10 |
| 00000011 | COMA | 26 27 | 01100000 | IDFR | a |
| 000011-- | SM | 36 | 01011111 | RTN1 | 2 8 10 |
| 000001-- | RSM | 36 | 01100001 | IDFS | a |
| 000010-- | TM | 38 | 01100010 | W1R | a |
| 000100-- | EXC | 16 27 34 33 | 01100011 | W1S | a |
| 000101-- | EXCI | 15 16 27 34 33 | 01100100 | TB | b |
| 000110-- | LDA | 16 27 33 | 01100101 | TA | b |
| 000111 | EXCD | 15 16 27 34 33 | 01100110 | TK | b |
| 0010---- | LAX | $\overline{\text{LAX}}$ 22 27 | 01100111 | TKN2 | b |
| 0011---- | ADX | 2 24 27 30 | 01101000 | TKN1 | c |
| 01010100 | NPR | h | 01101001 | TKF | c |
| 01010101 | ATSF | e 24 | 01101010 | TAK | c |
| 01010110 | ATRF | e 26 | 01101011 | TTAB | c |
| 01010111 | ATF | e 24 26 | 01101101 | TC | d |
| 01011000 | INCB | 15 24 33 | 01101110 | RSC | d |
| 01011001 | ADD | 24 27 33 | 01101111 | SC | d |
| 01011010 | ADD1 | 23 24 28 33 | 0111---- | SSR | 4 |
| 01011011 | ADD11 | 23 24 27 30 33 | 10------ | TRO | 2 |
| 01011100 | DECB | 15 | 11------ | TR1 | |
| 01011101 | NPS | 62 | | | |

FIG.6

| BL \ Bu | ZERO BLOCK (X register) 0 0 | FIRST BLOCK (Y register) 0 1 | SECOND BLOCK (Z register) 1 0 | THIRD BLOCK (M register) 1 1 |
|---|---|---|---|---|
| 0 0 0 0 | ( 0 ) | ( 1 ) | ( 2 ) | ( 3 ) |
| 1 1 0 0 | ( 16 ) | ( 17 ) | ( 18 ) | ( 19 ) |
| 1 1 0 1 | ( 4 ) | ( 5 ) | ( 6 ) | ( 7 ) |
| 1 1 1 0 | ( 8 ) | ( 9 ) | ( 10 ) | ( 11 ) |
| 1 1 1 1 | ( 12 ) | ( 13 ) | ( 14 ) | ( 15 ) |

FIG.15 page 13

| ADDRESS | CODE | LABEL | MNEMONICS | OPERAND | COMMENT |
|---|---|---|---|---|---|
| 00 | 00100000 | | LAX | 0 | F1-F4 (Clear) |
| 01 | 01010111 | | ATF | | |
| 02 | 01100001 | | IDFS | | |
| 03 | 01010100 | | NPR | | |
| 04 | 01101110 | | RSC | | |
| 05 | 01000000 | | LB | (0) | XReg |
| 06 | 11000110 | | TR1 | R-O | O→X |
| 07 | 01000001 | | LB | (1) | YReg |
| 08 | 11000110 | | TR1 | R-O | O→Y |
| 09 | 01000010 | | LB | (2) | ZReg |
| 10 | 11000110 | | TR1 | R-O | O→Z |
| 11 | 01000011 | | LB | (3) | MReg |
| 12 | 11000110 | | TR1 | R-O | O→M |
| 13 | 11001010 | | TR1 | Test-J | |
| 14 | 10010001 | | TRO | H1317 | |
| 15 | 01110100 | | SSR | | |
| 16 | 10010100 | | TRO | H0420 | |
| 17 | 11001010 | H1317 | TR1 | Test-J | |
| 18 | 10010101 | | TRO | H1321 | |
| 19 | 01111100 | J1319 | SSR | | |
| 20 | 10110001 | | TRO | H1249 | |
| 21 | 11001010 | H1321 | TR1 | Test-J | |
| 22 | 10011001 | | TRO | H1325 | |
| 23 | 01111001 | | SSR | | |
| 24 | 10100111 | | TRO | H0939 | |
| 25 | 11001010 | H1325 | TR1 | Test-J | |
| 26 | 10011101 | | TRO | H1329 | |
| 27 | 01111000 | | SSR | | |
| 28 | 10001000 | | TRO | H0808 | |
| 29 | 11001010 | H1329 | TR1 | Test-J | |
| 30 | 10100001 | | TRO | H1333 | |
| 31 | 01110100 | | SSR | | |

| ADDRESS | CODE | LABEL | MNEMONICS | OPERAND | COMMENT |
|---|---|---|---|---|---|
| 32 | 10001010 | | TRO | H0410 | |
| 33 | 11011001 | H1333 | TR1 | JR-a-J | |
| 34 | 10100101 | | TRO | H1337 | |
| 35 | 01110101 | H1335 | SSR | | JAM |
| 36 | 10111000 | | TRO | H0556 | |
| 37 | 11001100 | H1337 | TR1 | MS1-J | |
| 38 | 10101000 | | TRO | H1340 | |
| 39 | 10100011 | | TRO | H1335 | |
| 40 | 11001110 | H1340 | TR1 | $MS_2$-J | |
| 41 | 10101011 | | TRO | H1343 | |
| 42 | 10100011 | | TRO | H1335 | JAM |
| 43 | 01110100 | H1343 | SSR | | |
| 44 | 10101110 | | TRO | H0446 | |
| 45 | 11010111 | H1345 | TR1 | CSSR-J | |
| 46 | 10110100 | | TRO | H1352 | |
| 47 | 01010000 | | LB | (16) | CSS-ON |
| 48 | 00001111 | | SM | 3 | |
| 49 | 01000000 | | LB | (0) | A F/F-S |
| 50 | 00001100 | | SM | 0 | |
| 51 | 10111101 | | TRO | H1361 | |
| 52 | 11110101 | H1352 | TR1 | PR-ON | |
| 53 | 11001010 | | TR1 | Test-J | |
| 54 | 10111001 | | TRO | H1357 | |
| 55 | 11100100 | | TR1 | M→W | |
| 56 | 10010011 | | TRO | H1319 | |
| 57 | 11000111 | H1357 | TR1 | WTL-J | |
| 58 | 10111101 | | TRO | H1361 | |
| 59 | 01001100 | | LB | (12) | HLR-ON |
| 60 | 00001100 | | SM | 0 | |
| 61 | 01111100 | H1361 | SSR | | |
| 62 | 10000000 | | TRO | H1200 | |

page 12

FIG. 16

| ADDRESS | CODE | LABEL | MNEMONICS | OPERAND | COMMENT |
|---|---|---|---|---|---|
| 00 | 11100000 | H1200 | TR1 | RL-OFF | DFC-ON |
| 01 | 01000000 | H1201 | LB | (0) | D F/F-R |
| 02 | 00000111 | | RSM | 3 | |
| 03 | 11000111 | H1203 | TR1 | WTL-J | |
| 04 | 11100101 | | TR1 | HLR-OFF | |
| 05 | 11000000 | | TR1 | $MS_4$-1 | |
| 06 | 11010100 | | TR1 | $MS_7$-J | |
| 07 | 11011111 | | TR1 | MSS-OFF | |
| 08 | 11011000 | | TR1 | Ja-1 | |
| 09 | 10110110 | | TRO | H1254 | JAM |
| 10 | 11011010 | | TR1 | PB-J | |
| 11 | 10000011 | | TRO | H1203 | |
| 12 | 01001010 | | LB | (10) | |
| 13 | 01100101 | | TA | | |
| 14 | 00001111 | H1214 | SM | 3 | D F/F-S |
| 15 | 11000111 | H1215 | TR1 | WTL-J | |
| 16 | 11100101 | | TR1 | HLR-OFF | |
| 17 | 11000000 | | TR1 | MS4-1 | |
| 18 | 11010100 | | TR1 | $MS_7$-J | |
| 19 | 11011111 | | TR1 | MSS-OFF | |
| 20 | 11011000 | | TR1 | Ja-1 | |
| 21 | 10110110 | | TRO | H1254 | JAM |
| 22 | 11011010 | | TR1 | PB-J | |
| 23 | 10000001 | | TRO | H1201 | |
| 24 | 11011011 | | TR1 | PA-J | |
| 25 | 10001111 | | TRO | H1215 | |
| 26 | 01000000 | | LB | (0) | D F/F-J |
| 27 | 00001011 | | TM | 3 | |
| 28 | 10001110 | | TRO | H1214 | |
| 29 | 00000111 | | RSM | 3 | D F/F-R |
| 30 | 00001000 | | TM | 0 | A F/F-J |
| 31 | 10100011 | | TRO | H1235 | |
| 32 | 00000100 | | RSM | 0 | A F/F-R |
| 33 | 01111001 | H1233 | SSR | | |
| 34 | 10000111 | | TRO | H0907 | |
| 35 | 00001001 | H1235 | TM | 1 | B F/F-J |
| 36 | 10100111 | | TRO | H1239 | |
| 37 | 01110101 | | SSR | | |
| 38 | 10010110 | | TRO | H0522 | |
| 39 | 11010111 | H1239 | TR1 | CSSR-J | |
| 40 | 10101100 | | TRO | H1244 | |
| 41 | 01000000 | | LB | (0) | B F/F-S |
| 42 | 00001101 | | SM | 1 | |
| 43 | 10100001 | | TRO | H1233 | |
| 44 | 00101000 | H1244 | LAX | 8 | THVR-OFF |
| 45 | 01010110 | | ATRF | | |
| 46 | 01000100 | | LB | (4) | MSS-OFF |
| 47 | 00000100 | | RSM | 0 | |
| 48 | 11100111 | | TR1 | DFC-OFF | |
| 49 | 11000000 | H1249 | TR1 | $MS_4$-1 | |
| 50 | 11011000 | | TR1 | Ja-1 | |
| 51 | 10110110 | | TRO | H1254 | JAM |
| 52 | 11001110 | | TR1 | $MS_2$-J | |
| 53 | 10111000 | | TRO | H1256 | |
| 54 | 01110101 | H1254 | SSR | | JAM |
| 55 | 10111000 | | TRO | H0556 | |
| 56 | 11011010 | H1256 | TR1 | PB-J | |
| 57 | 10111100 | | TRO | H1260 | |
| 58 | 01111011 | | SSR | | |
| 59 | 10000000 | | TRO | H1100 | |
| 60 | 01111101 | H1260 | SSR | | |
| 61 | 10111001 | | TRO | H1357 | |
| 62 | 00000000 | | OO | | |

FIG.17

Page 11

| ADDRESS | CODE | LABEL | MNEMONICS | OPERAND | COMMENT |
|---|---|---|---|---|---|
| 00 | 11000111 | H1100 | TR1 | WTL-J | |
| 01 | 10000111 | | TRO | H1107 | |
| 02 | 01001100 | | LB | (12) | RL-OFF |
| 03 | 00000101 | | RSM | 1 | |
| 04 | 11101001 | | TR1 | HLR-ON | |
| 05 | 01111100 | H1105 | SSR | | |
| 06 | 10110001 | | TRO | H1249 | |
| 07 | 11100101 | H1107 | TR1 | HLR-OFF | |
| 08 | 11010000 | | TR1 | $MS_4$-J | |
| 09 | 10110101 | | TRO | H1153 | |
| 10 | 00100000 | | LAX | 0 | TRS-OFF |
| 11 | 01010111 | | ATF | | |
| 12 | 01010001 | | LB | (17) | PH-J |
| 13 | 01011100 | | DECB | | |
| 14 | 11001001 | | TR1 | $J_2$ | |
| 15 | 10111100 | | TRO | H1160 | |
| 16 | 11001010 | | TR1 | Test-J | |
| 17 | 10010101 | | TRO | H1121 | |
| 18 | 01000111 | | LB | (7) | 2min.-R |
| 19 | 00101001 | | LAX | 9 | |
| 20 | 00010000 | | EXC | 0 | |
| 21 | 01000111 | H1121 | LB | (7) | 2min.-J |
| 22 | 00101001 | | LAX | 9 | |
| 23 | 00000010 | | TAM | | |
| 24 | 10111001 | | TRO | H1157 | |
| 25 | 11000101 | | TR1 | Tim-OFF | |
| 26 | 01001100 | | LB | (12) | HLR , PH-ON |
| 27 | 00100101 | | LAX | 5 | |
| 28 | 00010000 | | EXC | 0 | |
| 29 | 11100100 | | TR1 | M→W | |
| 30 | 11000000 | H1130 | TR1 | $MS_4$-1 | |
| 31 | 01000001 | | LB | (1) | |

| ADDRESS | CODE | LABEL | MNEMONICS | OPERAND | COMMENT |
|---|---|---|---|---|---|
| 32 | 11011010 | | TR1 | PB-J | |
| 33 | 00001110 | | SM | 2 | G F/F-S |
| 34 | 11011000 | | TR1 | Ja-1 | |
| 35 | 10100110 | | TRO | H1138 | JAM |
| 36 | 11001110 | | TR1 | $MS_2$-J | |
| 37 | 10101000 | | TRO | H1140 | |
| 38 | 01110101 | H1138 | SSR | | JAM |
| 39 | 10111000 | | TRO | H0556 | |
| 40 | 11001000 | H1140 | TR1 | PSW-J | |
| 41 | 10011110 | | TRO | H1130 | |
| 42 | 01001100 | | LB | (12) | PH-OFF |
| 43 | 00000110 | | RSM | 2 | |
| 44 | 11100100 | | TR1 | M→W | |
| 45 | 01000001 | | LB | (1) | G F/F-J |
| 46 | 00001010 | | TM | 2 | |
| 47 | 10110011 | | TRO | H1151 | |
| 48 | 00000110 | | RSM | 2 | G F/F-R |
| 49 | 01111101 | | SSR | | |
| 50 | 10110100 | | TRO | H1352 | |
| 51 | 00001101 | H1151 | SM | 1 | F F/F-S |
| 52 | 10000101 | | TRO | H1105 | |
| 53 | 11011100 | H1153 | TR1 | TRS-ON | |
| 54 | 01001100 | | LB | (12) | RL-OFF |
| 55 | 11101011 | | TR1 | TM-1 | |
| 56 | 10000101 | | TRO | H1105 | |
| 57 | 11101101 | H1157 | TR1 | LB-S6 | |
| 58 | 11000011 | | TR1 | T+1 | |
| 59 | 10111101 | | TRO | H1161 | |
| 60 | 11000101 | H1160 | TR1 | Tim-OFF | |
| 61 | 01111010 | H1161 | SSR | | |
| 62 | 10000000 | | TRO | H1000 | |

Page 10

FIG.18

| ADDRESS | CODE | LABEL | MNEMONICS | OPERAND | COMMENT |
|---|---|---|---|---|---|
| 00 | 01000001 | H1000 | LB | (1) | F F/F-J |
| 01 | 00001001 | | TM | 1 | |
| 02 | 10001000 | | TRO | H1008 | |
| 03 | 11001000 | H1003 | TR1 | PSW-J | |
| 04 | 01000001 | | LB | (1) | F F/F-R |
| 05 | 00000101 | | RSM | 1 | |
| 06 | 01111100 | | SSR | | |
| 07 | 10110001 | | TRO | H1249 | |
| 08 | 11010100 | H1008 | TR1 | $MS_7$-J | |
| 09 | 10010110 | | TRO | H1022 | |
| 10 | 11000101 | | TR1 | Tim-OFF | |
| 11 | 01010000 | | LB | (16) | CSSR-S-ON |
| 12 | 00001101 | | SM | 1 | |
| 13 | 11100100 | | TR1 | M→W | |
| 14 | 11010111 | H1014 | TR1 | CSSR-J | |
| 15 | 10001110 | | TRO | H1014 | |
| 16 | 01010000 | | LB | (16) | CSS-ON<br>CSSR-S-OFF |
| 17 | 00101000 | | LAX | 8 | |
| 18 | 00010100 | | EXCI | 0 | |
| 19 | 00000110 | | RSM | 2 | PR-OFF |
| 20 | 01111001 | | SSR | | |
| 21 | 10000011 | | TRO | H0903 | |
| 22 | 01001100 | H1022 | LB | (12) | RL-J |
| 23 | 00001001 | | TM | 1 | |
| 24 | 10011010 | | TRO | H1026 | |
| 25 | 10011100 | | TRO | H1028 | |
| 26 | 00001101 | H1026 | SM | 1 | RL-ON |
| 27 | 11100100 | | TR1 | M→W | |
| 28 | 11001000 | H1028 | TR1 | PSW-J | |
| 29 | 10000011 | | TRO | H1003 | |
| 30 | 00100010 | | LAX | 2 | THVR-ON |
| 31 | 01010111 | | ATF | | |
| 32 | 11000101 | | TR1 | Tim-OFF | |
| 33 | 01111001 | | SSR | | |
| 34 | 10000000 | | TRO | H0900 | |
| 35 | 00001111 | H1035 | SM | 3 | JR-ON |
| 36 | 11100100 | | TR1 | M→W | |
| 37 | 11011001 | H1037 | TR1 | JRa-J | |
| 38 | 10100101 | | TRO | H1037 | |
| 39 | 01010100 | | NPR | | JR-OFF |
| 40 | 01010011 | H1040 | LB | (19) | O→T |
| 41 | 11000110 | | TR1 | R-O | |
| 42 | 11011001 | H1042 | TR1 | JRa-J | |
| 43 | 10111101 | | TRO | H1061 | |
| 44 | 11111001 | | TR1 | L+1 | |
| 45 | 11001010 | | TR1 | Test-J | |
| 46 | 10110001 | | TRO | H1049 | |
| 47 | 01001011 | | LB | (11) | 500ms-T |
| 48 | 00001101 | | SM | 1 | |
| 49 | 01001011 | H1049 | LB | (11) | 500ms-J |
| 50 | 00001001 | | TM | 1 | |
| 51 | 10101010 | | TRO | H1042 | |
| 52 | 01001110 | | LB | (14) | K F/F-J |
| 53 | 00001011 | | TM | 3 | |
| 54 | 10111010 | | TRO | H1058 | |
| 55 | 01100001 | | IDFS | | JL-OFF |
| 56 | 00000111 | | RSM | 3 | K F/F-R |
| 57 | 10101000 | | TRO | H1040 | |
| 58 | 01100000 | H1058 | IDFR | | JL-ON |
| 59 | 00001111 | | SM | 3 | K F/F-S |
| 60 | 10101000 | | TRO | H1040 | |
| 61 | 01110101 | H1061 | SSR | | JAM |
| 62 | 10111000 | | TRO | H0556 | |

FIG.19

Page 9

| ADDRESS | CODE | LABEL | MNEMONICS | OPERAND | COMMENT |
|---|---|---|---|---|---|
| 00 | 11001100 | H0900 | TR1 | $MS_1$-J | |
| 01 | 01000100 | | LB | (4) | PFS-ON |
| 02 | 00001111 | | SM | 3 | |
| 03 | 11100000 | H0903 | TR1 | RL-OFF | DFC-ON |
| 04 | 11000000 | | TR1 | $MS_4$-1 | |
| 05 | 01100101 | | TA | | |
| 06 | 00000000 | | OO | | |
| 07 | 11000000 | H0907 | TR1 | $MS_4$-1 | |
| 08 | 11011000 | | TR1 | Ja-1 | |
| 09 | 10100010 | | TRO | H0934 | JAM |
| 10 | 11010111 | | TR1 | CSSR-J | |
| 11 | 10100000 | | TRO | H0932 | |
| 12 | 01000000 | | LB | (0) | B F/F-J |
| 13 | 00001001 | | TM | 1 | |
| 14 | 10010001 | | TRO | H0917 | |
| 15 | 11010100 | | TR1 | $MS_7$-J | |
| 16 | 10011110 | | TRO | H0930 | |
| 17 | 11011011 | H0917 | TR1 | PA-J | |
| 18 | 10000111 | | TRO | H0907 | |
| 19 | 01000100 | | LB | (4) | PFS-OFF |
| 20 | 11011110 | | TR1 | TM-3 | |
| 21 | 11000010 | | TR1 | M+1 | |
| 22 | 00100110 | | LAX | 6 | M=6-J |
| 23 | 00000010 | | TAM | | |
| 24 | 10100100 | | TRO | H0936 | |
| 25 | 01000000 | | LB | (0) | B F/F-J |
| 26 | 00001001 | | TM | 1 | |
| 27 | 10000111 | | TRO | H0907 | |
| 28 | 01110101 | | SSR | | |
| 29 | 10000000 | | TRO | H0500 | |
| 30 | 01110101 | H0930 | SSR | | |
| 31 | 10010000 | | TRO | H0516 | |
| 32 | 11001110 | H0932 | TR1 | $MS_2$-J | |
| 33 | 10010001 | | TRO | H0917 | |
| 34 | 01110101 | H0934 | SSR | | JAM |
| 35 | 10111000 | | TRO | H0556 | |
| 36 | 00100111 | H0936 | LAX | 7 | M=7-J |
| 37 | 00000010 | | TAM | | |
| 38 | 10110000 | | TRO | H0948 | |
| 39 | 11010111 | H0939 | TR1 | CSSR-J | |
| 40 | 10000111 | | TRO | H0907 | |
| 41 | 11001110 | | TR1 | $MS_2$-J | |
| 42 | 10101101 | | TRO | H0945 | |
| 43 | 11010110 | | TR1 | $MS_3$-J | |
| 44 | 10100010 | | TRO | H0934 | JAM |
| 45 | 11000101 | H0945 | TR1 | Tim-OFF | O→M |
| 46 | 01111100 | | SSR | | |
| 47 | 10000001 | | TRO | H1201 | |
| 48 | 00001011 | H0948 | TM | 3 | M=8-J |
| 49 | 10000111 | | TRO | H0907 | |
| 50 | 11000101 | H0950 | TR1 | Tim-OFF | O→M |
| 51 | 11000000 | H0951 | TR1 | $MS_4$-1 | |
| 52 | 11011000 | | TR1 | Ja-1 | |
| 53 | 10100010 | | TRO | H0934 | JAM |
| 54 | 11011011 | | TR1 | PA-J | |
| 55 | 10110011 | | TRO | H0951 | |
| 56 | 11000111 | | TR1 | WTL-J | |
| 57 | 10111100 | | TRO | H0960 | |
| 58 | 01111101 | | SSR | | |
| 59 | 10110100 | | TRO | H1352 | |
| 60 | 01111000 | H0960 | SSR | | |
| 61 | 10000010 | | TRO | H0802 | |
| 62 | 00000000 | | OO | | |

FIG.20

Page 8

| ADDRESS | CODE | LABEL | MNEMONICS | OPERAND | COMMENT |
|---|---|---|---|---|---|
| 00 | 11011100 | H0800 | TR1 | TRS-ON | |
| 01 | 11100111 | | TR1 | DFC-OFF | |
| 02 | 11011000 | H0802 | TR1 | Ja-1 | |
| 03 | 10111101 | | TRO | H0861 | JAM |
| 04 | 11010000 | | TR1 | $MS_4$-J | |
| 05 | 10000000 | | TRO | H0800 | |
| 06 | 11001100 | | TR1 | $MS_1$-J | |
| 07 | 10111011 | | TRO | H0859 | |
| 08 | 00100111 | H0808 | LAX | 7 | CLR, CHVR-ON |
| 09 | 01010111 | | ATF | | TRS-OFF |
| 10 | 11100010 | | TR1 | DFC-ON | |
| 11 | 01010001 | | LB | (17) | |
| 12 | 11101110 | | TR1 | DEC-3 | |
| 13 | 00000000 | | OO | | |
| 14 | 00000000 | | OO | | |
| 15 | 00000000 | | OO | | |
| 16 | 00000000 | | OO | | |
| 17 | 00000000 | | OO | | |
| 18 | 00000000 | | OO | | |
| 19 | 00000000 | | OO | | |
| 20 | 01100101 | | TA | | |
| 21 | 00000000 | | OO | | |
| 22 | 11011010 | H0822 | TR1 | PB-J | |
| 23 | 10101010 | | TRO | H0842 | |
| 24 | 01000100 | | LB | (4) | PSS-ON |
| 25 | 00001101 | | SM | 1 | |
| 26 | 11100100 | | TR1 | M→W | |
| 27 | 11011011 | H0827 | TR1 | PA-J | |
| 28 | 10100100 | | TRO | H0836 | |
| 29 | 01001111 | | LB | (15) | |
| 30 | 00001011 | | TM | 3 | |
| 31 | 11111000 | | TR1 | DMR-ON | |
| 32 | 01001000 | | LB | (8) | TFC-ON |
| 33 | 00001101 | | SM | 1 | |
| 34 | 11100100 | | TR1 | M→W | |
| 35 | 10111001 | | TRO | H0857 | |
| 36 | 11011000 | H0836 | TR1 | Ja-1 | |
| 37 | 10111101 | | TRO | H0861 | JAM |
| 38 | 10011011 | | TRO | H0827 | |
| 39 | 11011000 | H0839 | TR1 | Ja-1 | |
| 40 | 10111101 | | TRO | H0861 | JAM |
| 41 | 10110100 | | TRO | H0852 | |
| 42 | 11011000 | H0842 | TR1 | Ja-1 | |
| 43 | 10111101 | | TRO | H0861 | JAM |
| 44 | 11011011 | | TR1 | PA-J | |
| 45 | 10010110 | | TRO | H0822 | |
| 46 | 01001111 | | LB | (15) | |
| 47 | 00001011 | | TM | 3 | |
| 48 | 11111000 | | TR1 | DMR-ON | |
| 49 | 01001000 | | LB | (8) | TFC-ON |
| 50 | 00001101 | | SM | 1 | |
| 51 | 11100100 | | TR1 | M→W | |
| 52 | 11011010 | H0852 | TR1 | PB-J | |
| 53 | 10100111 | | TRO | H0839 | |
| 54 | 01000100 | | LB | (4) | PSS-ON |
| 55 | 00001101 | | SM | 1 | |
| 56 | 11100100 | | TR1 | M→W | |
| 57 | 01110111 | H0857 | SSR | | |
| 58 | 10111101 | | TRO | H0761 | |
| 59 | 01111100 | H0859 | SSR | | |
| 60 | 10000000 | | TRO | H1200 | |
| 61 | 01110101 | H0861 | SSR | | JAM |
| 62 | 10111000 | | TRO | H0556 | |

FIG. 21

Page 7

| ADDRESS | CODE | LABEL | MNEMONICS | OPERAND | COMMENT |
|---|---|---|---|---|---|
| 00 | 00001011 | H0700 | TM | 3 | |
| 01 | 11000010 | | TR1 | M+1 | |
| 02 | 01000001 | H0702 | LB | (1) | E F/F-J |
| 03 | 00001000 | | TM | 0 | |
| 04 | 10000111 | | TRO | H0707 | |
| 05 | 11001110 | | TR1 | $MS_2$-J | |
| 06 | 10100000 | | TRO | H0732 | JAM |
| 07 | 01001111 | H0707 | LB | (15) | H F/F-J |
| 08 | 00001001 | | TM | 1 | |
| 09 | 10010111 | | TRO | H0723 | |
| 10 | 11111001 | | TR1 | L+1 | |
| 11 | 11010000 | | TR1 | $MS_4$-J | |
| 12 | 11001010 | | TR1 | Test-J | |
| 13 | 10010000 | | TRO | H0716 | |
| 14 | 01000111 | | LB | (7) | |
| 15 | 00001111 | | SM | 3 | |
| 16 | 01000111 | H0716 | LB | (7) | |
| 17 | 00001011 | | TM | 3 | |
| 18 | 10011010 | | TRO | H0726 | |
| 19 | 01010011 | | LB | (19) | |
| 20 | 11000110 | | TR1 | R-O | |
| 21 | 01001111 | | LB | (15) | O F/F-S |
| 22 | 00001110 | | SM | 2 | |
| 23 | 00001010 | H0723 | TM | 2 | O F/F-J |
| 24 | 10011010 | | TRO | H0726 | |
| 25 | 11000000 | | TR1 | $MS_4$-1 | |
| 26 | 01001101 | H0726 | LB | (13) | MS5-J |
| 27 | 11001001 | | TR1 | $J_2$ | |
| 28 | 10101000 | | TRO | H0740 | |
| 29 | 01000100 | | LB | (4) | PSS-J |
| 30 | 00001001 | | TM | 1 | |
| 31 | 10100010 | | TRO | H0734 | |
| 32 | 01110101 | H0732 | SSR | | JAM |
| 33 | 10111000 | | TRO | H0556 | |
| 34 | 00101110 | H0734 | LAX | 14 | CHVR-OFF |
| 35 | 01010110 | | ATRF | | |
| 36 | 11111100 | | TR1 | TFC-OFF | |
| 37 | 01001111 | | LB | (15) | |
| 38 | 00001010 | H0738 | TM | 2 | O F/F-J |
| 39 | 00001101 | | SM | 1 | H F/F-J |
| 40 | 11001100 | H0740 | TR1 | $MS_1$-J | |
| 41 | 11101010 | | TR1 | PSS-OFF | |
| 42 | 11011000 | | TR1 | Ja-1 | |
| 43 | 10100000 | | TRO | H0732 | JAM |
| 44 | 11011011 | | TR1 | PA-J | |
| 45 | 10000010 | | TRO | H0702 | |
| 46 | 11000010 | | TR1 | M+1 | |
| 47 | 00100001 | | LAX | 1 | M=1-J |
| 48 | 00000010 | | TAM | | |
| 49 | 10110101 | | TRO | H0753 | |
| 50 | 11111000 | | TR1 | DMR-ON | |
| 51 | 11100100 | | TR1 | M→W | |
| 52 | 10000010 | | TRO | H0702 | |
| 53 | 00001010 | H0753 | TM | 2 | M=4,5,6,7-J |
| 54 | 10111000 | | TRO | H0756 | |
| 55 | 10111010 | | TRO | H0758 | |
| 56 | 00001011 | H0756 | TM | 3 | M=8-J |
| 57 | 10000010 | | TRO | H0702 | |
| 58 | 01000010 | H0758 | LB | (2) | P F/F-J |
| 59 | 01110100 | | SSR | | |
| 60 | 10000000 | | TRO | H0400 | |
| 61 | 01001111 | H0761 | LB | (15) | |
| 62 | 10000000 | | TRO | H0700 | |

FIG. 22 page 6

| ADDRESS | CODE | LABEL | MNEMONICS | OPERAND | COMMENT |
|---|---|---|---|---|---|
| 00 | 01000010 | H0600 | LB | (2) | C F/F-J |
| 01 | 00001010 | | TM | 2 | |
| 02 | 10000101 | | TRO | H0605 | |
| 03 | 00001100 | | SM | 0 | P F/F-S |
| 04 | 00000000 | | OO | | |
| 05 | 01000100 | H0605 | LB | (4) | PSS-J |
| 06 | 00001001 | | TM | 1 | |
| 07 | 01000010 | | LB | (2) | C F/F-S |
| 08 | 00001110 | | SM | 2 | |
| 09 | 01000011 | H0609 | LB | (3) | |
| 10 | 00100110 | | LAX | 6 | M=6-J |
| 11 | 00000010 | | TAM | | |
| 12 | 10010000 | | TRO | H0616 | |
| 13 | 01000001 | | LB | (1) | E F/F-S |
| 14 | 00001100 | | SM | 0 | |
| 15 | 10111011 | | TRO | H0659 | |
| 16 | 00101001 | H0616 | LAX | 9 | M=9-J |
| 17 | 00000010 | | TAM | | |
| 18 | 10101110 | | TRO | H0646 | |
| 19 | 01001000 | | LB | (8) | TFC,DMR-OFF |
| 20 | 00100001 | | LAX | 1 | |
| 21 | 00011100 | | EXCD | 0 | |
| 22 | 00000111 | | RSM | 3 | PFS-OFF |
| 23 | 11100100 | | TR1 | M→W | |
| 24 | 11000000 | H0624 | TR1 | $MS_4$-1 | |
| 25 | 11011000 | | TR1 | Ja-1 | |
| 26 | 10111101 | | TRO | H0661 | JAM |
| 27 | 11011011 | | TR1 | PA-J | |
| 28 | 10011000 | | TRO | H0624 | |
| 29 | 11010110 | | TR1 | $MS_3$-J | |
| 30 | 10111101 | | TRO | H0661 | JAM |
| 31 | 01001000 | | LB | (8) | TC-ON |
| 32 | 00001110 | | SM | 2 | |
| 33 | 11100100 | | TR1 | M→W | |
| 34 | 11000000 | H0634 | TR1 | $MS_4$-1 | |
| 35 | 11011000 | | TR1 | Ja-1 | |
| 36 | 10111101 | | TRO | H0661 | JAM |
| 37 | 11011011 | | TR1 | PA-J | |
| 38 | 10100010 | | TRO | H0634 | |
| 39 | 00101010 | | LAX | 10 | CLR-OFF |
| 40 | 01010110 | | ATRF | | |
| 41 | 01000100 | | LB | (4) | PSS-OFF |
| 42 | 00000101 | | RSM | 1 | |
| 43 | 01001000 | | LB | (8) | TC-OFF |
| 44 | 01110100 | | SSR | | |
| 45 | 10001110 | | TRO | H0414 | |
| 46 | 00001011 | H0646 | TM | 3 | M=8-J |
| 47 | 10111011 | | TRO | H0659 | |
| 48 | 01000001 | | LB | (1) | E F/F-R |
| 49 | 00000100 | | RSM | 0 | |
| 50 | 11010010 | | TR1 | $MS_6$-J | |
| 51 | 10110101 | | TRO | H0653 | |
| 52 | 10110111 | | TRO | H0655 | |
| 53 | 11010010 | H0653 | TR1 | $MS_6$-J | |
| 54 | 10111011 | | TRO | H0659 | |
| 55 | 11001100 | H0655 | TR1 | $MS_1$-J | |
| 56 | 01000100 | | LB | (4) | PFS-ON |
| 57 | 00001111 | | SM | 3 | |
| 58 | 11100100 | | TR1 | M→W | |
| 59 | 01110111 | H0659 | SSR | | |
| 60 | 10000010 | | TRO | H0702 | |
| 61 | 01110101 | H0661 | SSR | | JAM |
| 62 | 10111000 | | TRO | M0556 | |

FIG. 23

Page 5

| ADDRESS | CODE | LABEL | MNEMONICS | OPERAND | COMMENT |
|---|---|---|---|---|---|
| 00 | 11000000 | H0500 | TR1 | $MS_4$-1 | |
| 01 | 11010100 | | TR1 | $MS_7$-J | |
| 02 | 10010000 | | TRO | H0516 | |
| 03 | 01000100 | | LB | (4) | MSS-ON |
| 04 | 00001100 | | SM | (0) | |
| 05 | 11100111 | | TR1 | DFC-OFF | |
| 06 | 01010011 | | LB | (19) | |
| 07 | 11000011 | | TR1 | T+1 | |
| 08 | 11001010 | | TR1 | Test-J | |
| 09 | 10001100 | | TRO | H0512 | |
| 10 | 01001011 | | LB | (11) | 1.5S-T |
| 11 | 00001110 | | SM | 2 | |
| 12 | 01001011 | H0512 | LB | (11) | 1.5ST-J |
| 13 | 00001010 | | TM | 2 | |
| 14 | 10000000 | | TRO | H0500 | |
| 15 | 11010100 | | TR1 | $MS_7$-J | |
| 16 | 01000100 | H0516 | LB | (4) | MSS-OFF |
| 17 | 00000100 | | RSM | 0 | |
| 18 | 11100010 | | TR1 | DFC-ON | |
| 19 | 11000101 | | TR1 | Tim-OFF | |
| 20 | 11001010 | | TR1 | Test-J | |
| 21 | 10110100 | | TRO | H0552 | |
| 22 | 11000000 | H0522 | TR1 | $MS_4$-1 | |
| 23 | 11010100 | | TR1 | $MS_7$-J | |
| 24 | 11011111 | | TR1 | MSS-OFF | |
| 25 | 11011000 | | TR1 | Ja-1 | |
| 26 | 10111000 | | TRO | H0556 | JAM |
| 27 | 11011011 | | TR1 | PA-J | |
| 28 | 10010110 | | TRO | H0522 | |
| 29 | 01010000 | | LB | (16) | CSSR-R-ON |
| 30 | 00100100 | | LAX | 4 | CSS-OFF |
| 31 | 00010100 | | EXCI | 0 | |

| ADDRESS | CODE | LABEL | MNEMONICS | OPERAND | COMMENT |
|---|---|---|---|---|---|
| 32 | 00001110 | | SM | 2 | PR-ON |
| 33 | 11100100 | | TR1 | M→W | |
| 34 | 11000111 | H0543 | TR1 | WTL-J | |
| 35 | 10100110 | | TRO | H0538 | |
| 36 | 11101001 | | TR1 | HLR-ON | |
| 37 | 10100111 | | TRO | H0539 | |
| 38 | 11100101 | H0538 | TR1 | HLR-OFF | |
| 39 | 11000000 | H0539 | TR1 | $MS_4$-1 | |
| 40 | 11010100 | | TR1 | $MS_7$-J | |
| 41 | 11011111 | | TR1 | MSS-OFF | |
| 42 | 11011000 | | TR1 | Ja-1 | |
| 43 | 10111000 | | TRO | H0556 | JAM |
| 44 | 11011011 | | TR1 | PA-J | |
| 45 | 10100010 | | TRO | H0534 | |
| 46 | 01010000 | | LB | (16) | CSSR-R-OFF |
| 47 | 00000110 | | RSM | 2 | |
| 48 | 11100100 | | TR1 | M→W | |
| 49 | 00000101 | | RSM | 1 | B F/F-R |
| 50 | 01111100 | H0550 | SSR | | |
| 51 | 10000001 | | TRO | H1201 | |
| 52 | 11001010 | | TR1 | Test-J | |
| 53 | 10110010 | | TRO | H0550 | |
| 54 | 01111100 | | SSR | | |
| 55 | 10101100 | | TRO | H1244 | |
| 56 | 01000000 | H0556 | LB | (0) | LOAD-OFF |
| 57 | 11000110 | | TR1 | R-O | |
| 58 | 00100000 | | LAX | 0 | O→F |
| 59 | 01010111 | | ATF | | |
| 60 | 01001100 | | LB | (12) | JR-ON |
| 61 | 01111010 | | SSR | | |
| 62 | 10100011 | | TRO | H1035 | |

Page 4

FIG.24

| ADDRESS | CODE | LABEL | MNEMONICS | OPERAND | COMMENT |
|---|---|---|---|---|---|
| 00 | 00001000 | H0400 | TM | 0 | |
| 01 | 10000100 | | TRO | H0404 | |
| 02 | 01001000 | | LB | (8) | |
| 03 | 11011110 | | TR1 | TM-3 | |
| 04 | 01110110 | H0404 | SSR | | |
| 05 | 10000000 | | TRO | H0600 | |
| 06 | 01111001 | H0406 | SSR | | |
| 07 | 10110010 | | TRO | H0950 | |
| 08 | 00000000 | | OO | | |
| 09 | 00000000 | | OO | | |
| 10 | 01001000 | H0410 | LB | (8) | DFC-ON |
| 11 | 00001100 | | SM | 0 | |
| 12 | 01110101 | | SSR | | |
| 13 | 10000000 | | TRO | H0500 | |
| 14 | 00000110 | H0414 | RSM | 2 | TC-OFF |
| 15 | 01000010 | | LB | (2) | D·C F/F-R |
| 16 | 00100000 | | LAX | 0 | |
| 17 | 00010000 | | EXC | 0 | |
| 18 | 11100100 | | TR1 | M→W | |
| 19 | 10000110 | | TRO | H0406 | |
| 20 | 01000000 | H0420 | LB | (0) | |
| 21 | 00100000 | H0421 | LAX | 0 | |
| 22 | 00010000 | | EXC | 0 | |
| 23 | 00010000 | | EXC | 0 | |
| 24 | 01010111 | | ATF | | |
| 25 | 00101111 | | LAX | 15 | |
| 26 | 00010000 | | EXC | 0 | |
| 27 | 00010011 | | EXC | 3 | |
| 28 | 01010111 | | ATF | | |
| 29 | 00100000 | | LAX | 0 | |
| 30 | 00010000 | | EXC | 0 | |
| 31 | 00010000 | | EXC | 0 | |

| ADDRESS | CODE | LABEL | MNEMONICS | OPERAND | COMMENT |
|---|---|---|---|---|---|
| 32 | 01010111 | | ATF | | |
| 33 | 00101111 | | LAX | 15 | |
| 34 | 00010000 | | EXC | 0 | |
| 35 | 00010011 | | EXC | 3 | |
| 36 | 01010111 | | ATF | | |
| 37 | 01011000 | | INCB | | |
| 38 | 10010101 | | TRO | H0421 | |
| 39 | 11001010 | | TR1 | Test-J | |
| 40 | 10101011 | | TRO | H0443 | |
| 41 | 01110111 | | SSR | | |
| 42 | 10000010 | | TRO | H0702 | |
| 43 | 01000001 | H0443 | LB | (1) | |
| 44 | 10010101 | | TRO | H0421 | |
| 45 | 00000000 | | OO | | |
| 46 | 01010001 | H0446 | LB | (17) | MS8-J |
| 47 | 11101111 | | TR1 | DEC2 | |
| 48 | 11001001 | H0448 | TR1 | $J_2$ | |
| 49 | 10110000 | | TRO | H0448 | |
| 50 | 11111011 | H0450 | TR1 | A-J | |
| 51 | 00000000 | | OO | | |
| 52 | 11111001 | | TR1 | L+1 | |
| 53 | 11001010 | | TR1 | Test-J | |
| 54 | 10111001 | | TRO | H0457 | |
| 55 | 01001011 | | LB | (11) | 800mS-T |
| 56 | 00001101 | | SM | 1 | |
| 57 | 01001011 | H0457 | LB | (11) | 800mST-J |
| 58 | 00001001 | | TM | 1 | |
| 59 | 10110010 | | TRO | H0450 | |
| 60 | 11000101 | | TR1 | Tim-OFF | |
| 61 | 01111101 | | SSR | | |
| 62 | 10101101 | | TRO | M1345 | |

FIG. 25

Page 3

| ADDRESS | CODE | LABEL | MNEMONICS | OPERAND | COMMENT |
|---|---|---|---|---|---|
| 00 | 00100000 | H0300 | LAX | 0 | |
| 01 | 00010011 | | EXC | 3 | |
| 02 | 00100000 | | LAX | 0 | |
| 03 | 00010011 | | EXC | 3 | |
| 04 | 00100011 | H0304 | LAX | 3 | |
| 05 | 01101011 | | TTAB | | |
| 06 | 10001011 | | TRO | H0311 | |
| 07 | 01011011 | | ADD11 | | |
| 08 | 10100000 | | TRO | H0332 | |
| 09 | 00010000 | | EXC | 0 | |
| 10 | 10000100 | | TRO | H0304 | |
| 11 | 00011011 | H0311 | LDA | 3 | |
| 12 | 00100011 | H0312 | LAX | 3 | |
| 13 | 01100111 | | TKN2 | | |
| 14 | 10011100 | | TRO | H0328 | |
| 15 | 01011100 | | DECB | | |
| 16 | 00100001 | | LAX | 1 | |
| 17 | 01011011 | | ADD11 | | |
| 18 | 10010101 | | TRO | H0321 | |
| 19 | 00010111 | | EXCI | 3 | |
| 20 | 10000100 | | TRO | H0304 | |
| 21 | 01101110 | H0321 | RSC | | |
| 22 | 00010100 | | EXCI | 0 | |
| 23 | 00100001 | | LAX | 1 | |
| 24 | 01011011 | | ADD11 | | |
| 25 | 10101001 | | TRO | H0341 | |
| 26 | 00010011 | | EXC | 3 | |
| 27 | 10000100 | | TRO | H0304 | |
| 28 | 01011011 | H0328 | ADD11 | | |
| 29 | 10101001 | | TRO | H0341 | |
| 30 | 00010000 | | EXC | 0 | |
| 31 | 10001100 | | TRO | H0312 | |
| 32 | 01101110 | H0332 | RSC | | |
| 33 | 00101000 | H0333 | LAX | 8 | TRS-ON |
| 34 | 01010101 | | ATSF | | |
| 35 | 01001000 | | LB | (8) | TFC-OFF |
| 36 | 00001001 | H0336 | TM | 1 | TM-1 |
| 37 | 01011110 | | RTN | | |
| 38 | 00000101 | | RSM | 1 | |
| 39 | 01110000 | | SSR | | M→W |
| 40 | 10101010 | | TRO | H0242 | |
| 41 | 01101110 | H0341 | RSC | | TRS-OFF |
| 42 | 00100011 | | LAX | 3 | CLR-OFF |
| 43 | 01010110 | | ATRF | | |
| 44 | 01011110 | | RTN | | |
| 45 | 00100000 | H0345 | LAX | 0 | $J_2$ |
| 46 | 00110011 | H0346 | ADX | 3 | |
| 47 | 01011111 | | RTN1 | | |
| 48 | 01101010 | | TAK | | |
| 49 | 01011110 | | RTN | | |
| 50 | 10101110 | | TRO | H0346 | |
| 51 | 00100001 | H0351 | LAX | 1 | T+1 |
| 52 | 00100000 | H0352 | LAX | 0 | |
| 53 | 01011011 | | ADD11 | | |
| 54 | 10111001 | | TRO | H0357 | |
| 55 | 00010000 | | EXC | 0 | |
| 56 | 01011110 | | RTN | | |
| 57 | 00010100 | H0357 | EXCI | 0 | |
| 58 | 10110100 | | TRO | H0352 | |
| 59 | 01101110 | | RSC | | |
| 60 | 01011110 | | RTN | | |
| 61 | 01001101 | H0361 | LB | (13) | MS4-1 |
| 62 | 10000000 | | TRO | H0300 | |

FIG. 26

Page 2

| ADDRESS | CODE | LABEL | MNEMONICS | OPERAND | COMMENT |
|---|---|---|---|---|---|
| 00 | 00100000 | H0200 | LAX | 0 | $J_1$ |
| 01 | 00010011 | | EXC | 3 | |
| 02 | 00100000 | | LAX | 0 | |
| 03 | 00010011 | | EXC | 3 | |
| 04 | 00100011 | H0204 | LAX | 3 | |
| 05 | 01101011 | | TTAB | | |
| 06 | 10001011 | | TRO | H0211 | |
| 07 | 01011011 | | ADD11 | | |
| 08 | 10100000 | | TRO | H0232 | |
| 09 | 00010000 | H0209 | EXC | 0 | |
| 10 | 10000100 | | TRO | H0204 | |
| 11 | 00011011 | H0211 | LDA | 3 | |
| 12 | 00100011 | H0212 | LAX | 3 | |
| 13 | 01100111 | | $TKN_2$ | | |
| 14 | 10011100 | | TRO | H0228 | |
| 15 | 00011011 | | LDA | 3 | |
| 16 | 01011100 | | DECB | | |
| 17 | 00100001 | | LAX | 1 | |
| 18 | 01011011 | | ADD11 | | |
| 19 | 10010110 | | TRO | H0222 | |
| 20 | 00010100 | | EXCI | 0 | |
| 21 | 10000100 | | TRO | H0204 | |
| 22 | 01101110 | H0222 | RSC | | |
| 23 | 00010100 | | EXCI | 0 | |
| 24 | 00100001 | | LAX | 1 | |
| 25 | 01011011 | | ADD11 | | |
| 26 | 10100000 | | TRO | H0232 | |
| 27 | 10001001 | | TRO | H0209 | |
| 28 | 01011011 | H0228 | ADD11 | | |
| 29 | 10100010 | | TRO | H0234 | |
| 30 | 00010000 | | EXC | 0 | |
| 31 | 10001100 | | TRO | H0212 | |

| ADDRESS | CODE | LABEL | MNEMONICS | OPERAND | COMMENT |
|---|---|---|---|---|---|
| 32 | 01101110 | H0232 | RSC | | |
| 33 | 01011110 | | RTN | | |
| 34 | 01101110 | H0234 | RSC | | |
| 35 | 01011111 | | RTN1 | | |
| 36 | 00001000 | H0236 | TM | 0 | |
| 37 | 10101000 | | TRO | H0240 | |
| 38 | 01100011 | | W1S | | |
| 39 | 10101100 | | TRO | H0244 | |
| 40 | 01100010 | H0242 | W1R | | |
| 41 | 10101100 | | TRO | H0244 | |
| 42 | 01010100 | H0242 | NPR | | M→W |
| 43 | 01010000 | | LB | (16) | |
| 44 | 01101001 | H0244 | TM | 1 | |
| 45 | 10110000 | | TRO | H0248 | |
| 46 | 01100011 | | W1S | | |
| 47 | 10110001 | | TRO | H0249 | |
| 48 | 01100010 | H0248 | W1R | | |
| 49 | 00001010 | H0249 | TM | 2 | |
| 50 | 10110101 | | TRO | H0253 | |
| 51 | 01100011 | | W1S | | |
| 52 | 10110110 | | TRO | H0254 | |
| 53 | 01100010 | H0253 | W1R | | |
| 54 | 00001011 | H0254 | TM | 3 | |
| 55 | 10111010 | | TRO | H0258 | |
| 56 | 01100011 | | W1S | | |
| 57 | 10111011 | | TRO | H0259 | |
| 58 | 01100010 | H0258 | W1R | | |
| 59 | 01011000 | H0259 | INCB | | |
| 60 | 10100100 | | TRO | H0236 | |
| 61 | 01011101 | | NPS | | |
| 62 | 01011110 | | RTN | | |

FIG. 27

Page 1

| ADDRESS | CODE | LABEL | MNEMONICS | OPERAND | COMMENT |
|---|---|---|---|---|---|
| 00 | 00100000 | H0100 | LAX | 0 | PB-J |
| 01 | 01100100 | H0101 | TB | | |
| 02 | 01011110 | | RTN | | |
| 03 | 00110101 | | ADX | 5 | |
| 04 | 01011111 | | RTN1 | | |
| 05 | 10000001 | | TRO | H0101 | |
| 06 | 00100000 | H0106 | LAX | 0 | WTL-J |
| 07 | 01101000 | H0107 | TKN1 | | |
| 08 | 10001010 | | TRO | H0110 | |
| 09 | 01011111 | | RTN1 | | |
| 0A | 00110011 | H0110 | ADX | 3 | |
| 0B | 01011110 | | RTN | | |
| 0C | 10000111 | | TRO | H0107 | |
| 0D | 01010001 | H0113 | LB | (17) | CSSR-J |
| 0E | 01011100 | | DECB | | |
| 0F | 01011100 | | DECB | | |
| 10 | 01110000 | H0116 | SSR | | |
| 11 | 10000000 | | TRO | H0200 | |
| 12 | 01010001 | H0119 | LB | (17) | JRa-J |
| 13 | 01011100 | | DECB | | |
| 14 | 01011100 | | DECB | | |
| 15 | 01011100 | | DECB | | |
| 16 | 10010000 | | TRO | H0116 | |
| 17 | 01010001 | H0123 | LB | (17) | MS3-J |
| 18 | 01011100 | | DECB | | |
| 19 | 10010000 | | TRO | H0116 | |
| 1A | 01000100 | H0126 | LB | (4) | MSS-OFF |
| 1B | 00001000 | H0127 | TM | 0 | TM-0 |
| 1C | 01011110 | | RTN | | |
| 1D | 00000100 | | RSM | 0 | |
| 1E | 01110000 | H0130 | SSR | | M→M |
| 1F | 10101010 | | TRO | H0242 | |

| ADDRESS | CODE | LABEL | MNEMONICS | OPERAND | COMMENT |
|---|---|---|---|---|---|
| 32 | 01001100 | H0132 | LB | (12) | HLR-ON |
| 33 | 00001000 | | TM | 0 | |
| 34 | 10100100 | | TRO | H0136 | |
| 35 | 01011110 | | RTN | | |
| 36 | 00001100 | H0136 | SM | 0 | |
| 37 | 10011110 | | TRO | H0130 | |
| 38 | 00100000 | H0138 | LAX | 0 | Ja-1 |
| 39 | 00110010 | H0139 | ADX | 2 | |
| 40 | 01011110 | | RTN | | |
| 41 | 01101001 | | TKF | | |
| 42 | 10100111 | | TRO | H0139 | |
| 43 | 01011111 | | RTN1 | | |
| 44 | 00001011 | H0144 | TM | 3 | TX-3 |
| 45 | 01011110 | | RTN | | |
| 46 | 00000111 | | RSM | 3 | |
| 47 | 10011110 | | TRO | H0130 | |
| 48 | 01100101 | H0148 | TA | | PA-J |
| 49 | 01011110 | | RTN | | |
| 50 | 00100000 | H0150 | LAX | 0 | |
| 51 | 00110001 | H0151 | ADX | 1 | |
| 52 | 01011111 | | RTN1 | | |
| 53 | 10110011 | | TRO | H0151 | |
| 54 | 00100000 | H0154 | LAX | 0 | (R-0) |
| 55 | 00010100 | | EXCI | 0 | |
| 56 | 10110110 | | TRO | H0154 | |
| 57 | 01011110 | | RTN | | |
| 58 | 01110000 | H0158 | SSR | | $J_2$ |
| 59 | 11101101 | | TRI | H0345 | |
| 60 | 01001000 | H0160 | LB | (8) | DMR-ON |
| 61 | 00001111 | | SM | 3 | |
| 62 | 01011110 | | RTN | | |

FIG.28

Page 0

| ADDRESS | CODE | LABEL | MNEMONICS | OPERAND | COMMENT |
|---|---|---|---|---|---|
| 00 | 01110000 | $MS_4$-1 | SSR | | |
| 01 | 11111101 | | TR1 | H0361 | |
| 02 | 01000011 | M+1 | LB | (3) | |
| 03 | 01110000 | T+1 | SSR | | |
| 04 | 11110011 | | TR1 | H0351 | |
| 05 | 01000011 | Tim-OFF | LB | (3) | |
| 06 | 11110110 | R-O | TR1 | H0154 | |
| 07 | 11000110 | WTL-J | TR1 | H0106 | |
| 08 | 01000101 | PSW-J | LB | (5) | |
| 09 | 11111010 | $J_2$ | TR1 | H0158 | |
| 10 | 01010001 | Test-J | LB | (17) | |
| 11 | 11111010 | | TR1 | H0158 | |
| 12 | 01001001 | $MS_1$-J | LB | (9) | |
| 13 | 11010000 | | TR1 | H0116 | |
| 14 | 01000101 | $MS_2$-J | LB | (5) | |
| 15 | 11010000 | | TR1 | H0116 | |
| 16 | 01001101 | $MS_4$-J | LB | (13) | |
| 17 | 11010000 | | TR1 | H0116 | |
| 18 | 01001001 | $MS_6$-J | LB | (9) | |
| 19 | 11111010 | | TR1 | H0158 | |
| 20 | 01010001 | $MS_7$-J | LB | (17) | |
| 21 | 11010000 | | TR1 | H0116 | |
| 22 | 11010111 | $MS_3$-J | TR1 | H0123 | |
| 23 | 11001101 | CSSR-J | TR1 | H0113 | |
| 24 | 11100110 | Ja-1 | TR1 | H0138 | |
| 25 | 11010010 | JRa-J | TR1 | H0118 | |
| 26 | 11000000 | PB-J | TR1 | H0100 | |
| 27 | 11110000 | PA-J | TR1 | H0148 | |
| 28 | 01110000 | TRS-ON | SSR | | |
| 29 | 11100001 | | TR1 | H0333 | |
| 30 | 11101100 | TM-3 | TR1 | H0144 | |
| 31 | 11011010 | MSS-OFF | TR1 | H0126 | |

| ADDRESS | CODE | LABEL | MNEMONICS | OPERAND | COMMENT |
|---|---|---|---|---|---|
| 32 | 01001100 | RL-OFF | LB | (12) | |
| 33 | 00000101 | | RSM | 1 | |
| 34 | 01001000 | DFC-ON | LB | (8) | |
| 35 | 00001100 | | SM | 0 | |
| 36 | 11011110 | M→W | TR1 | H0130 | |
| 37 | 01001100 | HLP-OFF | LB | (12) | |
| 38 | 11011011 | | TR1 | H0127 | |
| 39 | 01001000 | DFC-OFF | LB | (8) | |
| 40 | 11011011 | TM-O | TR1 | H0127 | |
| 41 | 11100000 | HLP-ON | TR1 | H0132 | |
| 42 | 01000100 | PSS-OFF | LB | (4) | |
| 43 | 01110000 | TM-1 | SSR | | |
| 44 | 11100100 | | TR1 | H0336 | |
| 45 | 01000111 | LB-S6 | LB | (7) | |
| 46 | 01011100 | DEC-3 | DECB | | |
| 47 | 01011100 | DEC-2 | DECB | | |
| 48 | 01011100 | | DECB | | |
| 49 | 01011110 | | RTN | | |
| 50 | 00100111 | TRS-OFF | LAX | 7 | |
| 51 | 01010110 | | ATRF | | |
| 52 | 01011110 | | RTN | | |
| 53 | 01000100 | PR-ON | LB | (4) | |
| 54 | 00001110 | | SM | 2 | |
| 55 | 01011110 | | RTN | | |
| 56 | 11111100 | DMR-ON | TR1 | H0160 | |
| 57 | 01010011 | L+1 | LB | (19) | |
| 58 | 10000011 | | TRO | T+1 | |
| 59 | 11110010 | A-J | TR1 | H0150 | |
| 60 | 01001000 | TFC-OFF | LB | (8) | |
| 61 | 10101011 | | TRO | TM-1 | |
| 62 | 00000000 | | OO | | |

| BL \ Bu | ZERO BLOCK 0 0 | | | | |
|---|---|---|---|---|---|
| 1 1 0 0 | CSS | CSSR-R | CSSR-S | | (16) |
| 1 1 0 1 | PFS | PR | PSS | MSS | (4) |
| 1 1 1 0 | DMR | TC | TFC | DFC | (8) |
| 1 1 1 1 | JR | PH | RL | HLR | (12) |
| | 3bit | 2bit | 1bit | 0bit | |

FIG.35

| BL \ Bu | ZERO BLOCK 0 0 | FIRST BLOCK 0 1 | SECOND BLOCK 1 0 | THIRD BLOCK 1 1 | |
|---|---|---|---|---|---|
| 0 0 0 0 | D B A ( 0 ) | G F E ( 1 ) | C P ( 2 ) | | |
| 0 0 0 1 | | | | | |
| 0 0 1 0 | | | | | |
| | ⋮ | ⋮ | ⋮ | ⋮ | |
| 1 1 1 1 | JR PH PL HLR ( 12 ) | | K ( 14 ) | O H ( 15 ) | |

FIG.36

SINGLE-CHIP, MOS-LSI MICROPROCESSOR CONTROLLED ELECTROPHOTOGRAPHIC COPYING MACHINE

This application is a continuation of application Ser. No. 794,140 filed on May 21, 1977, which is now abandoned.

BACKGROUND OF THE INVENTION

The present invention pertains to a control for an electrophotographic copying machine and, more particularly, to a method for controlling an electrophotographic copying machine by means of a single control element.

It is conventional in the art of an electrophotographic copying machine that a plurality of microswitches are provided for sensing events in the sequence of operation of the machine, the respective outputs of the microswitches being useful to determine the next succeeding events.

Briefly speaking, in the electrophotographic copying machine, there is provided a photo-sensitive member or a master paper carrying a photoconductive layer deposited on the upper surface of an electrically conductive layer. First, uniform charge is carried out on the photoconductive layer on the master paper. If the photoconductive layer is exposed to a light pattern, the corresponding electrostatic latent image is formed thereon. Thereafter, the latent image is developed in a visual form by means of toners through a development station. A copy sheet after being fed is forced into a close contact position with the photosensitive member to transfer the toner image onto the copy sheet which in turn is sent to a fixing station for the purpose of fixing the toner image. The copy sheet is finally sent to an outlet.

As briefly stated, the sequence of copying operation consists of the charging, light exposing, developing, transferring, fixing steps, etc., and these steps are under control of the microswitches which sense the feeding states of the copy sheet and the rotation position of the photosensitive drum.

In this case, a control circuit is essentially complicated and needs a number of wirings communicating with the microswitches. The control circuit is typically composed of cascade connected stages of TTL-IC's. Taking an example of the charging station, the control circuit provides charging control signals and operates the charging station via a driver circuit. However, the microswitches cannot be focused on a single position because of operational and physical problems.

Meanwhile, solenoids are employed as a means of transducing respective sensing outputs inclusive ones indicative of copy sheet jam into mechanical outputs. There is created a possibility that the whole of the machine inclusive of these solenoids serves as a source of noises for the electronic control circuits. It is obvious that the control circuits undergo the influences of the noise source because of complexity and extended length of wirings. In addition, while the essential steps of the machine such as the charging, the light exposure and movement of an original table are carried out in synchronization of the master paper, the control circuits operate in response to signals inputted in an asynchronous mode. Therefore, they are susceptible to noise.

The control for the electrophotographic copying machine needs a sufficiently long period of time to return of the original table upon operation of a print start switch. Nevertheless, it is not necessarily required to perform the sensing operations of the microswitches in a parallel fashion. If time permits, the operating states of the family of the switches can be confirmed in a serial fashion. Such conversion into the serial control permits extra wirings to be avoided and maximum allowance for noise to be enhanced.

SUMMARY OF THE INVENTION

To achieve the above, in accordance with the present invention, a microprocessor implemented with a one-chip, one-package, MOS-FET ROM-RAM scheme is employed to provide a control for copying operation.

The micro-processor is one that operates sub-divided digital control and arithmetic circuits under control of a string of instructions stored in a read-only memory (ROM) together with transmission with a read-write memory (RAM).

Fortunately, the inherent disadvantages of the microprocessor that the processing speed thereof is much longer is negligible as compared with the normal operating speed of the electrophotographic copying machine. Therefore, the combined copying machine and micro-processor is very preferable.

In particular, employment of MOS-FET's provides less or no power consumption and enhances degree of integration as compared with TTL's.

In addition, a considerable reduction in the size of the electronic control circuit is realized by employing the micro-processor for controlling the copying machine. In other words, the control circuit needs merely a single element that is the micro-processor. This enhances degrees of reliability and service and eliminates the influences of incoming noises. Interconnections are simplified because confirmation as to the respective states of the copying machine, for example, sensed by the microswitches is performed in a series fashion. Moreover, when it is desired to modify the specification of the machine itself or to accommodate the machine to modification in its peripheral tools in future, all that is necessary is to modify the micro-processor. These advantages are not expected at all in accordance with the conventional parallel controlled copying machine.

BRIEF DESCRIPTION OF THE DRAWINGS

These and other objects and novel features of the present invention are set forth in the appended claims and the present invention as to its organization and its mode of operation will be understood from a consideration of the following detailed description of the preferred embodiments when used in connection with the accompanying drawings;

FIG. 6 is a diagram showing a string of instructions contained in a storage of the control element;

FIGS. 7 through 10 are logic diagrams showing counters and registers employed to address the storage shown in FIG. 5, wherein FIG. 7 shows a stack register associated with page addressing, FIG. 8 shows a counter associated with step addressing, FIG. 9 shows a counter associated with page addressing and FIG. 10 shows a stag register associated with step addressing;

FIGS. 15 through 28 are diagrams showing instructions written into a ROM on page $P_0$ to $P_{13}$ for controlling the copying machine;

FIG. 35 shows storage positions in the RAM of portions to be controlled;

FIG. 36 shows storage positions of flip-flops stored in the RAM;

DETAILED DESCRIPTION OF THE INVENTION

Figure 1:
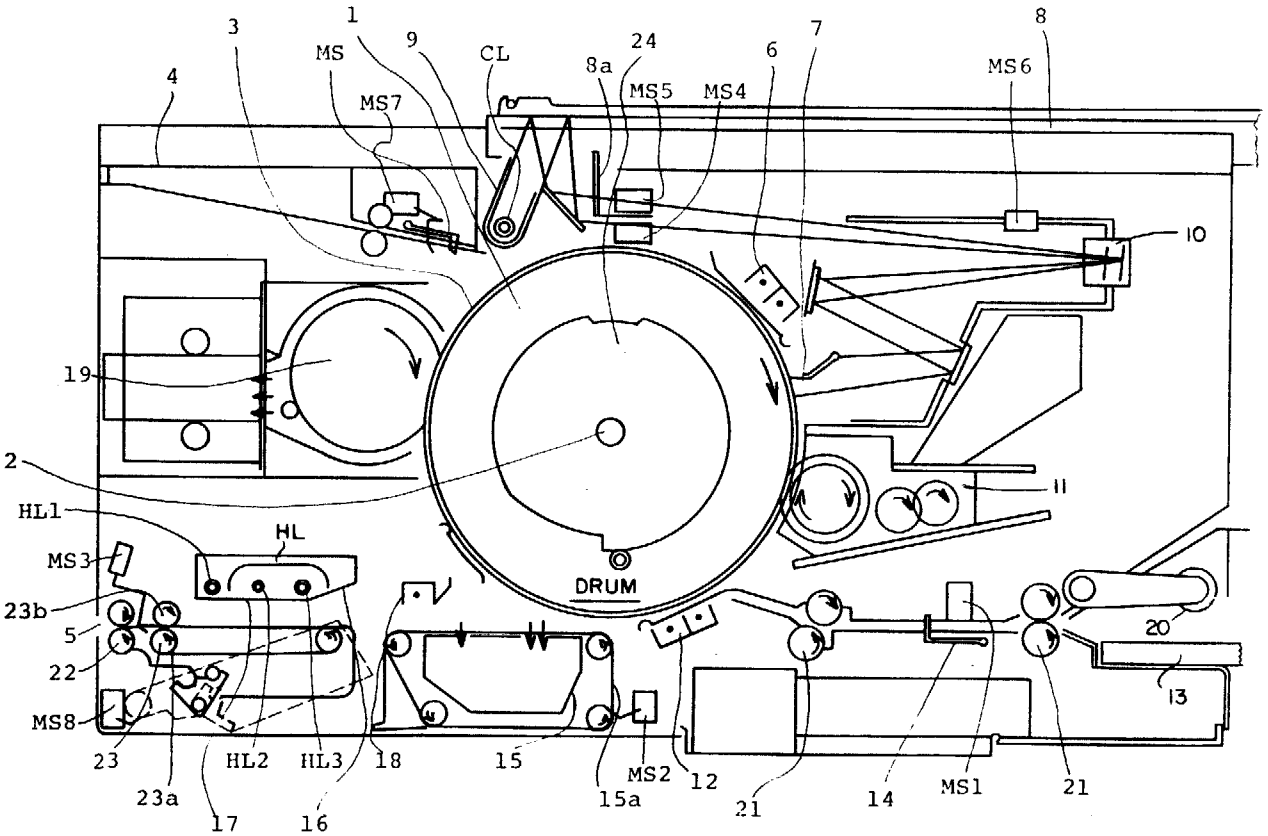
FIG. 1 is a sectional-view showing construction of an electrophotographic copying machine embodying the present invention.

First of all, construction of an electrophotographic copying machine embodying the present invention will be discussed briefly with reference to FIG. 1.

There is provided a rotary drum 1 which rotates about an axis 2 at a fixed rate in the direction denoted by the arrow. The drum 1 is removably covered with a master paper 3, namely, a light-sensitive member having a photoconductive layer at its upper surface and an electrically conductive base at its rear surface. Although the master paper 3 is not illustrated herein, its end position is arrested by means of a finger means secured about the rotary drum 1. Therefore, the master paper 3 is secured about the drum 1. When the old paper 3 is to be replaced by a new one, the finger means is opened so that the old paper 3 is sent to an outlet 5 and at the same time a new paper 3 is introduced into an inlet 4, being arrested by the finger means. This operation is carried out in union with rotation of the drum 1.

A microswitch $MS_7$ disposed adjacent the inlet 4 determines whether the master paper member 3 is entered. As discussed below, an exchange cycle is executed for the master paper 3 as far as the switch $MS_7$ is in the ON state. Description of details of the exchange scheme is omitted herein because it is of no particular importance in understanding the present invention.

Figure 2:
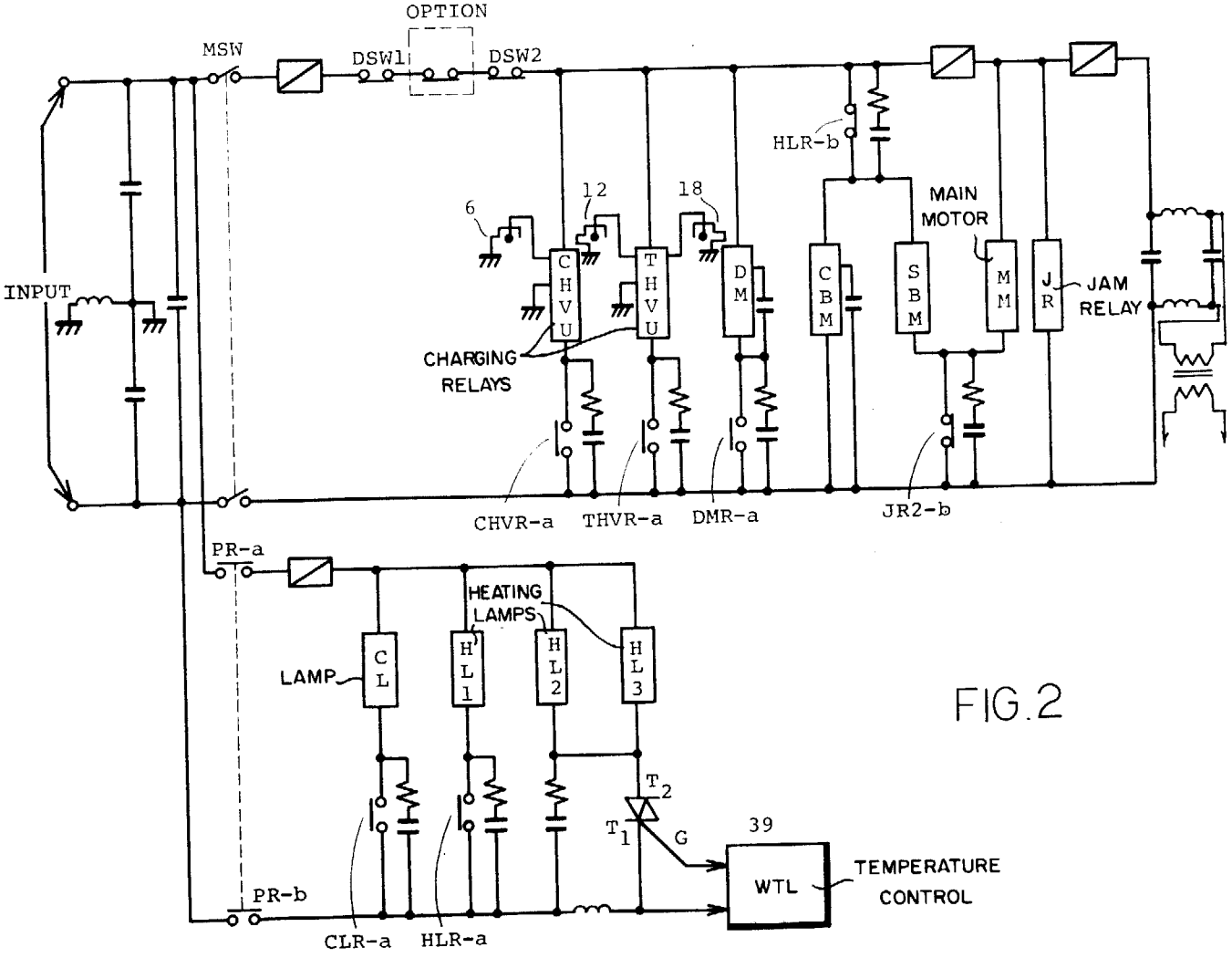
FIG. 2 is a circuit diagram showing a power supply used in the machine of FIG. 1.

A variety of means available for forming an image corresponding to an original on the surface of the master paper 3 are placed in close proximity with the rotary drum 1. A charger 6 is provided for affording uniform charge to the surface of the master paper 3. The charger 6 produces a high voltage effective to provide the surface of the master paper 3 with uniform charge when a high voltage generation region CHVU is activated as shown in FIG. 2. This activation is executed through a charging relay and its contact CHVR-a.

A light exposure station 7 is provided where a light image is applied onto the charge master paper 3, thereby to form its corresponding electrostatic light image. The light exposure is carried out in a manner that an original table 8 carrying an original to be copied thereon is illuminated through a lighting means 9 and light reflected from the original is utilized through an optical system 10.

The original table 8 moves in synchronization with the rotary drum 1. In other words, the original table 8 begins to rotate as soon as the light-sensitive member on the rotary drum 1 has arrived at the light exposure station 7. The rate of movement of the original table is, of course, equal to the rotation ratio of the drum 1.

A development station 11 charges the electrostatic latent image into a visual image through the use of toners.

A charger 12 is provided for transportation of the toner image onto a copy receiving paper 13. The paper 13 is automatically fed via a feeding roller 20 and led via a first roller 21 into the interior of the machine. The feeding of the paper is prohibited by a paper stopper 14 for a while. Introduction of the paper is sensed by a microswitch $MS_1$. When the rotary drum 1 rotates by a certain degree under the circumstances that the microswitch $MS_1$ senses the introduced paper, the stopper 14 is opened so that the transportation paper 13 is fed in good time and forced into close contact position with the master paper 3 bearing the toner image. Through the charger 12 the toner image is transported onto the copy receiving paper 13. A pick-off means 15 serves to remove the copy paper 13 from the master paper 3.

Upon removal of the copy paper 13 from the master paper 3, the paper 13 is attached to a conveying belt 15*a* with aid of absorption power created within the pick-off means 15. A second microswitch $MS_2$ secured adjacent the pick-off means 15 senses separation of the copy paper.

At this stage the toner image has not yet been transferred on the paper 13. The fixture of the toners is needed. This is accomplished by advancing the paper 13 toward a fixing station 16 through the conveying belt 15*a*.

The toner fixing station 16 includes a heating lamp HL as a heating source to effect the fixing procedure. The fixing station 16 bears a range of the optimum temperatures. The machine will fail to achieve the copying operation unless the optimum temperatures are exceeded. The optimum temperatures are about 300° C.. It is noted that a paper tray 17 in the fixing station 16 is placed as denoted by the solid line when power is thrown, and shifted to the position denoted by the dotted line when power is opened. This state is sensed by a microswitch $MS_8$. The reason why the tray 17 is shifted upon removal of power supply is that the paper is isolated from the heating lamp HL to prevent combustion and to facilitate removal of the paper 13 in the event of paper jamming.

The paper 13 travels to an outlet 5 by rotation of a feeding roller 22. A microswitch $MS_3$ is positioned adjacent the outlet 5 to sense the leaving paper. A driving roller 23*a* and a follower roller 23*b* in combination are useful to sense a slip roller jam. As far as the paper 13 travels in a normal fashion, rotation of the driving roller 23*a* is transmitted. However, in the case of jamming, no transmission of rotation results.

Meanwhile, a discharger 18 removes charge on the paper 13 by means of corona discharge. Although not shown, light beams from the heating lamp HL remove charge carried on the light-sensitive member 13 and a brush 19 clears up the surface of the light-sensitive member 13 to get it ready for the formation of a next latent image.

It will be understood that the discharger 18 and the charger 12 produce corona discharge effective to discharging and charging for image transformation when the high voltage generation portion THVU is connected. Operation of the portion THVU is realized when a relay is turned ON and its contact THVR-a is closed in response to control signals from control circuits.

The original table 8 starts advancing as soon as the rotary drum 1 reaches a specific rotation position, and returns to its home position when its degree of advancement is in excess. A microswitch $MS_4$ is positioned against an actuator 8*a* moving in union with advancement of the original table 8, to thereby detect the home position of the original table 8. The microswitch $MS_5$ facing against the above-discussed microswitch $MS_4$ serves to detect excess advancement of the original table 8.

Pursuant to the concept of the present invention, a one-chip micro-processor governs revolution of the rotary drum 1, advancement and return of the original table 8, transportation of the paper, actuation of the chargers 6, 12 and the discharger 18, etc. Normal events in the sequence of a copying operation are carried out as discussed below.

First, a main motor MM starts rotating when a power switch MSW is thrown. Contacts PR-a and PR-b (see FIG. 2) of a power relay are closed such that the heating lamp $HL_2$ and $HL_3$ are turned on to increase the temperature of the fixing station 16. When the fixing station 16 is heated over a predetermined temperature, the ready state for a copying operation is visually displayed. Upon depression of a print switch PSW the rotary drum 1 rotates such that the respective components operate depending upon the states of the microswitches or sensing switches. That is, when the rotary drum 1 reaches a specific position, the lamp CL in the illumination station 9 is turned on so that the surface of the master paper 3 is charged by the respective chargers and simultaneously the original table 8 starts to move. If the microswitch $MS_1$ senses the introduction of the paper, then the paper stopper 14 will be opened in synchronization with rotation of the drum 1. The paper 13 is conveyed via the roller 21. At the light exposure station 7 an electrostatic latent image is formed on the master paper 3. The latent image is changed into a toner image via the development station 11. The paper 13 is conveyed so as to come into contact with the master paper 3. Then, the toner image is transferred onto the paper 13 after passing over the charger 12. The paper is detached from the light-sensitive member 3 on the drum 1. Within the pick-off means 15 the paper is attracted onto the conveying belt 15*a* through air absorption force, the residual charge thereon being cleaned up through the discharger 18. After traveling within the fixing station 16, the copy paper 13 is led to the outlet 5 via the feeding roller 22.

Discharge is carried out on the surface of the light-sensitive member 3 by light beams emitted from the heating lamp HL in the fixing station 16. The brush 19 cleans up the copy paper. Thus, the machine is ready for the formation of a next latent image. If the original table 8 has overrun the predetermined distance, the microswitch $MS_5$ becomes operative such that the table 8 restores to its home position. This return is sensed by a microswitch $MS_4$. Therefore, the copy paper is stopped and the rotary drum 1 also is stopped at its initial position.

In the making of multiple copies, the procedure is repeated. For example, a multicopy dial is provided such that copy operation is inhibited when one dial shows zero. This may be detected by a microswitch $MS_6$.

Figure 3:
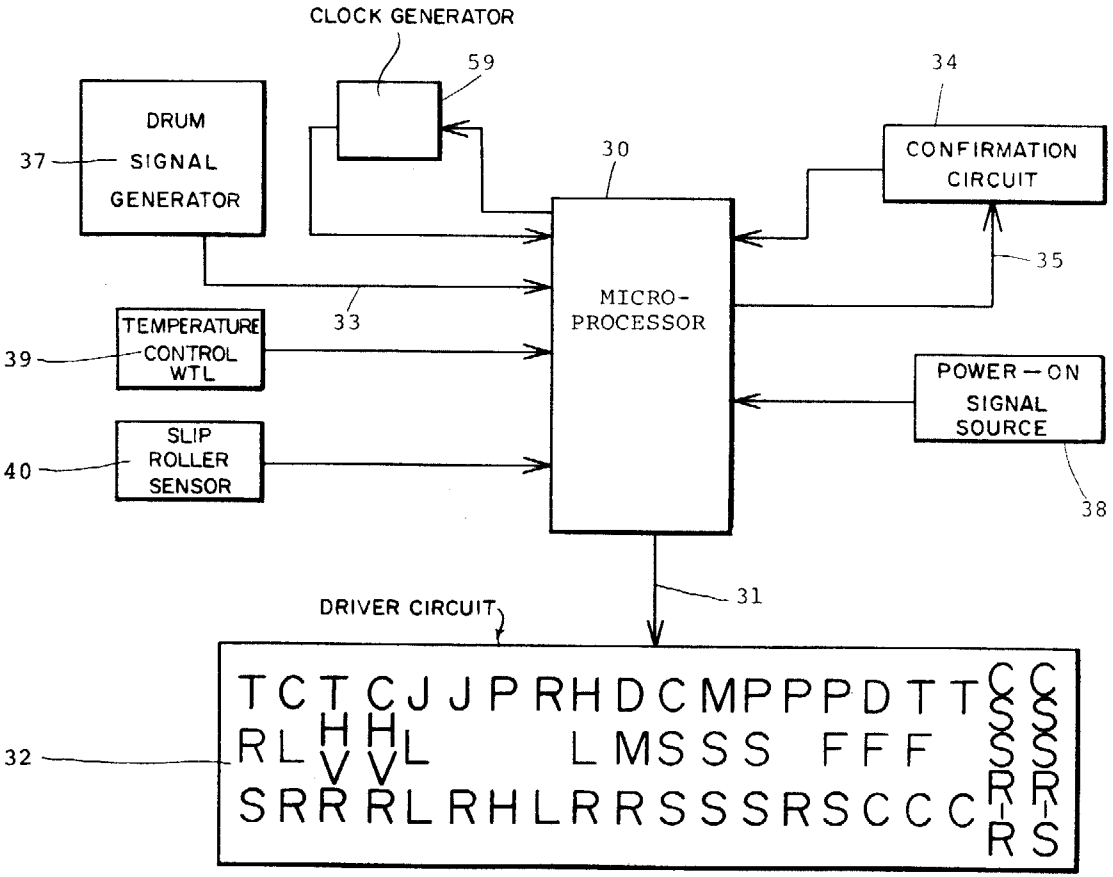
FIG. 3 is a block diagram showing a control for the machine.

FIG. 3 shows a block diagram of the copying machine employing the micro-processor of the present invention. In FIG. 3, 30 designates a one-chip, one-package micro-processor (hereinafter referred to as a "control element"). Control signals derived from the control element 30 supply current to solenoids, relays via a driver circuit 32. For example, when a drum feed clutch DFC is on, the rotary drum 1 begins to rotate. In order to control the solenoids, the relays, etc., synchronizing signals 33 associated with rotation of the drum 1 are inputted to the control element 30. These signals 33 permit strobe signals 35 to be derived from the control element 30, the strobe signals being useful to confirm the operating states of the microswitches 34.

The control element 30 outputs the control signals 31 to control the copying machine in accordance with the confirmed states of the microswitches and the synchronizing signals.

Figure 4:
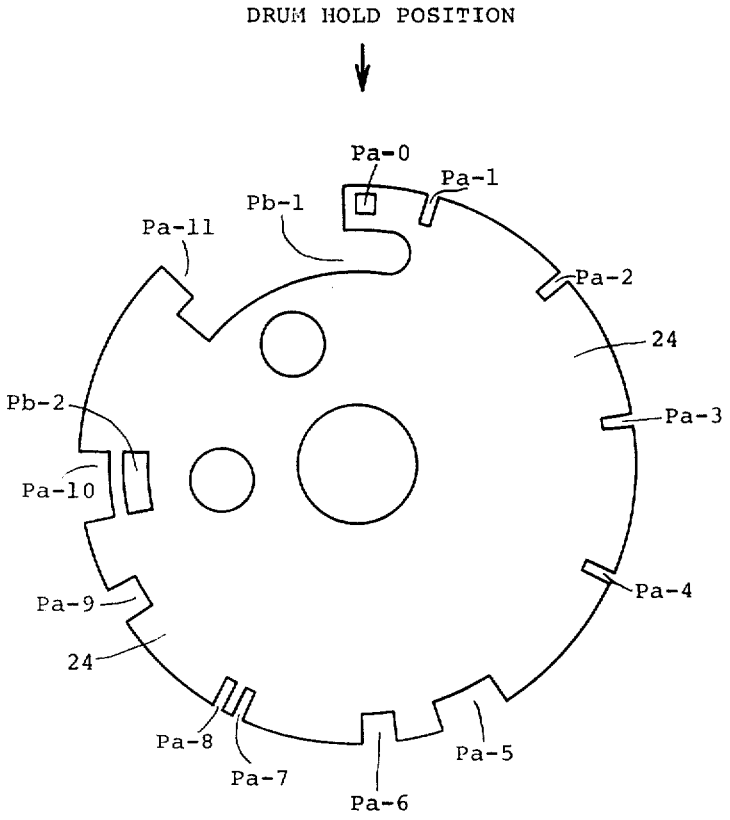
FIG. 4 is a front view showing a disc adapted to rotate in union with a rotary member and to generate a series of synchronizing signals.

The synchronizing signals 33 to be applied to the control element 30 are provided by a signal generation portion 37 responsive to rotation of the rotary drum 1. That is, the generation portion 37 comprises a series of slits Pa and a series of slits Pb formed on a disc 24 as shown in FIG. 4 coaxial with the shaft 2 of the rotary drum 1 and a photo-coupler secured with intervention of these slits. Accordingly, a signal 33 synchronous with rotation of the drum 1 is outputted via the signal generation portion 37. The position as shown by the arrow in FIG. 4 is the initial one of the rotary drum 1. Under these circumstances the synchronizing signals are obtained via the slits Pa-0, Pb-1.

A WTL level control circuit 39 is adapted to adjust the temperature of the fixing station 16 at a desired one by controlling the two heating lamps $HL_2$ and $HL_3$. The outputs of the WTL level control circuit 39 are applied to the control element 30. When the outputs from the circuit 39 assume the logic value "1", this indicates that the temperature of the fixing station 16 reaches the desired temperature. The logic value "0" shows that the same is below the desired one.

A circuit 40 senses slip roller jamming. In the event that there are abnormal events in operation of the roller 23, the control element 30 is informed of such abnormality. In summary, the logic value "1" shows the jam state while the logic value "0" shows the normal state.

When the power switch MSW of FIG. 2 is closed, the main motor MM rotates and the control element 30 is placed in its original state upon receipt of the signals from the signal source 38. The drum 1 and the original table 8 rotate, shift and stop once. Now, when the signals from the WTL circuit is "1", depression of the print switch PSW permits the control element 30 to provide its control signal 31. The resulting signal renders the drum feed clutch DFC operative via the driver circuit 32 to rotate the rotary drum 1. In response to such rotation of the drum 1 the synchronizing signals 33 are impressed on the control element 30. The outcome is that the control element 30 delivers the strobe signals 35 for confirmation of the operating states of the micro-switches and the control signals 31 are provided for the driver circuit 32. The control signals 31 operate the solenoids, the relays, etc. to sequentially perform the charging and movement of the original table.

Figure 5:
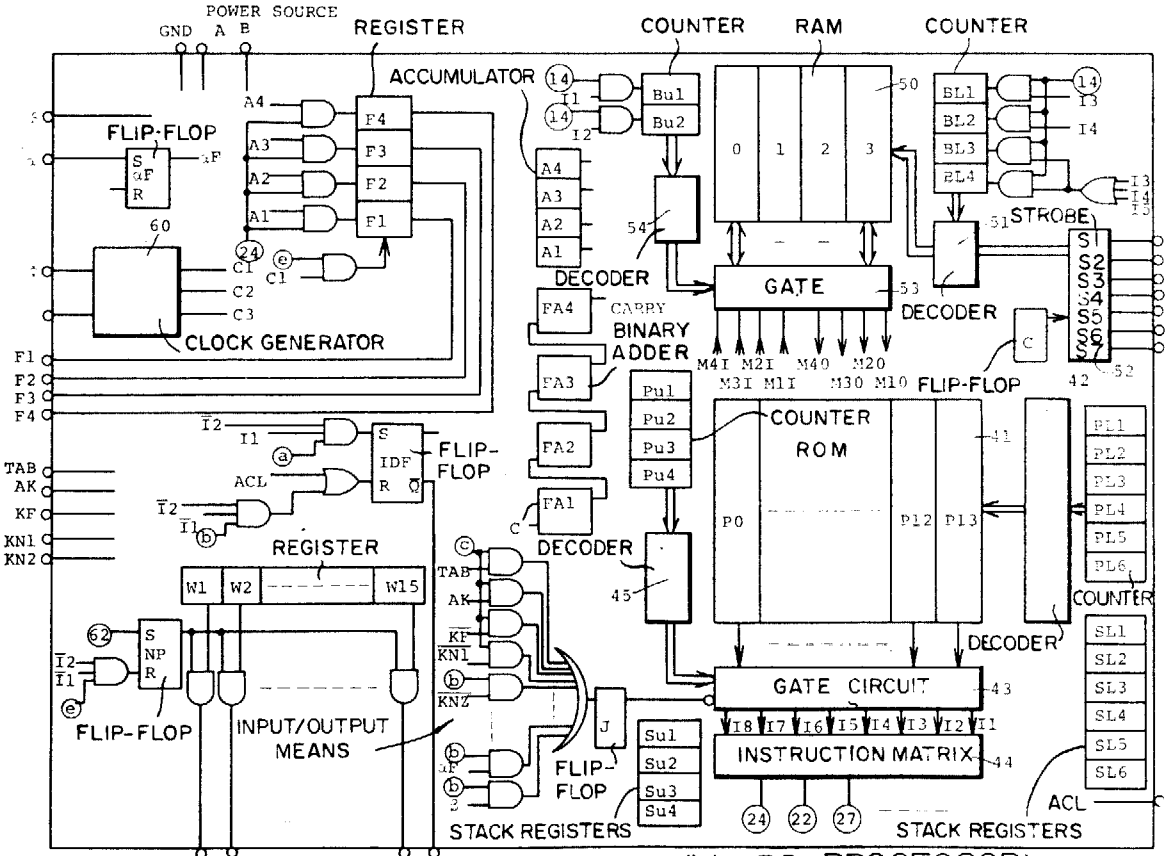
FIG. 5 is a block diagram showing implementation of a control element of the present invention.

The control element 30 featured by the present invention will be explained in detail. The control element 30 includes a read-only memory (ROM), a read-write memory (RAM), an accumulator, an input/output means, a clock pulse generator and a power supply. FIG. 5 shows a block diagram of contruction of the control element 30. The ROM 41 contains instructions each implemented with 8-bit parallel signals $I_1$–$I_8$. All the instructions are partitioned into page $P_0$ through page $P_{13}$ each page having 64 words (or steps). The stored instructions are fetched in sequence.

More particularly, the ROM 41 has a 6-bit counter PL available for addressing a specific step in respective ones of the pages, the counter PL being adapted to increment step-by-step except when a jump instruction is fetched from the ROM. There is provided also a 4-bit counter Pu to address a specific page within pages $P_0$ through $P_{13}$. This counter Pu is different from the counter PL in that its counts are varied only when a jump instruction is fetched. Address signals from the counter PL provide access to a specific step of the ROM 41 via the decoder 42. As a consequence of this, the ROM 41 delivers all instructions belonging to the same step on page $P_0$ through $P_{13}$ and leads them to a gate circuit 43. In response to signals received from the counter Pu via the decoder 45, the gate circuit 43 outputs the code signals $I_1$–$I_8$ of the instructions on the specific page which in turn are transferred to an instruction matrix 44. The instruction 44 produced micro-orders, that is, inputs to respective logic circuits.

After execution of the instructions, the counter PL is one incremented but the counter Pu is not varied except for jump. In this manner, the respective instructions are sequentially fetched from the ROM 41.

The ROM 41 also includes stack registers SL and Su similar to the bit arrangement of the counters PL and Pu. If the jump instruction is read out from the ROM 41, the current count of the counter PL plus one are loaded into the stack register SL while the count of the counter PU is loaded into the stack register SU. The designation to be jumped is stored in the counters PL and PU. Afterward, when the instruction to be returned is fetched from the ROM 41, the counts of the stack registers SL and SU are transferred to the counters PL and PU. Consequently, the ROM 41 reverts to the next step immediately after the step calling for the jumping.

Format of the instructions contained within the ROM 41 is illustrated in FIG. 6. There are illustrated several types $TR_1$, $TR_0$, SSR, RTN and $RTN_1$ of instructions effective to address the ROM 41. Although sub-routine pages $P_0$, $P_1$, $P_2$ and $P_3$ are previously determined, it is of course possible to employ all of pages as main routine ones. The instruction SSR indicates that the code signals $I_1$–$I_4$ of the instructions are to be transferred into one stack register SU. The SSR codes $I_8$–$I_1$ are denoted as "0111XXXX" in FIG. 6. The micro-order (4) is resulted so that the micro-order (4) applied to AND gates 106a–109a render the same effective. $I_1$–$I_4$ are inputted into the stack registers $SU_1$–$SU_4$ via OR gates 106–109.

Figure 8:
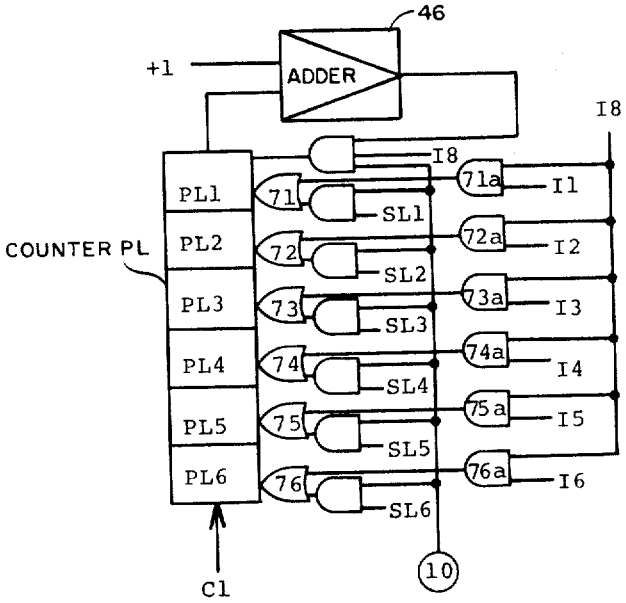

TR0 is an instruction indicating that the instruction codes $I_1$–$I_6$ are to be jumped into the steps 0 through 63 on the same page. This is denoted as 10XXXXXX and provides a micro-order 2. Since the instruction code $I_8$ is "1" as shown in FIG. 8, AND gates 71a–76a operate so that the contents of the code signals $I_1$–$I_6$ are loaded via OR gages 71–76 into counters $PL_1$–$PL_6$ of which the contents are modified into the contents represented by the codes $I_1$–$I_6$. The step represented by the codes $I_1$–$I_6$ are thus addressed.

If there is data stored within the stack register SU, its contents are transferred to the counter PU to enable jump to a specific page. SSR and $TR_o$ are a combined instruction. When SSR is first fetched, the stack register SU is loaded with $I_1$–$I_4$. When $TR_o$ is next fetched, the contents of the stack register SU are transferred to the counter PU. The counter PL indicates jump to a specific page upon receipt of the contents $I_1$–$I_6$.

Figure 7:
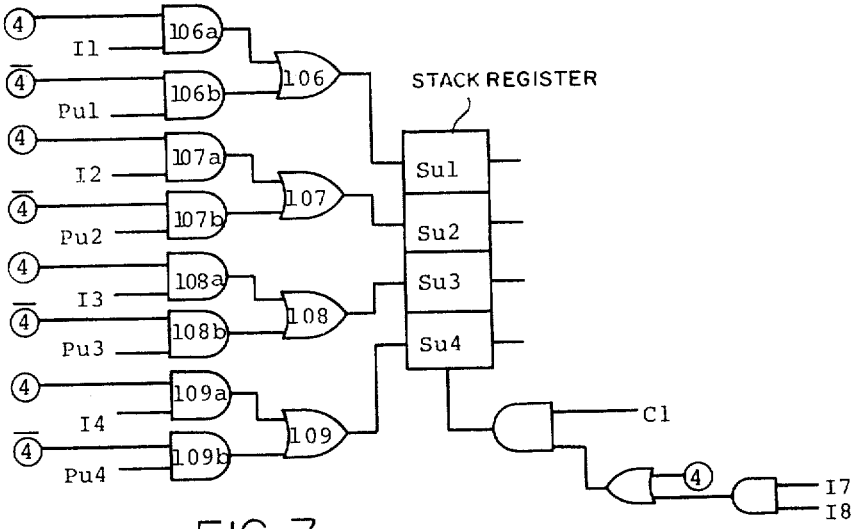
Figure 10:
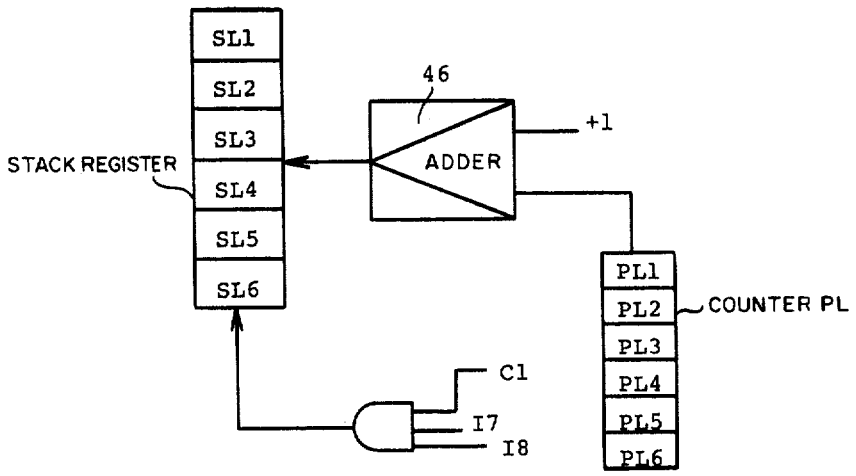

During a main routine $TR_1$ instructs jump to a sub-routine if it is fetched. The jumped designation is page $P_0$. In this case the codes $I_8$–$I_1$ are denoted as "11XXXXXX" and no micro-order is resulted. Referring to FIG. 10, the contents of the counters $PL_1$–$PL_6$ are one-step incremented via an adder 46 and then transferred into the stack registers $SL_1$–$SL_6$. Because of $I_8=I_7=$"1" on counters $PL_1$–$PL_6$ are one-step incremented at the timing of a clock signal $C_1$. The incremented contents being transferred into the stack registers $SL_1$–$SL_6$. In FIG. 7, since no micro-order is developed AND gates 106b–109b are effective so that the contents of the counters $PU_1$–$PU_4$ are transferred to the stack registers $SU_1$–$SU_4$. Contrarily, the counter $PU_1$–$PU_4$ receives no signals and assumes all "zeros". This designates page $P_o$ that is the subroutine page. In addition, since the code $I_8$ is "1" in FIG. 8, the contents of $I_1$–$I_6$ are transferred to the counter $PL_1$–$PL_6$, thereby designating the step indicated by the contents $I_1$–$I_6$ on page $P_o$.

Figure 9:
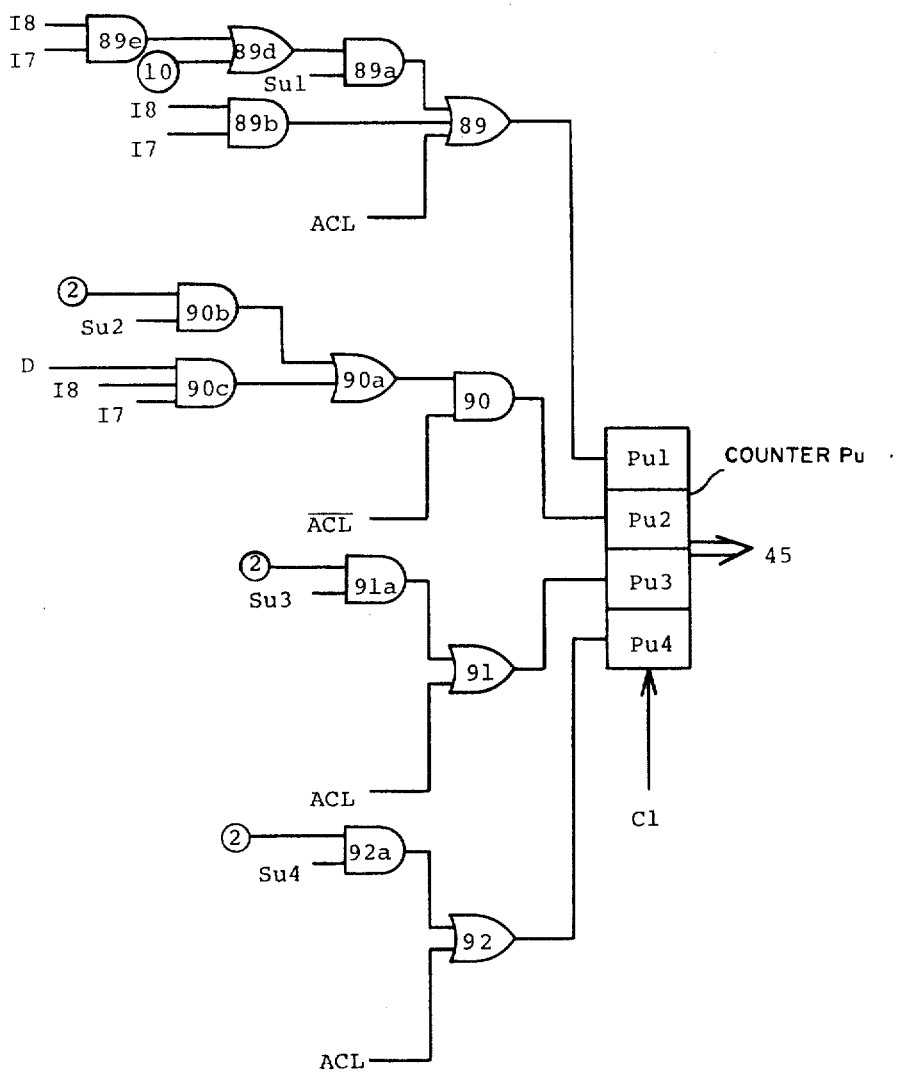

RTN is an instruction useful for executing return from the sub-routine to the main routine. In response to the above discussed instruction $TR_1$, the next step following the jumped subroutine is approached. In other words, when RTN is fetched during the sub-routine, the counters PU and PL are actuated to designate the next step following the jumped step. In case where the instruction $TR_1$ calling for jump is fetched, the contents of the counter PU are shifted into the stack register SU and the contents of the counter PL are shifted into the stack register SL with one-step increment. It will be easily understood for this reason that the contents of the stack register SU and the stack register SL are respectively shifted into the counter PU and the counter PL. The codes for the RTN instruction are "01011110". At this time, micro-orders 2 and 10 are derived. In FIG. 9, AND gates 89a, 90b, 91a and 92a are effective, thereby transferring the contents of the stack register $SU_1$–$SU_4$ into the counter $PU_1$–$PU_4$. In this drawing, ACL represents the signals derived from the signal generation source 37 discussed with respect to FIG. 3. When these signals ACL are inputted, the counter $PU_1$–$PU_4$ assumes "1011", page 13 of the ROM 41 is assigned.

Alike the instruction RTN, $RTN_1$ is used for return to main routine from sub-routine, thereby skipping the instruction contained in the step following the step which has called for jump to subroutine in response to the instruction $TR_1$. The second step following the step of the instruction $TR_1$ is executed. Since the outputs from a flip-flop J are supplied via an inverter to the gate circuit 43, the instruction on the next step is skipped. Therefore, when $RTN_1$ is fetched, the flip-flop J is set thereby skipping the next instruction following the step calling for jump into sub-routine by instruction $TR_1$.

The following sets forth the RAM 50 within the control element 30. Similarly, the RAM 50 has a 4-bit counter BL for addressing words or steps. The counter BL is variable in accordance with instructions. However, if instructions have no properties of varying the contents of the counter BL, the counter BL remains unchanged. The RAM 50 is further provided with a 2-bit counter BU available for four blocks 0–3 of the RAM 50. The 2-bit counter BU also remains unchanged except for the instructions read out from the ROM 41 bearing the properties of changing the contents of the counter BU.

The outputs of the counter BL are inputted to a decoder 51 of which the output permits the addressing of a specific word in the blocks 0–3 belonging to the same step of the RAM 50. Therefore, the addressed word is provided with access via the gate 53. The output of the counter BU is supplied to a decoder 54 of which the output renders a portion of the gate circuit 53 in the selected block operative. Thus, the outputs of the counters BL and BU provide access to a specific step in the signle block of the RAM 50.

The 4-bit input/output signals are in parallel supplied from and to the gate circuit 53. The input signals $M_1I$-$M_4I$ are stored in a specific step addressed by the counter BL within a specific block designated by the counter BU. The output signals $M_{10}$–$M_{40}$ are ones stored on a specific step within a specific block .

Figures 11, 12:
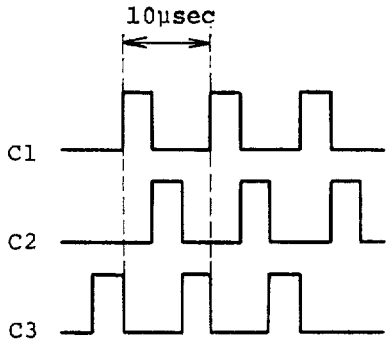
FIG. 11 is a time chart showing clock signals derived from a clock generator in FIG. 5.
FIG. 12 is a diagram for illustrating operation of a RAM in FIG. 5.
Figure 13:
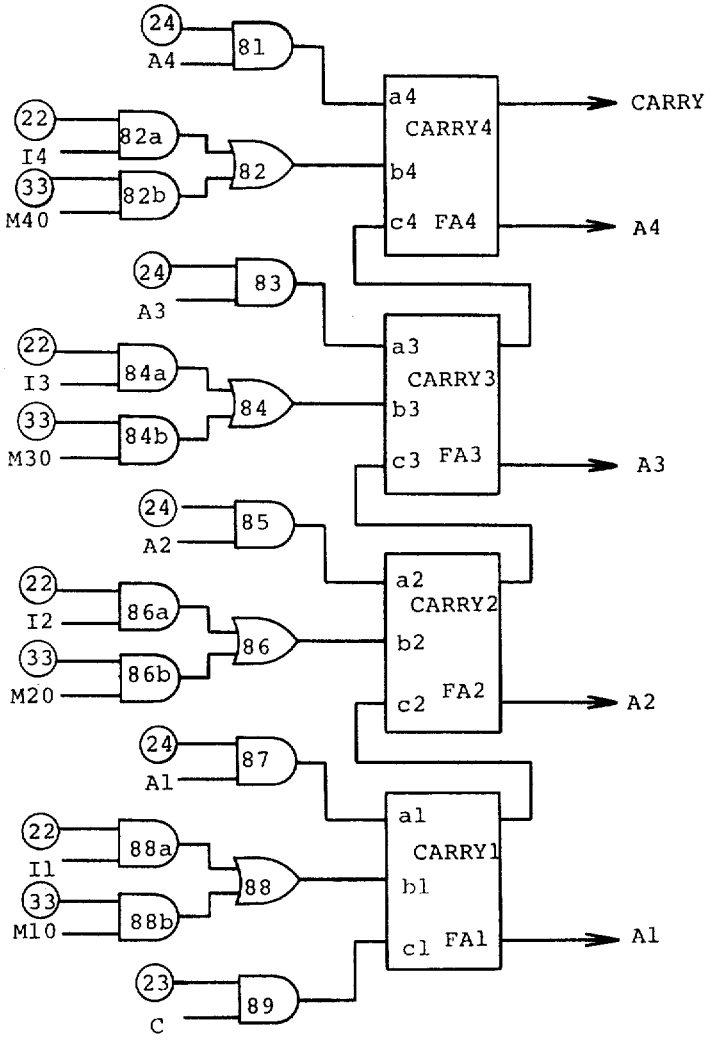
FIG. 13 is a logical gate diagram for illustrating operation of an adder of FIG. 5.

As shown in a time chart of FIG. 11, the clock generator 60 produces clock signals $C_1$, $C_2$ and $C_3$. The clock signal $C_1$ makes it possible to enter the above described input signals $M_1I$–$M_4I$ into the RAM 50. They are stored in the RAM 50. The clock signals $C_3$ permit the contents of the RAM 50 to be outputted as the output signals $M_{10}$–$M_{40}$ via the gate circuit 53. The fetching of the instructions from the ROM 41 is carried out in synchronous with the clock signals $C_1$. It takes approximately 10 μsec to fetch the next succeeding instructions.

The decoder 51 serves to address the RAM 50 and provide the decoder outputs outside the control element. These outputs are derived from terminals $S_1$, $S_2$, $S_3$, . . . $S_7$, when the counter BL is "15", "14", "13", . . . "19", respectively. The signals from the terminals $S_1$–$S_7$ are used as key strobing signals as well known in the art of calculators.

By way of example, the instructions fetched from the ROM 41 will be executed in the following manner.

When fetching the instruction LB from the ROM 41, its instruction codes $I_1$–$I_5$ are shifted into the address counters BU and BL to designate a specific position of the RAM 50. The counter BL may be set into any one of "0000", "1100", "1101", "1110" or "1111". The counter BU may designate any blocks 0-3. These circumstances are viewed from FIG. 12. When LB is fetched as shown in FIG. 6, the micro-order (14) is developed so that the micro-order 14 and the instruction code $I_3$ are applied to the counter BL, via an AND gate. The counter $BL_2$ receives the AND gated output of (14) ad $I_4$. The counter $BL_3$ receives the OR gated output of $I_3$, $I_4$ and $I_5$ and the AND gated output thereof including (14) as another input. Therefore, when it is desired to modify the contents of the counter BL into "0000" as viewed from FIG. 12, all that is necessary for $I_5$, $I_4$ and $I_3$ is to assume "000". Similarly, $I_5$, $I_4$ and $I_3$ should be "100", "001", "010" and "011" when the contents of the counter BL are to be "1100", "1101", "1110" and "1111", respectively.

The instruction codes $I_2$ and I designate a specific block of the RAM. The AND gated output of the instruction code $I_1$ and the micro-order 14 is applied to the counter BU1 and the AND gated signals $I_2$ and 14 are applied to the counter BU2. When it is desired to designate the block "0" the contents of the counter BU should be "00" and thus the codes $I_2$ and $I_1$ should be "00". Similarly, when $I_2$ and $I_1$ are "01" and the counter BU are "01", the first block of the RAM is assigned. When the codes $I_2$ and $I_1$ and thus the counter BU are "10", the second block is assigned. When the counter BU is "11", the third block is designated.

If the instruction LB is fetched from the ROM 41, the codes assume "01000100" so that $I_5$, $I_4$ and $I_3$ are "001" and $I_2$ and $I_1$ are "00". Therefore, the counter BL is "1101" while the counter BL is "00". It will be obvious from FIG. 12 that the instruction LB designates (4) of the 13th stop of the block 0 of the RAM. The respective one of the steps consists of 4 bits each corresponding to the respective input and output signals $M_1I$—$M_4I$, $M_{10}$–$M_{40}$. One bit consists of a flip-flop.

When the instruction SM ("000011XX") is outputted, is forced into set position one bit designated by the instruction codes $I_2$ and $I_1$ within four bits of the RAM 50 addressed by LB. In other words, when the codes $I_2$ and $I_1$ are "00", "01", "10" and "11", the 0th, 1st, 2nd and 3rd bits are set, respectively. For example, when the 3rd bit is to be set, $I_2$ and $I_1$ should be "11". In this case, the input signal $M_4I$ should be "1". The remaining bits remain unchanged. In addition, when RSM is outputted, is forced into reset position one bit designated by the instruction codes $I_2$ and $I_1$ within the four bits which have been addressed. At this time, the instruction codes $I_8$–$I_1$ are "000001XX" the instruction $I_4$ of SM is "1" and $I_4$ of RSM is "0". The code $I_4$ is applied to one input terminal of an AND gate of which the remaining input terminals receive $I_2$ and $I_1$. The input signals $M_1I$-$M_4I$ designated by $I_2$ and $I_1$ are inputted as "0" into the gate circuit 53 to reset the designated bit. The micro-order derived in response to RSM and SM is (36) that is used as control signals for gates.

The accumulator is illustrated in FIG. 5. This serves as a repeating station for data transmission and includes 4-bit accumulators $A_1$–$A_4$. Only when instructions are fetched to execute transmission, the clock signals $C_1$ are inputted to the accumulator scheme. These instructions force the accumulators $A_1$–$A_4$ into set or reset position. The accumulator stages $A_1$–$A_4$ are connected to 4-bit binary adder $FA_1$–$FA_4$. A carry flip-flop C is effective when addition or transmission. All arithmetic controls are performed via the accumulator stages $A_1$–$A_4$.

Figure 14:
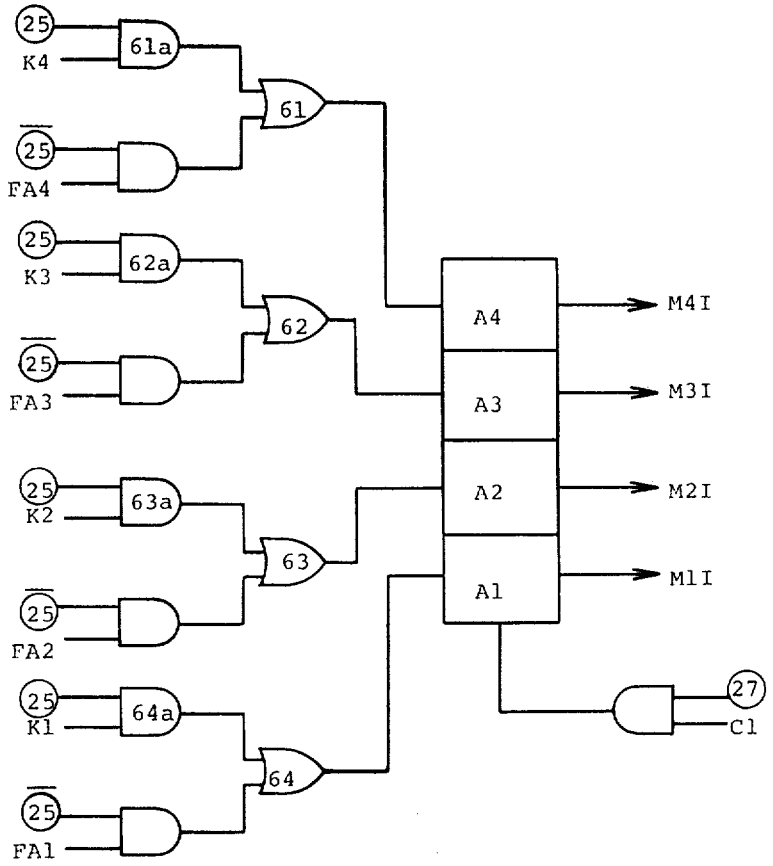
FIG. 14 is a logical gate diagram for illustrating operation of an accumulator of FIG. 5.

When the instruction KTA is shown in FIG. 6 is fetched, the contents of the counter $K_1$–$K_4$ are transferred to the accumulator stages. Under the circumstances, two micro-orders (25) and (27) are derived from the instruction matrix 44. As shown in FIG. 14, OR gates 61–64 serving as set inputs to the accumulators $A_1$–$A_4$ permit the count of the counters $K_1$–$K_4$ to be outputted since the development of the micro-order 25 renders AND gates *61a–64a* operative. The respective stages of the accumulator $A_1$–$A_4$ receive the count of the counter $K_1$–$K_4$ and, in response to the micro-order (27), the count of the counter $K_1$–$K_4$ is transferred into the accumulator $A_1$–$A_4$ through the use of the clock signal $C_1$. When the instruction TAM is fetched, the second instruction rather than the first instruction is executed as far as there is determined equivalency between the accumulator $A_1$–$A_4$ and the output signals $M_{10}$–$M_{40}$ from the addressed RAM 50. In other words, equivalency sensed enables skipping. At this moment, micro-orders (32), (24) and (33) are developed. The development of the micro-orders 24 and (33) renders AND gates 81, 82*b*, 83, 84*b*, 85, 86*b*, 87 and 88*b* effective such that the input terminals $a_4$–$a_1$ of the adder $FA_4$–$FA_1$ receive the contents of the accumulator $A_4$–$A_1$ via the enabled AND gates 81, 83, 85 and 87. On the contrary, the input terminals $b_4$–$b_1$ receive the outputs $M_{40}$–$M_{10}$ of the RAM 50 via the enabled OR gates 82, 84, 86 and 88. A coincidence circuit compares whether the contents of the accumulator $A_4$–$A_1$ applied to the adder $FA_4$–$FA_1$ are equal to the outputs $M_{40}$–$M_{10}$ of the RAM 50. The respective outputs from the coincidence circuit are AND gated and sent to the skipping flip-flop J.

If the contents of the accumulator $A_4$–$A_1$ are in agreement with the outputs $M_{40}$–$M_{10}$ of the RAM, the coincidence circuit provides the logic output "1" which in turn is supplied to the flip-flop J via an AND gate. For this reason, the flip-flop J is set to thereby skip the next instruction.

Conversely, if affirmative answer is not given, the flip-flop J is not forced into the set state, thereby fetching and executing the next instruction.

The input/output means is under control of the instructions fetched from the ROM 41. The input means includes input ports TAB, AK, $KN_2$ receiving the strobe signals from the control element 30 as viewed from FIG. 3 and synchronizing signal receiving ports $\alpha$ and $\beta$ for the purpose of synchronization. The input ports $\alpha$ and $\beta$ accept the signals from the slits Pa and Pb of the disc 24. The former receives the signals from the slits Pa, while the latter receives the same from the slits Pb. In the following description the synchronizing signals are denoted as $P_A$ and $P_B$. There are also included in input port $KN_1$ responsive to signals from the WTL circuit 39 and an input port KF responsive to signals from the slip roller jam detection. As noted earlier, the power supply input ACL reset a family of flip-flops to set up page 13 of the ROM 41.

Meanwhile, the output means has a 4-bit register $F_1$–$F_4$ and a 15-bit register $W_1$–$W_{15}$ of which the outputs are derived in parallel. The registers $W_1$–$W_{15}$ are outputted when a flip-flop $N_P$ is set.

In accordance with the present invention, the signals derived in parallel from the registers $F_1$–$F_4$ and $W_1$–$W_{15}$ provide a control for the copying machine. The clock signals $C_1$–$C_3$ operable within the control element 30 are derived from a clock generator 60 which operates in response to application of signals from a clock generating means 59 to a clock signal input port 4. The outcome is that the clock signals $C_1$, $C_2$ and $C_3$ are generated in a time relationship as shown in FIG. 11.

As discussed above, the instruction are contained within the ROM 41 of the control element 30. FIGS. 15 through 28 illustrate the contents of the instructions written on each page $P_0$ to $P_{13}$ of the ROM 41. If additional functions are needed, all that is necessary is to modify the contents of the instructions contained within the ROM 41.

Flow charts associated with the instructions shown in FIGS. 15 through 28 are depicted in FIGS. 29 through 34.

Now, the power switch is turned ON. The main switch MSW of FIG. 2 is closed so that the main motor MM rotates and the input port ACL receives signals to place the control element 30 into the initial state. As a result, the addressing counter PU assumes "1", "0", "1" and "1" at the respective stages thereof, PU1, PU2, PU3 and PU4, thereby designating page 13. The counter PL is all zero's.

The register $F_1$–$F_4$ in the control element 30 is cleaned to thereby place the contents of the RAM 50 into all zero's state. Since the counter PU shows "1101" and the counter PL shows "all zero's" upon power throw, the instruction LAX on page $P_{13}$ (See FIG. 15) of the ROM 41 is fetched. LAX permits the instruction codes $I_4$–$I_1$ to be inputted into the accumulator. At this moment, $I_4$–$I_1$ are "0000". After the execution of this instruction, the counter PL is one-step incremented and thus ready for the fetching of the next succeeding instruction ATF from the ROM 41. ATF is an instruction that transmits data in the accumulator $A_1$–$A_4$ into the register $F_1$–$F_4$. The register $F_1$–$F_4$ is cleaned up. This means no development of any control signals. Thereafter, the instruction IDFS is fetched. IDFS sets a flip-flop IDF within the control element 30. A set input is applied to the input terminal of the flip-flop IDF because of a micro-order (a), thereby setting that flip-flop. As discussed below, the output IDF of the flip-flop IDF is used as a control signal for a sam lamp JL. Subsequently, NPR is fetched to reset a flop-flop NP. The fetching of the next succeeding instruction RSC resets a flip-flop C of which the output is applied to the gate 52 as the strobe signals. Under the conditions that the flip-flop C is in the set position, the strobe signals are all derived from the terminals $S_1$–$S_7$. But when the same is in the reset position, the strobe signal is derived from any one of the terminals $S_1$–$S_7$ depending upon the count of the counter BL.

After the completion of the last named instruction LB is fetched. At this time the codes $I_5$–$I_1$ are "00000" and thus the counters BU and BL designate the 0th block and the 0th step. As viewed from FIG. 12, the designation address (0) of the RAM 50 is assigned.

The fetching of $TR_1$ enables sub-routine jump. This instruction permits the contents of the counter PU to be shifted into the stack register SU and the count of the counter PL to be one-step incremented and shifted into the stack register SL. When this occurs, the contents of the counter BU are "00" and the contents of the counter BL are "0000". After fetching the instruction $TR_1$ the jump into page $P_0$ of the sub-routine (See FIG. 28) is attained to fetch the 6th step instruction $TR_1$. $TR_1$ jumps into subroutine page $P_1$ so that the AND gate 89*b* of FIG. 9 is enabled to introduce "1" into the counter stage $PU_1$ via the OR gate 89 while the remaining counter stages $PU_2$–$PU_4$ are "0". Consequently, the counter PU designates page $P_1$. The contents of the counter PL are "110110". To this end is fetched the instruction LAX located at the 54th step of page $P_1$.

As discussed previously, since the codes $I_4$–$I_1$ for the instruction LAX are "0000", the contents of the accumulator A are also "0000". After the execution of this instruction, EXCI is fetched to exchange the contents of the accumulator A for the contents of the addressed RAM 50. Simultaneously, the instruction codes $I_1$ and $I_2$ and the contents of the address counter stages $BU_1$ and $BU_2$ in the RAM are impressed on the address counter BU after passing past a non-coincidence circuit. The address counter BL is incremented and, if BL is "1111", the next step instruction is skipped.

When fetching EXCI the RAM 50 assumes "0000" at its 0th block and 0th step. At this time the counter BU is "00" because of the codes $I_1$ and $I_2$ being "0", while the counter BL is "0001" thereby designating the 1st step, 0th block. Because the counter BL is "0001", TR0 is fetched. This instruction is to achieve the jump within the same page. The codes $I_1$–$I_6$ are inputted into the counter PL which assumes "110110". The procedure jumps into the 54th step on page $P_1$ to enable the fetching of the instruction LAX.

In summary, the above sequence is repeated such that the contents of the respective steps in the 0th block of the RAM 50 are placed into all "zero's" state and, when BL assume "1111", the instruction RTN is outputted. RTN is executed to shift the contents of the stack registers SU, SL into the counters PU and PL. As a result, the main routine is reverted from the sub-routine. To this end, the counter PU is "1011" and the counter PL is "000111" so as to fetch LB. This leads to the facts that the address counter BU of the RAM 50 is "01" and the counter BL is "0000", thereby designating the 0th step, the 1st block of the RAM 50 (See FIG. 12). The instruction $TR_1$ is fetched so that the respective steps of the first step are all "0's". The same circumstances are applicable to the second and third blocks. The above discussed procedure places the control element 30 into its initial state.

Figure 29:
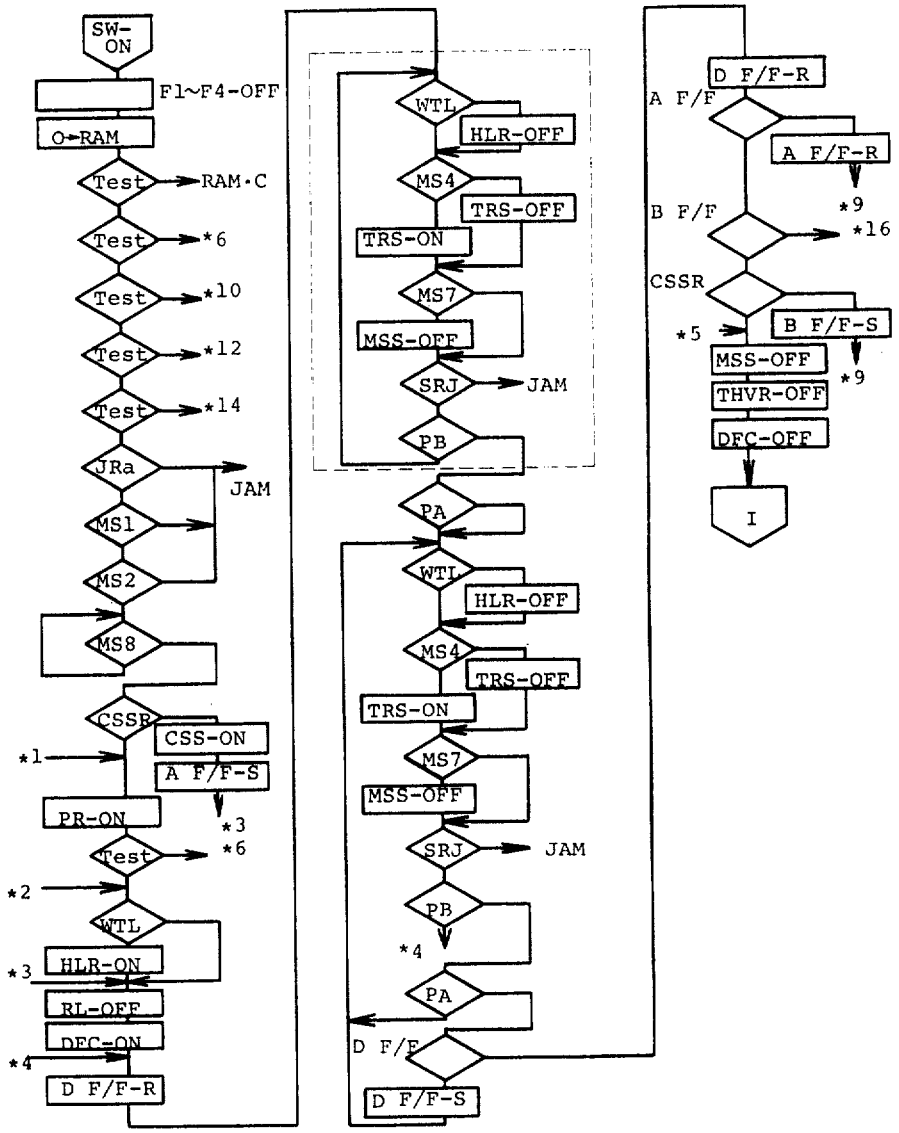
FIGS. 29 through 34 are flow charts associated with the instructions shown in FIGS. 15 through 28.

Reverting the flow chart of FIG. 29, a test judge is achieved after operation of 0→RAM. The test judge is achieved to find out whether the events in the sequence of machine operation are succeeded satisfactorily. In the following description it is assumed that no affirmative answers are given for all the events.

After completing the test judge, determination is performed as to a contact JR-a of a jam relay JR. If there is caused a copy paper jam, the contact JR-a is closed thereby informing the operator of such jam.

Figure 37:
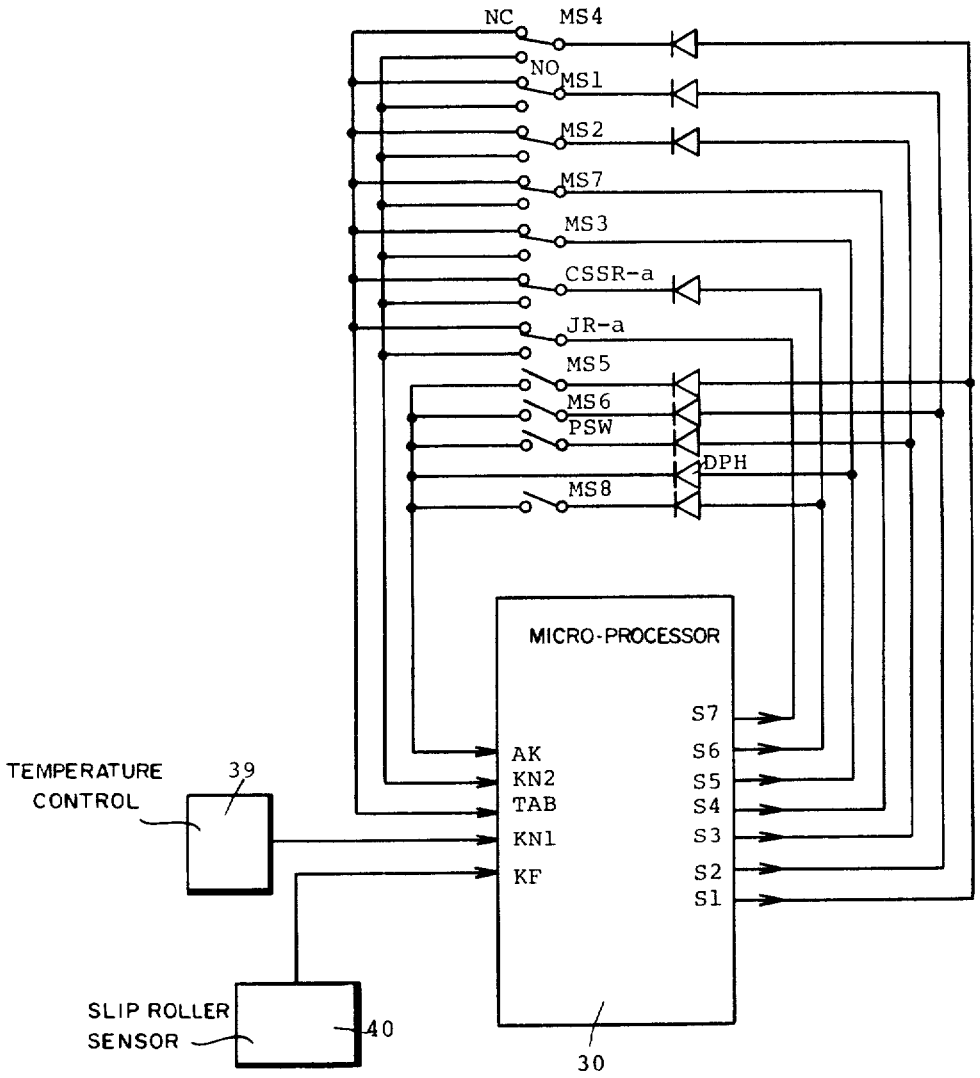
FIG. 37 is a block diagram showing input and output terminals of the control element.

In the following description assumption is placed for the purpose of explanation that in this case the judge answers NO to thereby judge the microswitch $MS_1$. One terminal of the microswitch $MS_1$, the remaining microswitches $MS_2$–$MS_8$, the jam relay contact JR-a, the master paper exchanger contact CSSR-a and the print switch PSW as illustrated in FIG. 37, are connected with the strobe output terminals $S_1$–$S_7$ of the control element 30, while their other terminals are connected in common with the input terminals TAB, AK and $KN_2$ of the control element 30. This is one of the important features of the present invention. It will be obvious from FIG. 37 that the number of necessary wires communicating between the microswitches and the control element 30 is considerably reduced. In other words, determination is carried out in a serial fashion as to the instantaneous conditions of the respective microswitches.

When it is desired to sense the conditions of the microswitch $MS_1$, $TR_1$ on the 37th step is fetched from the ROM 41. Consequently, the jumped 12nd step on the sub-routine page $P_0$ becomes operative. LB is fetched to designate the 14th step of the first block of the RAM 50 for the purpose of achieving jump into the sub-routine page $P_1$ responsive to the next instruction $TR_1$. Thus, SSR is fetched.

The counter BL which addresses steps in response to the instruction LB, assumes "1110" so that the strobe signal is derived from the terminal $S_2$ via decoder 51. As shown in FIG. 37, the strobe signal $S_2$ is impressed on the microswitch $MS_1$ having the contact NC connected with the input port TAB of the control element 30 and the contact NO connected with $KN_2$. When the microswitch $MS_1$ is turned toward NC, TAB receives the strobe signal $S_2$. The microswitch $MS_1$ provided for the purpose of sensing arrival of the copy paper is now in the contact site NC because of absence of the copy paper.

When the instruction SSR is fetched, it sets up a complex instruction together with the next succeeding instruction TR0 to enable again jump to the sub-routine page $P_2$. The designation is changed into the 0th step of page $P_2$ in accordance with the codes $I_8$–$I_1$. The instruction LAX is fetched. This leads that the accumulator A assumes "0000" and extracts the next instruction EXC. EXC is executed to exchange the contents of the accumulator $A_1$–$A_4$ for the contents of the RAM 50 (the 14th step of the 1st block). The codes $I_1$, $I_2$ and the address counters $BU_1$ and $BU_2$ are inputted into the counter BU after passing past a non-coincidence circuit. Modification is performed as to the designation associated with the addressed RAM block. Since $I_2=I_1=$"1" for the RAM block, the counter BU is "10" to designate the 2nd block. At this time, the address (10) of the RAM 50 shown in FIG. 12 is selected. After executing the above discussed instruction, LAX is fetched so that the accumulator A is "0000". The next succeeding instruction EXC modifies the contents of the 14th step of the 2nd block of the RAM 50 into "0000" and the address counter BU ito "01" designating the 1st block.

When the instruction LAX of the 4th step of the page $P_2$ (See FIG. 26), the accumulator A receives "0011" or "3 (decimal)", the instruction TTAB is outputted. TTAB skips the next instruction if the input port TAB is "1". Therefore, the input port TAB receives the strobe signal $S_2$ to confirm the operating state of the microswitch $MS_1$ since the microswitch $MS_1$ is inclined to NC. Because of the input terminal TAB being "1", the next instruction TR0 is skipped. ADD 11 of the 7th step of the page $P_2$ is executed. ADD performs binary addition of data of the accumulator and data of the addressed RAM, the results of the addition being loaded into the accumulator A. In addition, $ADD_1$ skips the next step instruction if a carry in the results from the adder FA is "0".

The input terminal a of the adder FA receives the contents of the accumulator $A_1$–$A_4$ with the other terminal b thereof receiving the output data $M_{10}$–$M_{40}$ of the RAM 50, thereby executing addition. The flip-flop C is reset. Since the output data $M_{10}$–$M_{40}$ is "0000", the outputs from the adder FA are "0011" and the carry output is "0". The outputs "0011" are transferred into the accumulator A.

EXC of the 9th step is executed. The contents of the accumulator A are stored in the address (9) of the 14th step, the 1st block of the RAM 50. Since the codes $I_2$ and $I_1$ are "00", the contents of the counter BU remain "10". Then, the instruction TR0 of the 10th step is executed. LAX is executed after reverting to the 4th step of the same page. The accumulator A is "0011" so that the next instruction TTAB is executed to confirm again the microswitch $MS_1$. ADD 11 on the 7th step is derived. Addition is carried out between "0011" stored on the address (9) of the RAM 50 and "0011" of the accumulator A, the results thereof ("0110") being loaded into the accumulator A. The instruction EXC of the 9th step permits the contents of the accumulator A to be loaded into the address (9) of the RAM 50.

At the moment where the instruction ADD11 on the 7th step is fetched, a carry "1" is developed under the condition the contents of the adder $FA_1$—$FA_4$ are over 15. The next instruction TR0 is fetched. When jumping into the 32nd step, RSC is fetched to reset the flip-flop C. If RTN is fetched to return to the main routine, the instruction on the 38th step of the page $P_{13}$ is fetched.

In this manner, addition is carried out many times until the adder FA outputs a carry "1", for the purpose of confirming the strobe signal "1" applied to the input terminal TAB. In other words, this makes sure confirmation as to the operating state of the microswitch $MS_1$. In the given embodiment, the operating state of the microswitch $MS_1$ is sensed six times. The same confirmation procedure is performed as to the remaining microswitches $MS_2$–$MS_8$.

In the foregoing description, the microswitch $MS_1$ is judged as "NO" and judgement is shifted into the second microswitch $MS_2$. In the event that the microswitches $MS_1$ and $MS_2$ are judged as "YES", the jam state JAM is determined. The microswitch $MS_2$ is to detect removal of the copy paper 13. But, it does not see such removal at this moment and thus inclines to NC. The strobe signal $S_3$ is outputted and transmitted into the input port TAB. To this end confirmation is repeated as to the operating state of the microswitch $MS_2$. Accordingly, the microswitch $MS_2$ is judged as "NO". Subsequently, the microswitch $MS_8$ is subjected to such judgement. The microswitch $MS_8$ is adapted to sense the tray 17 in the fixing station and more particularly the same raised when power switch is thrown. The judgment procedure continues working as far as an answer "NO" is given. If "YES" is given, CSSR is judged, CSSR being a contact placed into NO site as shown in FIG. 37 when the associated relay CSSR is ON in exchanging the master paper 3. In this case the relay CSSR is not inclined to NO site and thus judged as "NO". When CSSR is ON, the control element 30 outputs control signals effective to turn ON a power relay PR. However, these signals are not developed at this time. For, as shown in FIG. 15, TRI is fetched from the 52nd step of the page P13 to attain subroutine jump. When LB is derived from the 53rd step of the page $P_0$, the 13rd step, the 0th block of the RAM 50 is designated, namely, (4) in FIG. 12. When fetching SM, the 2nd bit of 4 bits in the designation (4) is set. The operating states of respective loads are stored on the steps 12 to 15 of the 0th block of the RAM 50 as shown in FIG. 35. Therefore, the power relay PR in its ON state permits "1" to be stored on the 2nd bit of the designation (4) of the RAM 50.

When RTN is fetched at the sub-routine page $P_0$ the main-routine is coming back. The test judge is again performed and, when NO is given, judgement is shifted into WTL. When the fixing station 16 is heated up to a sufficiently high temperature, WTL permits the signal "1" from the WTL level control circuit 39 to be supplied to the input port $KN_1$ of the control element 30. If WTL judgement gives answer "YES", the ready lamp is turned OFF and the drum feed clutch DFC is turned ON, conversely. If "NO" is answered, the heating lamp relay HLR is turned ON. In case where WTL is judged as "NO", the 0th bit of the address (8), the 0th and 1st bits of the address (12) contain "1", "1", and "0", respectively. Referring to FIG. 15, when WTL is judged as "NO", the main-routine is returned so that LB of the 59th step of the page $P_{13}$ is fetched from the ROM 41 to designate the address (12) of the RAM 50 as shown in FIG. 12. SM permits the 0th bit of the address (12) to contain "1". Subsequent to this, in response to the complex instruction SSR/TR0 P12 is jumped to fetch the 0th step instruction $TR_1$ to enable sub-routine jump. The thus jumped instruction LB indicates the address (12) of the RAM 50 and RSM resets the 1st bit of the address (12) which in turn stores "0". The next instruction LB designates the address (8). The 0th bit of the address (8) is "1" in response to SM and the drum feed clutch DFC is placed into the ON state. After that, $TR_1$ is fetched so that the contents (see FIG. 35) of the addresses (16), (4), (8) and (12) of the 0th block of the RAM 50 are loaded into the register $W_1$–$W_5$. This implies that $TR_1$ permits jump into $P_1$ and SSR/TR0 permit jump into $P_2$. At this time NPR is fetched to reset the flip flop NP. The contents of the register W are not developed to prohibit the development as the control signals. After the control signals from the register W shift the contents of the RAM 50 into the register W, the flip flop NP is set so that the above discussed signals are derived in parallel. If the flip flop NP is reset, the control signals are not outputted for an extremely short period of time.

To shift the contents of the RAM 50 into the register W, NPR and then LB are sequentially fetched to designate the address (16) of the 0th block of the RAM 50. In reply to TM the 1st bit of the designation (16) stores whether CSSR is set. Since CSSR is now in "0" state, TR0 is fetched to allow jump within the same page and to fetch WIR. WIR inputs "0" into W of the register W to effect one-position right shift. On the contrary, $W_1S$ inputs "1" into the register $W_1$ to effect one-position right shift. When WIR is fetched in this manner, "0" is supplied to the register stage $W_1$ to effect right shift. Afterward, TM is outputted to extract the 2nd bit of the designation (16) of the RAM 50 and, if this is "1", the next instruction is skipped. The 2nd bit of the designation (16) stores CSSR in the reset state. Of course, the output is "0" which is supplied to the register $W_1$ to effect right shift.

In the above mentioned manner, the contents of the RAM 50 are shifted into the register $W_1$–$W_{15}$. For example, when 2NCB is fetched, the counter BL is incremented to bear "1101". That is, the designation (4) of the RAM 50 is assigned. This follows that the contents of the designation (4) are transferred into the register $W_1$–$W_{15}$. The 2nd bit of the designation (4) stores the power relay PR and hence provides "1" for the register W. When the contents of the RAM are completely transmitted into the register $W_1$–$W_{15}$, NPS is fetched to place the flip flop NP into the set state and derive the contents of the register $W_1$–$W_{15}$ as control signals. In this instance the drum feed clutch DFC, the power relay PR and the heating lamp relay HLR are all in the ON state so that the drum 1 rotates and the lamps $HL_2$, $HL_3$ and $HL_1$ are turned on to increase the temperature at the fixing station. RTN enables main-routine jump. Revolution of the drum sets up the initial state of the copying machine. Therefore, if the machine is in the initial state and WTL is "YES", the print ready condition is informed. Upon depression of the print switch PSW the copy cycle starts working as shown by a flow chart of FIG. 29. A flip flop D is reset, which is located within the RAM 50 as shown in FIG. 36. Briefly speaking, all the flip flops as shown in FIG. 36 are in the reset state. After resetting the D flip flop, the wait time level WTL is judged. If the desired temperature is exceeded, "YES" is given to turn off the heating lamp relay HLR to determine the microswitch $MS_4$. If not, the three heating lamps $HL_1$–$HL_3$ continue operating to increase the temperature.

The function of the microswitch $MS_4$ is to sense the initial stop position of the original table 8 of FIG. 1 and thus gives "YES" when the original table is in its initial position. An original table return solenoid TRS is turned OFF to judge the microswitch $MS_7$. The function of TRS is to restore the original table 8 to its home position, but the function of TFC is to advance the same in the forward direction.

The microswitch $MS_7$ detects arrival of a new master paper 3 for exchange of the master paper. In FIG. 37, this inclines to NC and, if "NO" is judged, a master paper stopper solenoid MSS is turned OFF. After that, the slip roller jam SRJ is judged. As discussed with respect to FIG. 1, SRJ detects the roller 23 and provides its results for the input port KF of the control element 30 via the slip roller jam detector 40. Therefore, in this case "NO" is judged and judgement is effected on the synchronizing signals PB. To attain the judgment as to the synchronizing signals PB, $TR_1$ on $P_{12}$ is fetched to effect $P_0$ sub-routine jump and $P_1$ jump. LAX is fetched from the 0th step, $P_1$ to change the accumulator A into "0000". Then, TB is developed. When the synchronizing signal input port $\beta$ is "1", the next instruction is skipped by TB. Similarly, TA skips the next instruction when the synchronizing signal input port $\alpha$ is "1". The synchronizing signal PA applied to the input port $\alpha$ sets a flip flop $\alpha$F and Ta resets the same. As far as TB is fetched and the synchronizing signals PB are applied to the input $\beta$ of the control element 30, ADX is fetched. If not, RTN is fetched for return to the main-routine. The fetching of RTN shows that the drum 1 is not in its initial position. WTL is again judged. When the synchronizing signals PB are then applied, PB judge answers "YES". During the PB judge ADX is fetched so that the adder FA effects addition of "0000" of the accumulator A and "0101" of the codes $I_4$–$I_1$. The results being placed into the accumulator A. The adder FA does not develop a carry and the next $RTN_1$ is skipped and TB is again fetched. ADX is again executed to effect addition of "0101" of the accumulator A and "0101" of $I_4$–$I_1$. The resulting "1010" is placed into the accumulator A. The above operation is repeated. If the adder FA outputs a carry "1", $RTN_1$ is fetched for return to the main-routine such that LB is fetched from the 12th step of $P_{12}$. If TA is developed and the flip flop $\alpha$F is "1", that is, if the synchronizing signals PA is inputted, $TR_1$ is executed to effect jump into the sub-routine $P_0$ and to judge WTL.

In a flow chart of FIG. 29, PA is judged when "YES" is answered. When PB is "YES" and the synchronizing signals PB-1 are applied to the control element 30. Twice detection of PA (Pa-11 and Pa-0 as shown in FIG. 4) represents that the drum 1 is exactly in the original state. The revolution of the drum is stopped. In other words, PB is "YES" and the synchronizing signal PA-11 is supplied to the control element. PA is judged as "YES" and judgement is shifted into the flip flop D. In the event that PA is "NO", the wait time level WTL is again judged. In case where PA is "YES", the D flip flop is judged. Since the D flip flop is not in the set state ("1"), "NO" is answered. In this instance the 3rd bit of the designation (0) of the RAM 50 as shown in FIG. 36 sotres "1" to force the D flip flop into the set state. After executing confirmation as to WTL, the input state of PA-0 is confirmed. When the synchronizing signal PA-0 is inputted to the $\alpha$ terminal of the control element 30, PS is judged as "YES". Thereafter, the 3rd bit of the designation of the RAM receives and stores "0". The A flip flop is judged so that "NO" is given because the A flip flop is in the reset state. The circumstance may be applicable to a $\beta$ flip flop. For CSSR "NO" is judged.

The above operations turn off the high voltage relay THVR and the drum feed clutch DFC. As shown in FIG. 1, the relay THVR in the ON condition operates the chargers 12 and 18. The relay THVR is in the OFF state after throw of the power switch MSW, whereas the feed clutch DFC is in the ON state to prohibit rotation of the drum 1. Namely, the drum 1 is stopped because of the relationship between the synchronizing signals PA and PB applied to the terminals $\alpha$ and $\beta$ of the control element 30.

As stated above, the copying machine is placed into its initial state. Thereafter, the instructions are sequentially fetched from the ROM 41 to provide a control for the machine.

Figure 30:
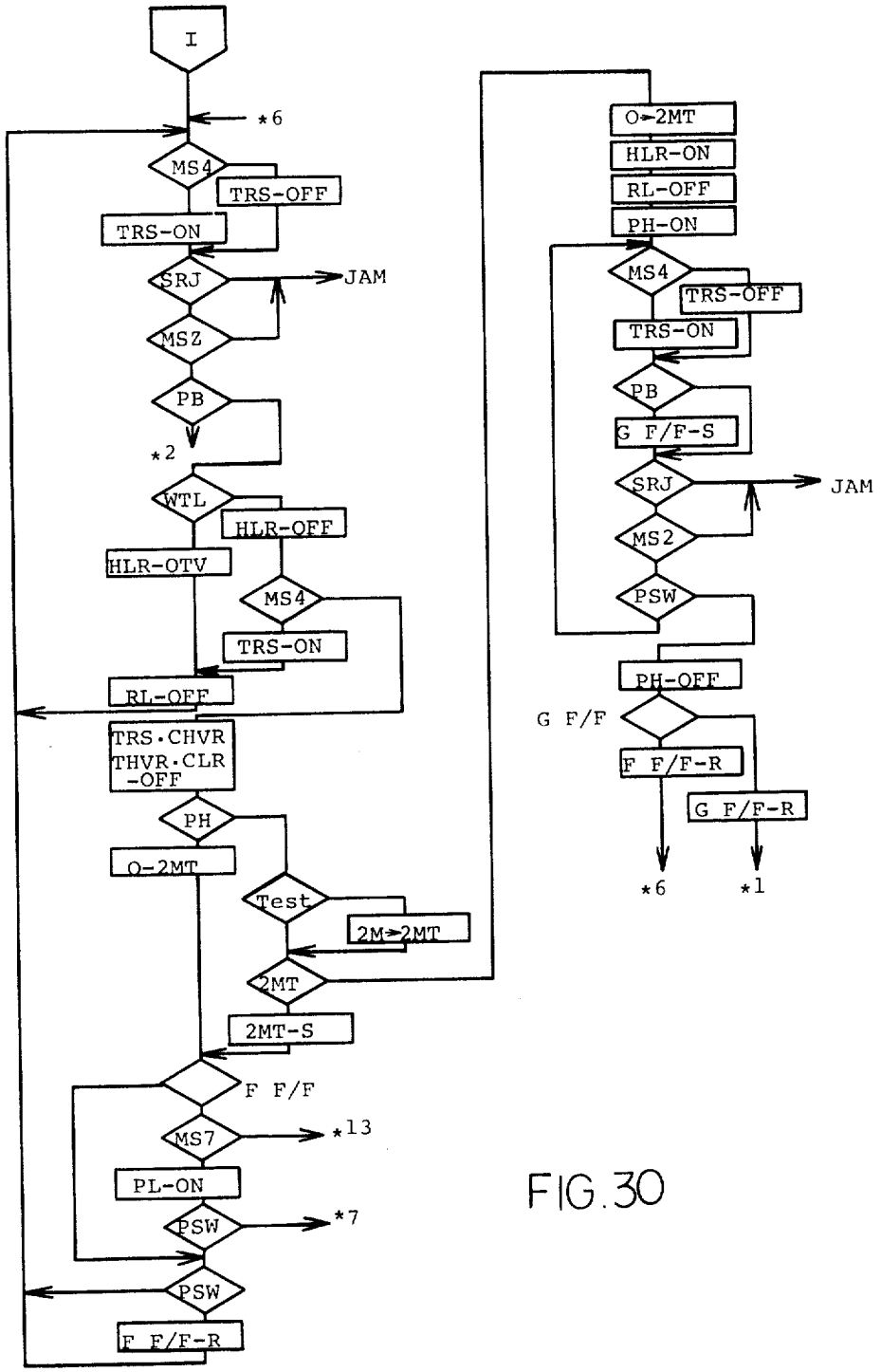

Referring to a flow chart of FIG. 30, the microswitch $MS_4$ is judged whereby the strobe signal $S_1$ is outputted and then applied to the input port $KN_2$. Thus, the microswitch $MS_4$ is judged "YES". For this reason the original table return solenoid TRS is rendered OFF (previously OFF) to judge the slip roller jam SRJ and the microswitch $MS_2$. Anyway these judges are concluded as "NO". However, a jam is evaluated because the microswitch $MS_2$ is in such state.

While PB is judged, the synchronizing signal PB is of course impressed on the input port $\beta$ of the control element 30 because the rotary drum 1 is in its initial state. The conclusion is that "YES" is answered. If "NO" is answered during PB judge, the drum feed clutch DFC 13 placed into the ON state to seek again the initial state of the rotary drum 1.

After that, WTL is judged wherein "YES" is given when the temperature of the fixing station 16 is above a predetermined one. If "YES" is not given, the lamp relay HLR is turned ON and the ready lamp RL is turned OFF to repeat the above procedure. In case where the temperature of the fixing station 16 is above the predetermined one, the signal "1" from the wait time level detector circuit 39 is applied to the input port KN so that WTL is judged as "YES" to turn OFF the heating lamp relay HLR. Then, the microswitch $MS_4$ is judged as "yes" to turn OFF TRS, CHVR and CLR. The last named CLR is a relay for an illuminating lamp wherein a lamp CL (see FIG. 2) is turned on to illuminate the original table 8 when the relay is in the ON state.

Subsequently, the preheating PH is judged. The preheating means that the fixing station 16 is settled into a relatively low temperature state when power throw. In judging PH, the instruction LB at the 12th step of the page $P_{11}$ is fetched so that the address counter BL of the RAM 50 is "1100" and BU is "01" to thereby designate (17). In reply to the instruction DECB the address counter BU is decremented into "1011". This follows that the strobe signal is derived from the terminal $S_5$ and supplied via a diode to the input terminal AK of the control element 30. $TR_1$ effects jump into the sub-routine $P_0$ and $TR_1$ is again fetched at the jumped designation to effect jump into the sub-routine $P_1$. Again, the SSR/TR0 complex instruction effects jump into $P_3$ to fetch LAX at the 45th step as shown in FIG. 25. LAX results in the accumulator A bearing "0000" which is added to "0011" of the codes $I_4$-$I_1$ in response to the next ADX, the results being returned back to the accumulator A. Since the adder FA provides no carry, ADX permits the next instruction to be skipped with executing TAK. Since the strobe signal from the terminal $S_5$ is applied via a diode to the input terminal AK, the next instruction is skipped. This means that PH is judged as "YES".

When in reply to ADX the adder FA provides a carry "1". $RTN_1$ is fetched for return to the main-routine so that PH is judged as "YES" and $TR_1$ is fetched for the test judge.

As illustrated in FIG. 37, a diode DPH is connected to effect the preheating in a few minutes, for example, 2 minutes after judging PH. Power supply to the heating lamp HL is controlled to save power energy. A lamp PH is turned ON indicative of the preheating state.

If the diode DPH as shown in FIG. 37 is removed, the preheating state is placed after 2 minutes has run. In other words, PH jump is completed as "NO".

As far as PH is judged as "YES", test judge is concluded as "NO" to set up a two-minute timer circuit which is normally disposed within the control element 30. The instructions are executed immediately after fetching. A duration of time needed for fetching the next succeeding instructions extends for about 10μ seconds.

The two-minute timer is judged and "YES" is answered after expiration of two minutes. If print is carried out immediately after power throw, the preheating will work automatically in two minutes. At this time the 2 minute timer is reset so that the heating lamp relay HLR and the preheating PH are ON and the ready lamp is OFF. Because of the heating lamp relay HLR in the ON state the heating lamp $HL_1$ serving as a standby lamp is turned ON. Meanwhile, in response to the preheating $HL_1$ in the ON state the heating lamps $HL_2$ and $HL_3$ are broken with the WTL circuit 39. The contents of the designations (16), (4), (8) and (12) of the RAM 50 shown in FIG. 35 are transferred into the register $W_1$-$W_{15}$. The register stage $W_2$ provides control signals to rurn ON a display lamp indicating the preheating state, etc., by the driver circuit 32. The control signals from the register $W_2$ inputs the WTL circuit 39 via the driver circuit 32, etc., to control the heating lamps $HL_2$ and $HL_3$.

Next, the microswitch $MS_4$ is judged as "YES". Since the drum 1 is in the initial state, PB is judged as "YES" and the slip roller jam SRJ is subjected to judgement. The microswitch $MS_2$ and the print switch PSW are judged as "NO". In summary, the machine is settled in the pre-heating state. The print switch PSW serves also to clean the pre-heating state and inform the operator of the pre-heating state when being depressed. When PSW is depressed in the ready state, the print cycle is entered.

In other words, when the print switch PSW is operated in the pre-heating state, PSW is judged as "YES" to turn OFF the pre-heating and extinguish the lamp indicative of the pre-heating and actuate the heating lamps $HL_2$ and $HL_3$. The G flip-flop is judged to set the F flip-flop so that the copying machine restores to its initial state.

The 2-minute timer begins working if the 2-minute timer is judged as "NO" before starting the pre-heating. The F flip-flop is judged as "YES" after the pre-heating state is cancelled. If "NO" is answered, the microswitch $MS_7$ is examined to turn ON the ready lamp RL to effect examination of the print switch PSW. When examining the print switch PSW, the strobe signal is derived from the terminal $S_3$ for confirmation of the ON and OFF states. When the print switch PSW is judged as "NO", the F flip-flop is reset to repeat again the same operation. This implies the ready state which is visually displayed on the ready lamp RL. The reason why the print switch PSW is examined twice under the circumstances is that the print switch PSW serves both as a pre-heating cancelling switch and copy cycle executing switch, and thus distinction between both is needed. That is, after cancelling the pre-heating, the F flip-flop is set not to judge PSW as "YES". PSW is, therefore, not judged through examination of the F flip-flop. The copy cycle is not entered as soon as the print switch PSW is depressed during the pre-heating state to cancel the pre-heating. If the copy cycle is entered and the temperature of the fixing station 16 is above the predetermined value, the ready lamp RL is turned ON and no problem is arisen. If the same circumstances are not viewed, WTL is judged as "NO" to turn OFF the ready lamp R. The confirmation signal as to PSW is not outputted and the copy cycle is not entered even when the print switch PSW.

The copy cycle begins working the the following manner.

The ready lamp RL is turned ON and, when the print switch PSW is depressed, PSW is judged as "YES" as shown in a flow chart of FIG. 30, thereby entering into the copy cycle. This follows that the control element 30 provides control signals to turn OFF the high voltage generation relay THUR. The 2-minute timer is reset.

For example, in FIG. 18, the instruction $TR_1$ at the 28th step enables jump into the sub-routine $P_0$ to examine PSW in the similar way as discussed above. At this time, "YES" is answered because of the print switch PSW depressed. Thus, TRO at the 29th step of the page $P_{10}$ is skipped to execute the next instruction LAX. LAX causes the accumulator A to accept the instruction codes $I_4$-$I_1$, the accumulator A bearing "0010". ATF functions to shift the contents of the accumulator A into the register F which is arranged to provide the control signals. To this end, the register F bears "0010." The contents of the register F are provided as the control signals for the control element 30 thereby turning ON the relay THUR via the driver. Therefore, the contact THUR-a is closed to excite the charger 12 and the discharger or charge remover 18. The contents of the respective register stages $F_1$, $F_2$, $F_3$ and $F_4$ control the high voltage generating relay CHUR, the just mentioned relay THUR, the relay CLR for a lighting lamp CL and the original table return solenoid TRS, respectively. "1" means ON and "0" means OFF.

The charging procudure begins in this manner and $TR_1$ is fetched to reset the 2-minute timer. RTN is called to return the subroutine to the main-routine to fetch SSR at the 33rd step of the $P_{10}$. SSR and TRO together enable jump into the 0th step, the page $P_9$ (See FIG. 19) to examine the microswitch $MS_1$ at the 0th step. At the present stage, the microswitch $MS_1$ concludes as "NO" because of an absence of the copy receiving paper 13. Afterword, LB is fetched so that the address (4) of the RAM 50 as illustrated in FIG. 12 is assigned by the counters BL and BU. The 3rd bit of that position (4) is set as "1" in reply to the instruction SM. This implies that the paper feeding solenoid PFS is in the ON state. The sub-routine $P_0$ (See FIG. 28) is jumped by $TR_1$ to fetch at the 32nd step. LB designates (12) of the RAM 50. The 1st bit of the designation (12)

stores "0" in accordance with RSM. The ready lamp RL is turned OFF.

Figure 38A:
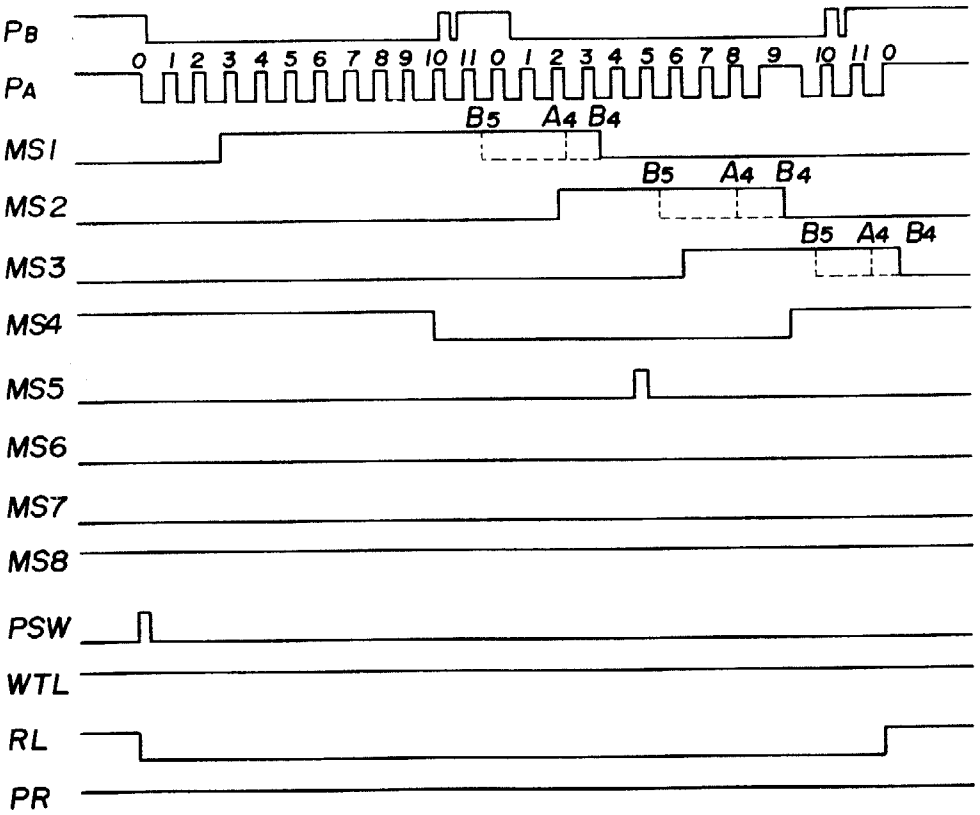
FIGS. 38(*a*) and 38(*b*) are time charts showing the operating states of the portions to be controlled.
Figure 38B:
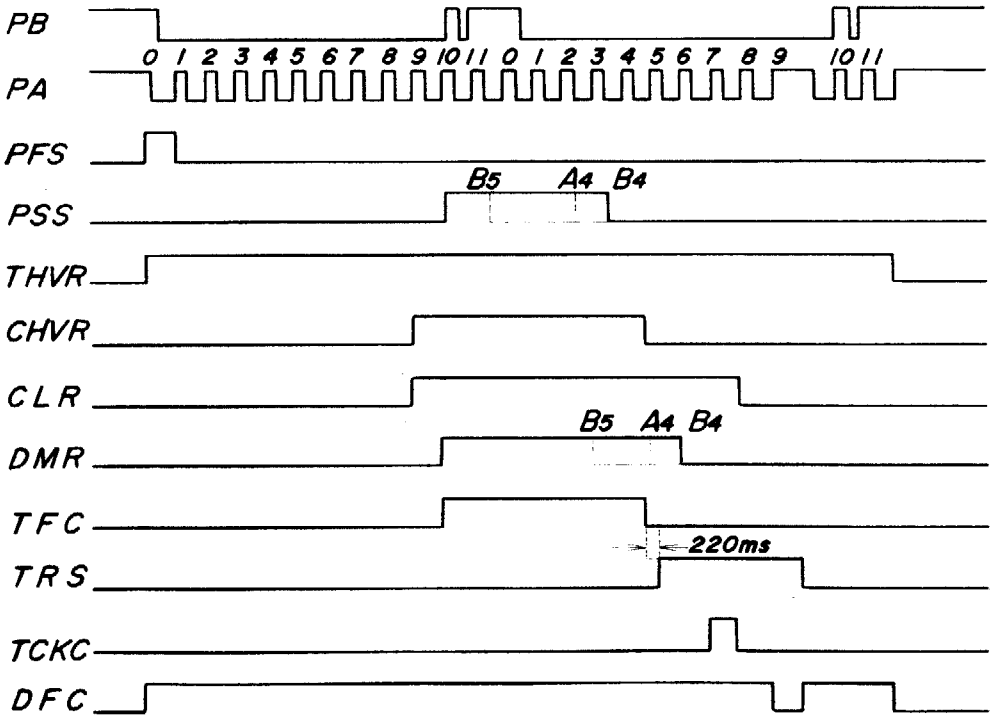

In addition, the position (8) of the RAM 50 is designated by LB and the 0th bit of that position is set as "1" by SM. Subsequent to this, $TR_1$ enables jump into the sub-routine $P_1$ and jump into $P_2$ in accordance with SSR/TRO complexed instruction. For this reason, NPR is fetched at the 42nd step of $P_2$ (See FIG. 26) so that the flip-flop NP is reset and the register $W_1$-$W_{15}$ ceases temporarily providing the control signals. As noted earlier, the contents of the RAM 50 shown in FIG. 35 are shifted into the register $W_1$-$W_{15}$. As soon as the contents of the RAM 50 have been completely transferred into the register $W_1$-$W_{15}$ pursuant to the next succeeding instruction, NPS is fetched to set the flip-flop NP. The contents of the register $W_1$-$W_{15}$ are outputted as the control signals. Since a duration of period from prohibition against delivering the control signals to cancellation of such prohibition is very short, such duration can be disregarded. The control signals operate the paper feeding solenoid PFS, the drum feeding clutch DFC and the high voltage generating relay THUR. The feeding roller 20 introduces the copy sheet 13 into the interior of the machine. Meanwhile, the rotary drum 1 begins rotating. These events in the copy cycle are illustrated in FIGS. 38(*a*) and 38(*b*). Subsequently, referring to FIG. 31(*a*), the microswitch $MS_4$ is examined and determined as "YES" to turn OFF the table return solenoid TRS. Then, the input condition of the synchronizing signal PA is examined. The operating state of the microswitch $MS_4$ is again confirmed to turn OFF TRS. Examination is applied to SRJ, CSSR and $MS_2$. Anyway "NO" is answered, the input condition of the synchronizing signal PA is confirmed. When examining the synchronizing signal PA, PA is concluded as "YES" because of "1" applied to the input terminal $\alpha$. If the synchronizing signal PA-1 is not inputted, the same cycle is repeated to examine again the microswitch $MS_4$ until the synchronizing PA-1 is received. After confirming receipt of the synchronizing signal PA-1, the solenoid PFS is OFF to supply a memory M with "1". M+1 remembers that "1" is applied to the RAM 50 and "1" is applied out of the synchronizing signal PA. Upon application of the synchronizing signal PA-2, operation M+1 is executed so that the memory stores "2". After completing M+1, it is examined whether M=6. When the contents of the memory are 6, "YES" is given. In this case M=1 and "NO" is answered since the synchronizing signal PA-1, in case of M=7 and M=8, "NO" is determined to thereby examine the microswitch $MS_4$. The above discussed procedure is performed each time the synchronizing signal is applied. If "YES" is given during examination as to whether M=8, the next stage of the procedure is in effect.

With reference to the instructions, the above procedure will be explained in detail.

At $P_9$ (See FIG. 19), $TR_1$ is fetched at the 17th step to judge PA. In this case, $TR_1$ enables jump into $P_0$ (See FIG. 28) to confirm the input condition of the synchronizing signal to allow the $TR_1$ to be fetched at that jumped position. To this end $P_1$ (See FIG. 27) is jumped to fetch the instruction TA at the 48th step. TA confirms whether the synchronizing signal PA is applied to the input terminal $\alpha$. For example, in the absence of the signal at the input terminal $\alpha$, RTN is fetched. PA is judged as "NO" to effect return to the main routine and to examine the microswitch $MS_4$. If the synchronizing signal PA is applied to the input terminal $\alpha$ in TA, LAX is executed rather than the next succeeding instruction. Therefore, the contents of the accumulator A are "0000" in response to LAX and the adder FA effects addition of "0000" of the accumulator A and "0001" of the codes $I_4$-$I_1$, the results of addition being loaded into the accumulator. At this time, the accumulator A bears "0001". Since the adder FA does not output carry "1" by execution of ADX, the next instruction is skipped and $TR_0$ is executed to perform again ADX. By repetition of the above operation, the adder FA provides carry "1" to fetch the instruction $RTN_1$. As a result, PA is judged as "YES".

If $RTN_1$ is fetched to effect return to the main routine, LB is fetched at the 19th step as shown in FIG. 19. LB designates the position (4) as shown by FIG. 12 by the address counters BL and BU of the RAM 50. $TR_1$ effects jump into $P_0$ and $TR_1$ (the 30th step) and the thus jumped position is fetched to effect again jump into $P_1$. TM (the 44th step) is fetched and executed. In FIG. 35, the 3rd bit of the designation (4) stores information concerning the paper feeding solenoid PFS, and thus stores "1". Since the 3rd bit is "1", the next instruction RTN (the 45th step ) is skipped to execute the next instruction RSM. Consequently, the 3rd bit of the designation (4) is reset and thus "0". The contents of the RAM 50 are shifted into the register $W_1$-$W_{15}$ of which the contents are provided as the control signals. In this case, the solenoid PFS is OFF via the driver 32, M+1 is executed. At this time, the instruction $TR_1$ (the 21st step of $P_9$) is fetched. As a result, LB (the 2nd step of $P_0$) is fetched to designate (3) of the RAM 50, SSR/$TR_0$ instruction allows jump into the 51st step of $P_3$, LAX forces the contents of the accumulator A into "0001" to fetch the next instruction LAX. In case where LAX is consequently developed, the next one is skipped. ADD11 carries out addition of the contents of the accumulator A and the designation (3) of the addressed RAM 50. The results are transferred into the accumulator A, namely, the accumulator A assumes "0001". In case where the adder FA has no carry "0", the next instruction is skipped to execute the next instruction. EXC is executed so that "0001" of the accumulator A is transferred into the designation (3) at the RAM 50 addressed. The contents of the designation (3) are "0001". Thereafter, RTN is fetched for return to the main-routine, thereby fetching the 22nd step of $P_9$, that is, LAX. The RAM 50 stores the first synchronizing signal PA-1.

Figure 31A:
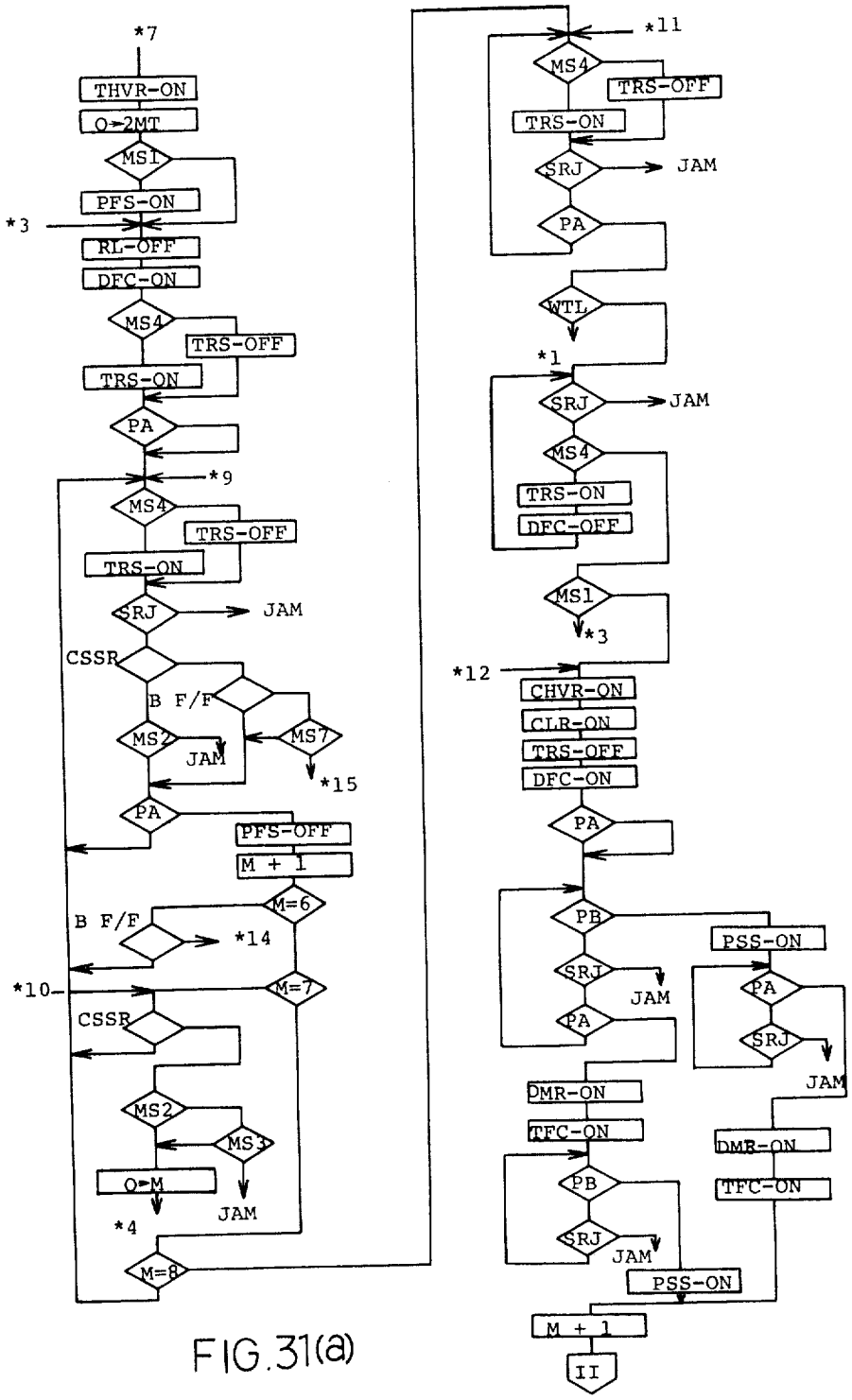
Figure 31B:
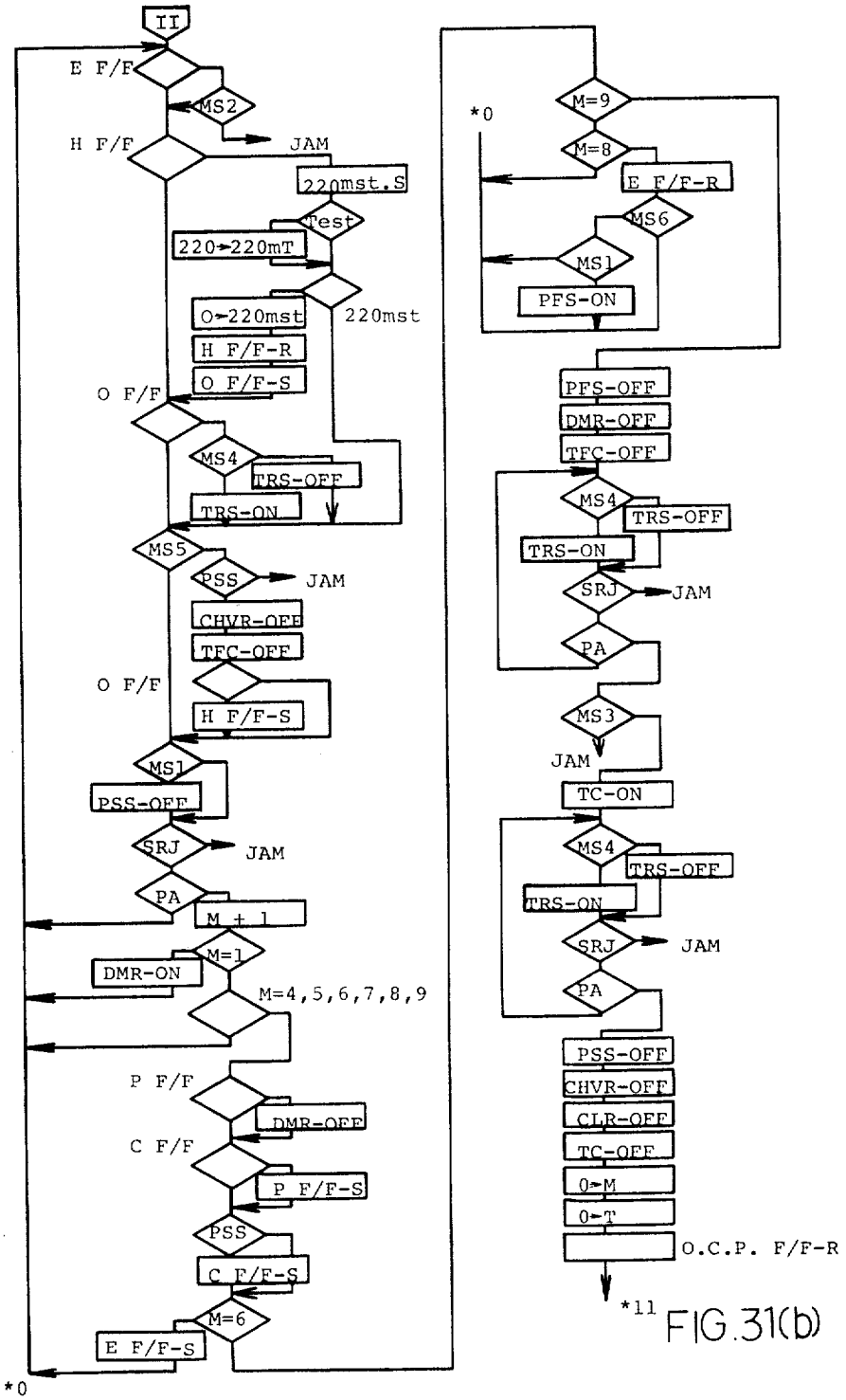

Examination as to whether M=6 is effected. LAX carries out comparison between the contents of the accumulator A and the contents of the designation (3) of the RAM 50 presently addressed. In this instance, answer is "NO". The same answer is resulted for M=7 and M=8. As shown in FIG. 31(*a*), the microswitch $MS_4$ is examined.

After repeating the above operation, if the drum 1 rotates and the 6th of the synchronizing signals obtained from such rotation is applied to the input terminal $\alpha$ of the control element 30, the contents of the designation (6) of the RAM 50 assume "6" or "0110". For judgement as to whether M=6, "YES" is judged, followed by examining the B flip-flop. The B flip-flop concerns exchange of the light-sensitive master paper 3. Such judgement is of course concluded as "NO". For this reason, the operation is repeated. The 7th pulse of the synchronizing pulses PA is inputted and stored in the designation (3) of the RAM 50. The contents of the designation are "0111". For M=6, judgement "NO" is answered, but for M=7, judgement "YES" is answered. Judgement as to CSSR provides answer "NO".

It will be easily understood that when the 8th pulse PA-8 of the synchronizing signals PA is applied, judgement for M=8 is concluded as "YES". The contents of the designation (3) of the RAM 50 are "0000". When confirming the microswitch $MS_4$, it is inclined to NO site to thereby sense the original table 8 in its initial state. Since examination for $MS_4$ is concluded as "YES", the original table return solenoid TRS is turned OFF. The slip roller jam $SRJ_1$ is judged as "NO" because of the absence of the copy paper 13. Therefore, PA is examined. PA examination is carried out on the 9th pulse PA-9 of the synchronizing signals PA and, when that signal PA-9 is applied to the input terminal $\alpha$, "YES" is answered. WTL is judged when the temperature of the fixing station has reached the predetermined one, SRJ and $MS_4$ are judged. Then, the microswitch $MS_1$ is judged. Under the circumstances the microswitch $MS_1$ does detect the copy sheet 13 and inclines to NO site. In conclusion, due to the solenoid PFS in the ON state, one copy sheet 13 is conveyed into the machine by the feeding roller 20.

The copy paper 13 is temporarily clutched by the paper stopper PS and at this time the microswitch $MS_1$ detects arrival of the paper. When confirming the operating state of the microswitch $MS_1$, the strobe signal is outputted from the terminal $S_2$ and transferred via the NO site of $MS_1$ and the diode into the terminal $KN_2$. This confirms the microswitch $MS_1$ at the NO site and provides answer "YES". As a result, the high voltage relay CHUR and the lamp relay CLR are turned ON. TRS remains in the OFF state and DFC remains in the ON state. The output signals from the register $F_1$–$F_4$ are control signals to turn ON CHUR and CLR. In other words, "1" is inputted to the register stages $F_1$ and $F_3$. The contents of the accumulator A are changed into "0101" in response to the instruction LAX and then transferred into the register F in response to ATF. Since THUR has been previously in the ON state, the contents of the accumulator A may be "0111".

As noted earlier, the lamp CL is turned ON and the charger 6 is excited to provide uniform charge for the master paper 3 when the rotary drum 1 rotates and the 9th pulse PA-9 of the synchronizing signal PA is developed as shown in the time charts of FIGS. 38(*a*) and 38(*b*).

Subsequently, PA is judged and then PB is judged. In response to receipt of the synchronizing signal PB, the copy sheet 13 is conveyed in synchronization with rotation of the rotary drum 1. At a point in time when the synchronizing signal PB-2 is inputted, the stopper solenoid PSS is turned ON to release the stopping of the copy sheet 13. The 10th pulse signal of the synchronizing pulses PA drives the development station and the original table S. Relative alignment of the slits Pa-10 and Pb-2 determines whether both synchronizing signals PB-2 and PA-10 are simultaneously developed or which one of both is developed earlier.

In the case where the synchronizing signals PB-w are developed earlier during PB judgement, the stopper solenoid PSS is turned ON and PA continues to be examined until the synchronizing signals PA-10 are developed. When the synchronizing signals PA-10 are inputted, the development motor relay DMR and the original table feed clutch TRC are placed into the ON state. Conversely, if the synchronizing signals PA-10 are inputted, the development motor relay DMR and the original table feed clutch TRC are in the ON state. When applying PB-2, the solenoid PSS is turned ON. Therefore, as shown by the flow chart, the motor relays DMR and TFC are ON and PSS is ON to render the development 11 and the original table 8 operative. The copy sheet 13 is conveyed. In this case, the microswitch $MS_4$ is inclined to NC.

After execution of M+1, the designation (3) of the RAM 50 stores application of the synchronizing signals PA-10 and flip-flops E, H and O are judged. These flip-flops not in the set state are judged as "NO". The microswitch $MS_5$ is judged as "NO". The microswitch $MS_5$ is examined, which senses excess advance of the original table 8. At this time, microswitch $MS_5$ is concluded as "NO". Judgement is shifted into the microswitch $MS_1$. The microswitch $MS_1$ will be inclined to NC site when passing the trailing edge of the copy sheet 13. In this case, the microswitch $MS_1$ is not inclined to the NC site and judged as "YES". PA is examined to confirm the input conditions of the synchronizing signal PA-11. As far as the drum 1 rotates and synchronizing signal PA-11 is applied, PA is concluded as "YES" to effect M+1. According to M+1, the designation (3) of the RAM 50 stores addition of "1". Since when applying the synchronizing signal PA-10 M+1 is executed and the designation (3) of the RAM 50 stores "1", that designation (3) of the RAM 50 stores M+2 upon receipt of the synchronizing signal PA-11. Therefore, M=1 judgement is concluded as "NO" because the designation (3) of the RAM 50 stores M=2. M=4, 5, 6, 7, 8 and 9 are next examined. In these examination procedures, "NO" is given and the E flip-flop is judged. In this manner, M+1 is executed each time the synchronizing signals PA, which of the synchronizing signals is stored. In other words, the position of the rotary drum 1 is confirmed. As soon as the microswitch $MS_1$ detects the trailing edge of the copy sheet 13 and declines to the NC site, the stopper solenoid PSS is turned OFF and the next succeeding copy sheet 13 ceases going ahead at that position. In this case, the microswitch $MS_1$ is judged as "NO" to turn OFF PSS. In the time chart B5, A4 and B4 represent the size of the copy paper 13.

When the contents of the designation (3) of the RAM 50 are "0100" and the synchronizing signal PA-1 is inputed, the flip-flops P and C and the stopper solenoid PSS are judged. Referring to the time chart of FIG. 38(2), in case of $B_5$ size, the microswitch $MS_1$ is in the NC site prior to application of the 2nd synchronizing signal PA-1 and $MS_1$ is judged to turn OFF the stopper solenoid PSS. In case of size $A_4$ or $B_4$, the microswitch $MS_1$ detects the arrival of the copy paper 13. The stopper solenoid PSS remains in the ON state. Under the conditions that the synchronizing signal PA-1 is applied and M=4, PSS is concluded as "NO" for the copy sheets of $B_5$ size and "YES" for the copy sheets of $A_4$ and $B_4$. In the following the copy sheets of $B_5$ size will be discussed.

Therefore, the C flip-flop is set after examining PSS. In FIG. 36, the 2nd bit of the designation (2) of the RAM 50 stores "1". After judging M=6, M=9 and M=8, the E flip-flop is again judged.

The synchronizing signal PA-2 is applied and M+1 is executed durng PA examination. The designation (3) of the RAM 50 stores "0101". Because the C flip-flop is in the set state, the P flip-flop is set after judgement as to the C flip-flop. The E flip-flop is judged. When the synchronizing signal PA-3 is applied to the input terminal $\alpha$ of the control element 30 during PA examination, the designation (3) of the RAM 50 stores "0110".

After judging the P flip-flop, the development motor relay DMR is turned OFF. The development motor contained within the development station 11 is stopped dependent upon the size of the copy paper 13. For example, the development ceases working when M=8 or the synchronizing signal PA-5 is applied in case of $A_4$ size, and when the synchronizing signal PA-6 is applied in case of $B_4$ size.

During M=6 judgement the designation (3) of the RAM 50 stores "0110" and then the E flip-flop is set. The operating state of the microswitch $MS_2$ is confirmed after judging the E flip-flop. In this case, the microswitch $MS_2$ is inclined to the NO site because the copy paper 13 in contact with the master paper is removed therefrom. But if the microswitch $MS_2$ is inclined to the NC site, the copy paper 13 remains in close contact with the drum 1 to inform JAM. The following description concerns operation where "YES" is answered. PA is again judged. PA judgement is effected on the synchronizing signals PA-4 to execute M+1.

Since answer "NO" is given for judgements M=6, M=9 and M=8, the E flip-flop is again judged to sense the next synchronizing signal PA-5. $MS_5$ is turned ON if the original table 8 has overadvanced when confirming the operating state of the microswitch $MS_5$ prior to PA judgement. For this reason, the strobe signal is derived from the terminal $S_1$ and then supplied to the input terminal AK, thereby confirming the ON state of the microswitch $MS_5$. In judging PSS the high voltage relay CHUR and the original feed clutch TFC are turned OFF. After judging the O flip-flop the H flip-flop is set. The H and O flip-flops relate to a 220 ms timer to be described later. The charging operation of the charger 6 is stopped since the original table 8 is stopped and the charging relay CHUR is turned OFF due to the above discussed operation.

At the present stage, the microswitch $MS_1$ does not detect the introduction of the copy paper 13 and thus the copy paper stopper solenoid PSS is in the OFF state. Meanwhile, the microswitch $MS_2$ detects removal of the copy paper 13 and inclines to the NO site. But, the microswitch $MS_3$ does not detect the leaving copy sheet 13 and is positioned at the NC site. The microswitch $MS_4$ is positioned at the NC site because the original table 8 moves from its initial position due to the original feed clutch in the ON state. The microswitch $MS_5$ detects overadvanced original table 8 so that the original table feed clutch TFC is turned OFF to force the original table 8 and the charger 6 into the stop condition.

If application of the synchronizing signal PA-5 has not yet been confirmed, the E and H flip-flops are examined. The H flip-flop is in the set state to set the 220 msec timer. This 220 msec timer prohibits movement of the original table 8 for 220 msec, that is, a duration of period beginning with turning OFF of the original feed clutch TFC and ending at turning ON of the original table return solenoid. Otherwise, TRS will be turned ON immediately after the original table 8 stops moving, thereby damaging clutches, gears, etc. The above mentioned timer is not necessarily needed and is normally contained within the control element 30.

If the timer is set and the synchronizing signal PA-5 is not confirmed. The above operational cycle is repeated such that the original table return solenoid TRS is turned ON for return of the table after expiration of 220 msec. Then, the 220 msec timer is reset so that the H flip-flop is set and the O flip-flop is set. The O flip-flop is judged as "YES" to effect confirmation of one microswitch $MS_4$. The microswitch $MS_4$ is positioned in the NC site because the original table 8 is not in the initial state. The control element provides control signals effective to turn ON the original return solenoid TRS. In reply to the receipt of the synchronizing signal PA-5 the designation (3) of the RAM 50 assume "1000".

After "YES" is answered during M=8 judgement, the E flip-flop is placed into the reset state and the microswitch $MS_6$ is subjected to examination. The function of the microswitch $MS_6$ is to confirm the multi-copy dial which is in the OFF state (see FIG. 37) and are judged as "NO" in case of one copy. The E flip-flop is again judged. In case of multi-copy the above operation is repeated after the microswitch $MS_1$ is confirmed and the paper feed solenoid PFS is turned ON.

Upon receipt of the synchronizing signal PA-6, M+1 is executed so that the contents of the designation (3) assume "1001" (M=9). For this reason, the microswitch $MS_4$ is confirmed and the original return solenoid TRS is turned ON or OFF after M=9 is determined and PFS, DMR and TFC are turned OFF. In other words, if the original table 8 is returned to the home position, the microswitch $MS_4$ will sense this. This confirmation is accomplished by outputting the strobe signals from the terminal $S_1$, thereby turning OFF the original return solenoid TRS. Is confirmed whether the synchronizing signal PA-7 is applied. Thereafter, the mocroswitch $MS_3$ is judged. The microswitch $MS_3$ detects the leaving of the copy paper 13 carrying the toner image and is now in the NO site. Otherwise, conveyance of the copy paper 13 is evaluated as abnormal to warn jam. After confirming the operational state of the microswitch $MS_3$ a total counter TC is turned ON and one incremented. After sensing the microswitch $MS_4$ the synchronizing signal PA-8 is confirmed to turn OFF PSS, CHUR, CLR and TC. Simultaneously, the designation (3) of the RAM 50 assumes "0000" and the timer is OFF and the respective flip-flops O, C and P are reset.

The microswitch $MS_4$ is judged after completing the above operational sequence (see FIG. 31(*a*),*11). The operational state of the synchronizing signal PA-9 is confirmed to see the inputs from the WTL circuit. The microswitch $MS_4$ is again confirmed until it is switched to the NO site. At this moment the drum feed clutch DFC is turned OFF to prevent to rotary drum 1 from revolving. When the microswitch $MS_4$ is turned to the NO site, judgement is shifted into the microswitch $MS_1$. If it is desired to make multi-copies, the feeding paper solenoid PFS is turned ON to enter into the subsequent copy mode. When the microswitch $MS_1$ does not sense the arrival of the paper, the operation is executed to seek the original position of the rotary drum 1. As illustrated in FIG. 29, the ready lamp RL is turned OFF and the drum feed clutch DFC is turned ON. The rotary drum 1 rotates again. When entering into the multi-copy mode the microswitch $MS_4$ is inclined to the NO site and the original return solenoid is turned OFF to restore the original table 8 into the original position. PA is judged under the circumstances that the synchronizing signal PB (the slit Pb-2) is applied during PB judgement. Next, PB judge confirms the synchronizing signal PB-1 and the D flip-flop is placed into the set state when the synchronizing signal PA-11 is inputted. The D flip-flop is reset when the next synchronizing signal PA-0 is applied. The drum feed clutch DFC is OFF. In other words, the drum 1 is in the initial state (namely, stopped) as far as the synchronizing signals PA-11 and PA-0 are inputted. Subsequently, the ready state is reached to turn ON the ready lamp RL.

As discussed above, the copying machine of the present invention is controlled by the one-chip control element 30. Since according to the present invention the control element 30 provides the strobe signals to confirm the operational states of the respective microswitches together with the synchronizing signals PA and PB obtainable from the revolution of the drum 1, as viewed from FIG. 37, the number of the wires leading from the microswitches is considerably reduced.

In operation, when conveyance of the copy paper 13 is abnormal, the so called jam state is sensed by the slip roller jam SRJ or the respective microswitches to enter into jam cycle. The cycle is illustrated in FIG. 32.

Figure 32:
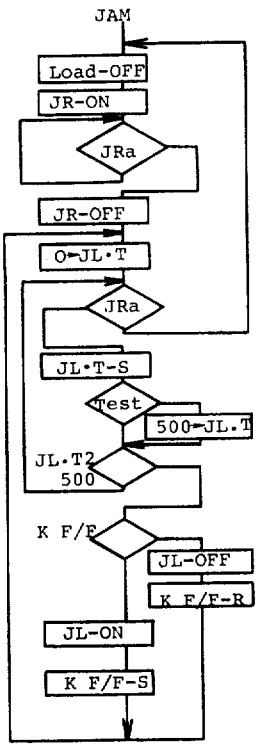

In FIG. 32, all the loads are placed into the OFF state when finding out jam. LB is fetched from the 50th step of p 5 as illustrated in FIG. 23, thereby designating (0) of the RAM 50. The succeeding instruction $TR_1$ enables jump into the sub-routine $P_0$ (FIG. 28). $TR_1$ ($P_0$, 6th step) is fetched and $P_1$ is again jumped to execute the instruction LAX ($P_1$, 54 step). Due to LAX the accumulator A is modified into "0000" and (0) of the RAM 50 assigned by EXCI also assumes "0000". After the contents of the RAM 50 are all modified into "0" as shown in FIG. 35, RTN is fetched returning to the main routine from the sub-routine. LAX at the 58th step of $P_5$ is executed so that the register F assumes "0000" in response to ATF without development of the control signals.

LB designates (12) of the RAM 50 (see FIG. 35). $P_{10}$ is jumped in response to SSR/TR0 instruction. SM (35th step) permits the 3rd bit of (12) of the RAM 50 designated by LB to store "1", indicating that the jam relay JR is turned ON in FIG. 35. TR1 enables jump into the sub-routine where the contents of the RAM shown in FIG. 35 are transferred into the register $W_1$-$W_{15}$ within the control element 30. The flip-flop NP is set and the register $W_1$-$W_{15}$ provides control signals to turn ON the jam relay JR. After that, the jam relay contact JR-a is judged as illustrated in the flow chart of FIG. 32. If the jam relay contact JR-a operates, the jam relay JR is turned OFF. Once the jam relay JR operates its associated contact JR-a is held in the closed state, the contact JR-a may be manually released.

The jam relay contact JR-a is confirmed until it delcines to the NO site and the jam relay JR is turned OFF after completing such confirmation. The jam lamp timer JLT is reset to repeat confirmation of the contact JR-a. In this case "YES" is answered. If the contact JR-a is open due to any cause, the above discussed operation is repeatedly carried out. In case of "YES" the jam lamp timer JLT starts to operate to judge the jam lamp timer JLT. JLT is judged as "YES" after a predetermined period of time has expired. The jam lamp JL is turned ON thereby indicating jam or error state and setting the K flip-flop. After the jam lamp timer JLT is reset, operation of the timer is repeated. If "YES" is answered in judging the jam lamp timer JLT, the K flip-flop is judged. Since the K flip-flop is in the set state, the jam lamp JL is OFF and the K flip-flop is reset. The jam lamp JL blinks each time the period determined by the jam lamp timer JLT has elapsed, indicating the jam state. The determined period is, for example, 500 msec.

LB is fetched at the 40th step as shown in FIG. 18. The designation (19) of the RAM 50 is assigned and TR1 permits the designation (19) to store "0". Subsequently, $TR_1$ at the 42th step enables sub-routine jumb and executes judgement as to the jam relay contact JR-a. In this case "YES" is answered and $TR_1$ is fetched at the 44th step thereby initiating operation of the timer. Therefore, LB at the 57th step of the sub-routine page $P_0$ (see FIG. 28) is fetched to designate (19) of the RAM 50. Jump is effected because of $TR_0$ and the 51st step of $P_3$ (see FIG. 25) is jumped due to SSR/$TR_1$ instruction. LAX is fetched, which permits the accumulator A to assume "0001". LAX is skipped and thus ADD11 is executed. ADD11 performs addition of the contents of the accumulator A and the contents of the RAM 50 addressed (that is, "0000" is the designation (19)), the results being transferred back to the accumulator A. In conclusion, the accumulator A assumes "0001". Because the adder FA carries "0" during ADD11 execution, the next instruction is skipped with executing EXC. For this reason the contents "0001" of the accumulator A are supplied to the designation (19) of the RAM 50. RTN is called back for return to the main-routine.

Thereafter, as viewed from FIG. 18, $TR_1$ at the 45th step is fetched to execute test judge. Since "NO" is answered, $TR_0$ is fetched which enables jump within the same page to fetch LB.

LB designates the position (11) of the RAM 50. In the event that the 1st bit of the designation (11) stores "1" due to the instruction TM, the next instruction is skipped. However, since the 1st bit bears "0" in this case, $TR_0$ enables jump within the same page to judge the jam relay contact JR-a. This implies that the jam lamp timer JLT is judged. When the 1st bit of the designation (11) of the RAM 50 bears "1", LB at the 52nd step is fetched to examine the K flip-flop.

Although the designation (19) of the RAM 50 assumes "0001", "YES" is answered when the designation (11) of the RAM 50 is "0010" during judgement is to the jam lamp timer JLT. Because the designation (11) of the RAM 50 assumes "0000" in this case, "NO" is resulted. By repeating the above operation, the contents of the designation (19) of the RAM 50 are modified. In other words, the designation (19) of the RAM 50 counts the number of repeated operations. When the operations are repeated 15 times, the designation (19) reaches "1111". Upon the 16th operation LAX at the 51th step modifies the accumulator A into "0001". ADD11 executes addition of "0001" of the accumulator A and "1111" of the designation (19) of the RAM 50 now addressed. As a result, the adder FA outputs carry "1". Execution of the next instruction $TR_0$ permits EXCI to be fetched EXCI shifts the contents of the accumulator A into the designation (19) of the RAM 50 assuming "0000". The counter BL addressing the step of the RAM 50 is one incremented with assuming "1101". The designation (7) of the RAM 50 is assigned (see FIG. 12). LAX is fetched to modify the contents of the accumulator A into "0000". ADD 11 executes addition of the contents of the accumulator A and the contents of the designation (7) of the RAM 50 plus the carry "1", the results thereof being supplied to the designation (7). Thus, the designation (7) stores "0001". When the designation (11) bears "0010", 500 msec has elapsed. Therefore, as shown in FIG. 18, LB designates (11) of the RAM 50 during judgement as to the jam lamp timer JLT. The 1st bit designated by $I_1$ and $I_2$ bears "1" and the next instruction is skipped with executing LB. When the designation (11) bears "0010", the above operation is repeated 512 times. This indicates expiration of 500 msec.

As viewed from FIG. 36, the 3rd bit of the RAM designated position (14) stores the K flip-flop. Since in the case the 3rd bit is "0", TM at the 53rd step serves to confirm the state of the K flip-flop. $TR_0$ enables jump into the same page to execute the instruction IDFR at the 58th step. IDFR resets the flip-flop IDI which provides its output IDF as control signals for the driver J2 to light the jam lamp JL. That is, when the flip-flop IDF is reset, the jam lamp JL is excited. If it is set, JL is extinguished. The jam lamp JL blink at the period of 500 msec.

Figure 39:
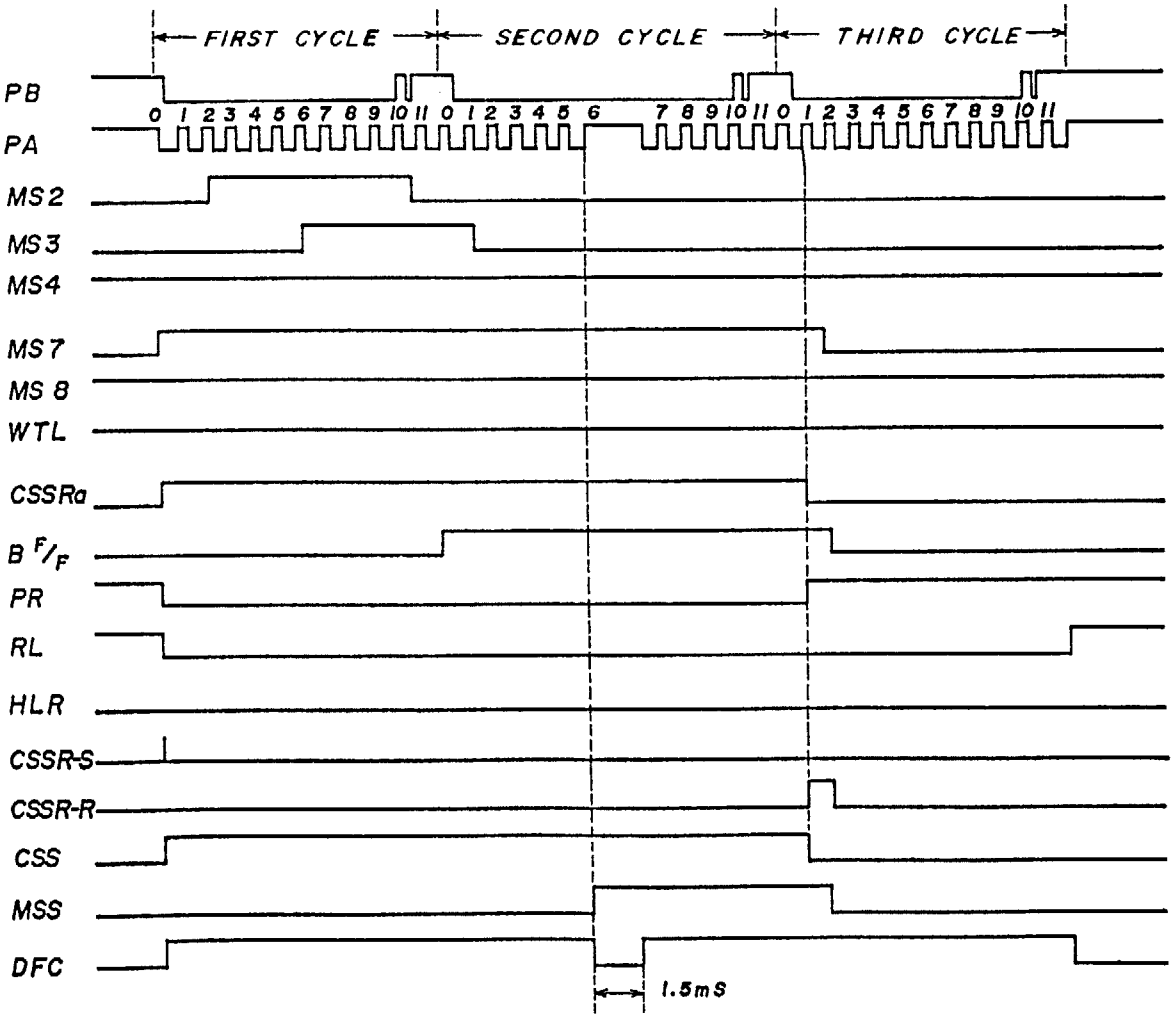
FIG. 39 is a time chart showing exchange of a photosensitive drum.

Exchange of the master paper 3 is carried out in the following manner with reference to FIG. 39.

After the rotary drum 1 rotates three times, exchange of the master paper 3 is finished. The microswitch $MS_7$ detects the introduction of the master paper 3. The arrived master paper 3 is arrested by the stopper MS. The microswitch $MS_7$ is confirmed as "YES" (see FIG. 30).

Figure 34:
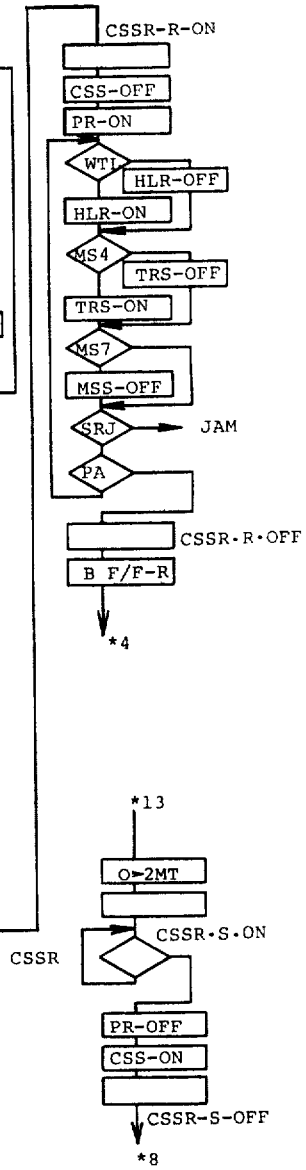

CSSR is turned ON as shown by FIG. 34. When the solenoid CSSR is released, the master paper 3 is free. When that relay is ON, its contact CSSR-a is closed. Conversely, when it is ON, the contact CSSR-a will restore to its home position. After judging CSSR-a, the power relay PR and the relay CSSR is turned OFF and the solenoid CSS is turned ON.

The drum 1 rotates and the synchronizing signals PA and PB control are exchange cycle. When the master paper 3 reaches the pick off means 15 due to rotation of the drum 1, it will be separated from the drum 1. In FIG. 31(*a*), application of the synchronizing signal PA-7 confirms the contact CSSR-a after M-7 judgement. In this case the contact CSSR-a is in the NO site to shift judgement into the microswitch $MS_2$. "YES" is obtained to confirm the microswitch $MS_3$. If $MS_3$ does not see leaving of the master paper 3, jam state is informed. Otherwise, the contents of the RAM bear "0".

The drum 1 continues to rotate to seek the initial conditions. As illustrated in the flow chart of FIG. 29, the B flip-flop is set after examining the relay contact CSSR. When the synchronizing signal PA-6 is supplied during the 2nd rotation of the drum 1, the 13 flip-flop is judged as "YES" is illustrated in FIG. 31(*a*). As a result, the master stopper solenoid MSS is turned ON after examination of $MS_7$ together with stopping of the rotation of the drum 1. To this end the stopper MS is open to introduce the master paper 3 into the interior of the machine.

Figure 33:
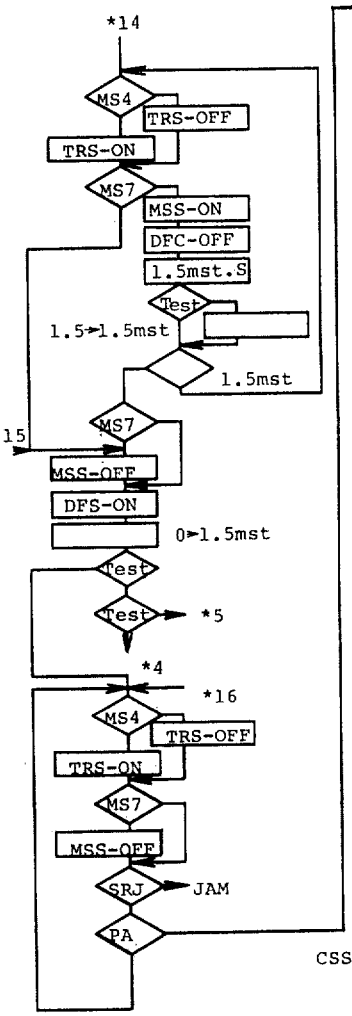

The drum 1 restarts to rotate after expiration of 1.5 msec. Thereafter, the rotary drum is set into its initial state and the B flip-flop is judged as "YES" as shown in FIG. 29. PA is judged as shown in FIG. 33, which confirms the input state of the synchronizing signal PA-1. Upon receipt of the synchronizing signal PA-1 the relay CSSR is turned ON and the solenoid CSS is turned OFF. At this time the leading edge of the master paper 3 is arrested by finger means. After the synchronizing signal PA-2 is applied. The relay CSSR is turned OFF and the B flip-flop is reset.

Afterword, the rotary drum 1 rotates until its initial state is reached. In case where CSSR is ON and CSS is OFF, the power relay PR is turned ON to light the heating lamps $HL_2$ and $HL_3$. Thus, the exchange cycle is completed.

The invention being thus described, it will be obvious that the same way be varied in many ways. Such variations are not to be regarded as a departure form the spirit and scope of the invention, and all such modifications are intended to be included within the scope of the following claims.

What is claimed is:

1. An electrophotographic copying machine comprising:

a rotatable drum on which a transferable image corresponding to an original image to be copied is formed;

master paper secured around said rotatable drum;

means for providing a uniform charge to the surface of said master paper;

light exposure station means for applying a latent image to the surface of the charged master paper thereby forming an electrostatic light image thereon;

developing station means for converting said electrostatic latent image on said master paper to a visible toner image by the application of a toner thereto;

means for feeding a copy receiving paper from an inlet means into a close contact position relative to said master paper bearing said visible toner image thereon;

means for transferring said visible toner image from said master paper to said copy receiving paper;

means for removing said copy receiving paper from said master paper after the transference of said visible toner image from said master paper to said copy receiving paper and for transporting said copy receiving paper to another position of said electrophotographic copying machine;

fixing station means downstream from said means for removing for accepting said copy receiving paper from said means for transporting and for firmly fixing said visible toner image onto said copy receiving paper by the application of heat thereto, said heat being provided by a heat source means;

roller means for advancing said copy receiving paper from said fixing station means to an outlet means;

control system means for controlling the operation of said electrophotographic copying machine as said copy receiving paper moves from said inlet means to said outlet means;

wherein said control system means comprises a predetermined number of sensing element means, each of said sensing element means developing an output signal indicative of a respective operating state of one of a plurality of operating elements of said copying machine;

drum signal generating means responsive to rotation of said rotatable drum for developing synchronizing signal indicative of the rotation of said rotatable drum and developed in synchronism in response to the rotation of said rotatable drum;

temperature control circuit means for controlling the temperature of said heat source means at said fixing station means, said temperature control circuit means generating a temperature controlling signal when the temperature of said heat source means reaches a desired temperature;

roller sensor means for sensing whether said roller means in jammed, said roller sensor means generating a roller sensor signal when said roller means is jammed;

power-on signal source means for generating a power-on signal indicative of the initiation of power to said electrophotographic copying machine.

microprocessor means responsive to said synchronizing signals, said temperature controlling signal, said roller sensor signal, and said power-on signal for generating control signals in accordance with said synchronizing signal, said temperature controlling signal, said roller signal, and said power-on signal, said microprocessor means including a ROM for storing a group or instructions, said microprocessor means utilizing said instructions to control the operating states of said plurality of operating elements of said electrophotographic copying machine by said generated signals in response to said output signals from said sensing element means;

means for generating strobe signals for interrogating a confirmation circuit means which generates signals for determining whether or not there are one or more output signals generated from said sensing element means, said strobe signals retrieving said instructions from said ROM;

means for terminating the generation of said strobe signals when said confirmation circuit means determines that there are no said output signals from said sensing element means; and means responsive to an output signal from said confirmation circuit means for constraining said means for generating strobe signals to generate said set of strobe signals a predetermined number of times in succession, when said confirmation circuit means determines that there are one or more sensing element means output signals.

2. The electrophotographic copying machine of claim 1 further comprising:

switch means for initiating operation of a print cycle under the control of said microprocessor means, said switch means placing said machine in a ready state in response to a first actuation of said switch means, said switch means initiating said said print cycle in response to a second actuation of said switch means.

3. The electrophotographic copying machine of claim 1 wherein said master paper secured around said rotatable drum is removable from said drum;

said copying machine further comprising means responsive to said control signals from said microprocessor means for replacing said master paper secured around said drum with a new master paper, said new master paper being resecured around said drum in response to energization by selected ones of said control signals generated from said microprocessor means.

4. The electrophotographic copying machine of claim 3 further comprising:

additional inlet means for introducing said new master paper to replace said master paper secured around said drum, said additional inlet means having one of said sensing element means positioned therein for sensing the presence of said new master paper;

said master paper being replaced by said new master paper at the end of the third revolution of said drum following the sensing of said new master paper by said one of said sensing element means in said additional inlet means, the replacement of said master paper with said new master paper being controlled by said control signals from said microprocessor means.

5. The electrophotographic copying machine of claim 4 wherein the replacement of said master paper with said new master paper is controlled in response to the generation of said confirmation output signals when said confirmation circuit means determines that there are one or more said sensing element output signals, said confirmation output signals energizing said microprocessor means, said microprocessor means utilizing said group of instructions stored in said ROM to generate one of said control signals for controlling the replacement of said master paper with said new master paper.

6. An electrophotographic copying maching comprising:

a rotatable support body having a light sensitive sheet disposed thereon, said light sensative sheet being held by clamping fingers at the surface of said support body;

detector means for detecting an instantaneous rotation position of said rotatable support body and developing output signals in accordance therewith;

a plurality of sensing elements, each of said sensing elements supplying an output signal indicative of a respective one of a plurality of operating states of said copying machine;

microprocessor means for processing said output signal from each of said sensing elements and developing control commands in accordance therewith, said microprocessor means further comprising, read only memory means for storing a string of instructions and for developing ROM output signals for controlling a plurality of operating elements in said copying machine in accordance with selected ones of said string of instructions, read only memory address register means for specifying individual memory regions in said read only memory means to select said instructions stored in said read only memory means, means responsive to said output signals from said detector means for modifying selected ones of said instructions stored in said read only memory means in accordance with said output signals from said detector means, read/write memory means for storing said plurality of operating states in response to the rotation of said rotatable support body, address register means for addressing said read/-write memory means, and transducer means responsive to said ROM output signals for converting said ROM output signals into control signals to control said plurality of operating elements in said copying machine; and exchange device means for exchanging said light sensitive sheet disposed on said support body with a new light sensitive sheet, the exchange of said light sensitive sheet for said new light sensitive sheet being controlled in response to said control signals from said microprocessor means, said exchange device means further comprising, first sensing switch means disposed at an inlet opening of said copying machine for sensing the presence of said new light sensitive sheet disposed therein, second sensing switch means disposed at an outlet opening of said copying machine for sensing the discharge of said light sensitive sheet after removal of said light sensitive sheet from said rotatable support body and for developing a second switch output signal in accordance therewith, and stopper means for preventing the introduction of said new light sensitive sheet into said copying machine until said second sensing switch means generates said second switch output signal, said stopper means permitting the introduction of said new light sensitive sheet when said second sensing switch means generates said second switch output signal and when said rotatable support body rotates to a basic rotation position for disposition of said new light sensitive sheet thereon.

* * * * *